US011330918B2

(12) United States Patent
Ward et al.

(10) Patent No.: US 11,330,918 B2
(45) Date of Patent: May 17, 2022

(54) FRAME ASSEMBLY

(71) Applicant: MCS INDUSTRIES, INC., Easton, PA (US)

(72) Inventors: Jay B. Ward, South Jordan, UT (US); Robert Terry Coyle, Jr., Palmer, PA (US); Matthew Scott Kressin, Allentown, PA (US)

(73) Assignee: MCS INDUSTRIES, INC.

( * ) Notice: Subject to any disclaimer, the term of this patent is extended or adjusted under 35 U.S.C. 154(b) by 0 days.

(21) Appl. No.: 17/152,962

(22) Filed: Jan. 20, 2021

(65) Prior Publication Data

US 2021/0137289 A1 May 13, 2021

Related U.S. Application Data

(63) Continuation-in-part of application No. 16/430,269, filed on Jun. 3, 2019, now Pat. No. 10,905,262, which (Continued)

(51) Int. Cl.
*A47G 1/06* (2006.01)
*A47G 1/16* (2006.01)

(52) U.S. Cl.
CPC ..... *A47G 1/06* (2013.01); *A47G 1/162* (2013.01); *A47G 2001/0677* (2013.01)

(58) Field of Classification Search
CPC .. A47G 1/06; A47G 1/162; A47G 2001/0677; A47G 2001/0694; A47G 1/142; A47G 1/1606; A47G 1/1633; F16B 2/06; F16B 2/005; F16B 2/10; F16B 2001/0028; F16M 13/022
See application file for complete search history.

(56) References Cited

U.S. PATENT DOCUMENTS 619,743 A 2/1899 Hathaway
1,342,477 A * 6/1920 Walas ..... A47G 1/06 40/779

(Continued)

FOREIGN PATENT DOCUMENTS

CN 2873007 2/2007
JP 09-266837 10/1997

(Continued)

OTHER PUBLICATIONS

International Search Report and Written Opinion as received in PCT/US2017/023071 dated Jun. 27, 2017.

*Primary Examiner* — Cassandra Davis
(74) *Attorney, Agent, or Firm* — Belles Katz LLC

(57) ABSTRACT

Embodiments of the present disclosure include an image frame assembly including a frame portion defining a viewing window and a backing panel attached to a back of the frame portion. The backing panel includes a hinge portion that rotatably couples the backing panel to the frame portion to allow the frame portion to rotate relative to the backing panel about an axis extending parallel to and proximate to an upper edge of the backing panel, a body portion extending from the hinge portion and configured to cover at least portion of a viewing window of the frame portion, and a plurality of biased members extending from the planar portion and toward the frame portion.

20 Claims, 30 Drawing Sheets

Related U.S. Application Data is a continuation of application No. 15/461,472, filed on Mar. 16, 2017, now Pat. No. 10,307,000.

(60) Provisional application No. 62/309,841, filed on Mar. 17, 2016.

(56) References Cited

U.S. PATENT DOCUMENTS

| | | | | | |
|---|---|---|---|---|---|
| 1,388,010 | A * | 8/1921 | Watson | G09F 1/12 | 40/721 |
| 3,283,431 | A * | 11/1966 | Pearlman | A47G 1/06 | 40/790 |
| 3,340,639 | A * | 9/1967 | Savage | B60R 13/105 | 40/209 |
| 3,680,239 | A | 8/1972 | Andrews | | |
| 4,188,740 | A * | 2/1980 | Forman | G09F 19/16 | 248/445 |
| 4,466,206 | A | 8/1984 | Meadows | | |
| 4,790,089 | A | 12/1988 | Astolfi | | |
| 5,845,425 | A | 12/1998 | Leake et al. | | |
| 5,996,815 | A * | 12/1999 | Walters | G11B 33/0483 | 211/40 |
| 6,070,350 | A | 6/2000 | Tone et al. | | |
| 6,234,329 | B1 * | 5/2001 | Loew | A47F 5/0087 | 16/346 |
| 8,381,661 | B2 * | 2/2013 | Hilde | A47B 43/00 | 108/42 |
| 8,667,721 | B2 * | 3/2014 | Heeps | G11B 33/0416 | 40/779 |
| 8,800,188 | B1 * | 8/2014 | Fishel | A47B 5/00 | 40/711 |
| 9,833,086 | B2 * | 12/2017 | Forrest | A47G 1/06 | |
| 10,307,000 | B2 | 6/2019 | Ward | | |
| 2005/0044764 | A1 | 3/2005 | Decker | | |
| 2008/0313945 | A1 | 12/2008 | Schaiewitz | | |
| 2010/0139140 | A1 | 6/2010 | Morgan et al. | | |

FOREIGN PATENT DOCUMENTS

| | | |
|---|---|---|
| KR | 20-0433829 | 8/1984 |
| KR | 20-0443480 | 2/2009 |
| KR | 10-0987907 | 10/2010 |
| WO | WO 2017/161337 | 9/2017 |

* cited by examiner

FRAME ASSEMBLY

CROSS-REFERENCE TO RELATED APPLICATION(S)

This application is a continuation-in-part of U.S. patent application Ser. No. 16/430,269, filed Jun. 3, 2019, which is a continuation of U.S. patent application Ser. No. 15/461,472, filed Mar. 16, 2017, now U.S. Pat. No. 10,307,000, which claims the benefit of U.S. Provisional Patent Application Ser. No. 62/309,841 filed Mar. 17, 2016. The aforementioned applications are hereby incorporated by reference in their entirety.

BACKGROUND

Picture frames are a common item used for the decoration and display of many types of images, such as artwork, photo prints, posters, etc. However, with conventional frames, inserting images into the frame and/or changing images within the frame is typically inconvenient and/or difficult because the frame requires almost a full disassembly in order to access and remove and replace a current image in the image frame with a new image.

For example, when using a conventional frame, a user must remove the frame from a wall, find a flat stable location to lay the frame face down, risk damage to a working surface or the frame, and remove any backing materials (e.g., cardboard backing held with metal tabs) that support the image. For example, the backing material is commonly installed with flexible metal tabs and/or staples that a user is required to bend (e.g., bend with a screw driver) in order to access an image within the frame. Furthermore, due to the need to bend the metal tabs and/or staples, the image within the frame, the frame and the glass are sometimes damaged (or at risk of damage) in the process of removing and/or replacing the image. Furthermore, after replacing the image, the backing material must be replaced, the metal tabs and/or staples re-bent, and the frame rehung on the wall.

Due to the inconvenience inherent in changing images within conventional frames, users tend to avoid changing images. In particular, many users may prefer to simply buy a new frame for new pictures, rather than deal with the time and hassle required for changing an image using conventional picture frames. As such, the decoration utility of conventional frames often becomes stale and mundane over time.

Accordingly, these and other disadvantages exist with respect to conventional image frames.

SUMMARY

The various embodiments described below provide benefits and/or solve one or more of the foregoing or other problems with conventional picture frames. For example, one or more embodiments described herein include an image frame assembly that allows for a quick and simple method for replacing images within the image frame assembly without removing the image frame assembly from a wall (e.g., a wall upon which the image frame assembly is hung) and without a need for removing backing material from the image frame assembly.

For instance, one or more embodiments of the present disclosure includes an image frame assembly having a frame portion that is rotatably coupled to a backing panel that can be attached to (e.g., hung from) a wall. The backing panel includes a plurality of biased members that apply pressure to an image within the image frame assembly to hold the image in place (e.g., against a glass pane and/or rabbet portion of the image frame assembly). As a result, in order to insert and/or exchange an image within the image frame assembly, a user lifts the frame portion from (e.g., rotates the frame portion relative to) the backing panel (e.g., opens the image frame assembly), if necessary, removes an image from within the image frame, places a new image in the image frame (against the glass or rabbet), and lowers the frame portion against the backing panel (e.g., closes the image frame assembly). Accordingly, because the image frame assembly of the present disclosure enables a user to exchange images within an image frame assembly without removing backing material and without removing the image frame assembly from a wall, the image frame assembly of the present disclosure provides and easier, faster, and more simple method of exchanging images within an image frame assembly while reducing or eliminating the risk of damage to the image and/or frame itself.

In one embodiment, the invention may be a frame assembly comprising: a frame comprising a front surface, a rear surface opposite the front surface, a rabbet defined by an inner surface and a floor, and a viewing window; one or more retaining members coupled to the frame along the inner surface of the rabbet, a first portion of the one or more retaining members protruding from the inner surface of the rabbet and being spaced apart from the floor of the rabbet by a gap; a transparent panel located in the rabbet and positioned in the gap between the first portion of the one or more retaining members and the floor of the rabbet, the transparent panel covering the viewing window; a hinge member comprising a front surface and a rear surface, the hinge member being alterable between: (1) a folded position whereby a first portion of the hinge member overlaps a second portion of the hinge member so that the front surface of the hinge member along the first portion faces the front surface of the hinge member along the second portion; and (2) an extended position whereby the first portion of the hinge member is rotated away from the second portion of the hinge member; and wherein the rear surface of the frame is coupled to the rear surface of the hinge member along the first portion of the hinge member such that altering the hinge member from the folded position to the extended position pivots the frame from a closed position to an open position.

In another embodiment, the invention may be a frame assembly comprising: a stand comprising a horizontal support portion and a vertical display portion extending upwardly from the horizontal support portion, the vertical display portion comprising a hinge portion and at least one biased member; a frame comprising a rabbet and a display window, the frame leaning against the vertical display portion of the stand and coupled to the hinge portion of the vertical display portion of the stand; and wherein the frame is pivotable between: (1) a first position whereby the hinge portion of the vertical display portion of the stand is in a folded position and a display item is pressed against the rabbet of the frame by the at least one biased member; and (2) a second position whereby the hinge portion of the vertical display portion rotates from the folded position to an extended position, thereby rotating a portion of the frame away from the vertical display portion so that the display item can be removed from the rabbet.

In yet another embodiment, the invention may be a frame assembly comprising: a frame comprising a front surface, a rear surface, a first rabbet, and a second rabbet, the second rabbet being positioned between the first rabbet and the rear surface; a transparent panel coupled to the frame within the first rabbet; a backing panel configured to be mounted to a wall, the backing panel comprising a body portion comprising a plurality of biased members and a hinge portion; wherein the frame is coupled to the hinge portion so that the frame can be pivoted relative to the body portion of the backing panel between a closed position whereby the biased members of the backing panel are configured to press a display item against a floor of the second rabbet of the frame and an open position whereby a portion of the frame is configured to be pivoted away from the wall so that the display item can be removed.

In a further embodiment, the invention may be a frame assembly comprising: a backing panel configured to be mounted on a support surface, the backing panel comprising a body portion and a hinge portion, the hinge portion formed by a segment of the backing panel being folded about a fold line of the backing panel; a frame comprising a lower frame member that is coupled to the hinge portion of the backing panel and an upper frame member that is coupled to the body portion of the backing panel, wherein the frame is configured to be pivoted relative to the body portion of the backing panel about the fold line while the backing panel remains mounted on the support surface; and one or more biased members configured to press an item positioned between the frame and the backing panel in a direction towards the frame.

Additional features and advantages of the embodiments will be set forth in the description that follows, and in part will be obvious from the description, or may be learned by the practice of such example embodiments. The features and advantages of such embodiments may be realized and obtained by means of the instruments and combinations particularly pointed out in the appended claims. These, and other features, will become more fully apparent from the following description and appended claims, or may be learned by the practice of such example embodiments as set forth hereinafter.

BRIEF DESCRIPTION OF THE DRAWINGS

The detailed description is described with reference to the accompanying drawings in which.

DETAILED DESCRIPTION

Figure 1:
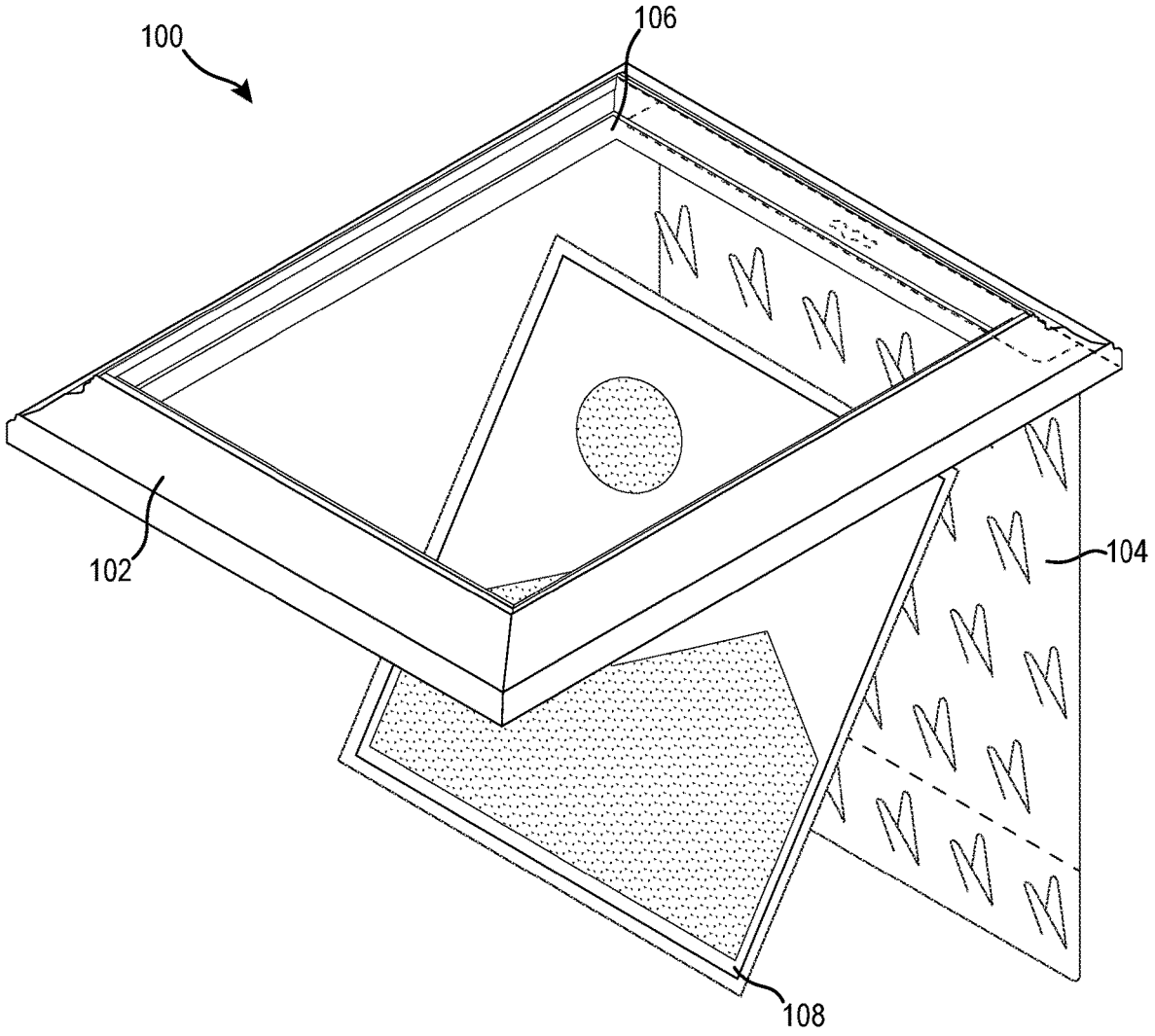
FIG. 1 shows a perspective view of an image frame assembly according to one or more embodiments of the present disclosure.

The various embodiments described herein provide an image frame assembly (e.g., picture frame) that enables a user to quickly and simply place an image (e.g., photo print) in the image frame assembly and/or exchange an image within the image frame. In some embodiments, an image frame assembly includes a frame portion (e.g., outer frame) that is rotatably coupled (e.g., attached) to a backing panel having a plurality of biased members for holding an image within the frame portion. In additional embodiments, the image frame assembly includes a frame portion that is rotatably coupled to a plurality of connected backing panels, each backing panel having a plurality of biased members for holding an image within the frame portion.

As noted above, in some embodiments, the image frame assembly includes a frame portion that is rotatably coupled to a backing panel having a plurality of biased members for holding an image within the frame portion. In one or more embodiments, the backing panel may include a hinge portion, for example, a movable joint or mechanism about which an attached member rotates as it opens and closes. Specifically, the frame portion may be coupled (e.g., connected) to the hinge portion such that the frame portion may rotate about an axis of rotation of the hinge portion. As such, the hinge portion allows the frame portion to rotate with respect to the backing panel allowing a user to "open" the frame assembly by rotating the frame portion away from the backing panel, as well as allowing a user to "close" the frame assembly by rotating the frame portion towards the backing panel.

Furthermore, as mentioned above, the backing panel includes a plurality of biased members. In particular, the plurality of biased members extend from the backing panel to provide support for an image within the image frame assembly (e.g., press the image up against a transparent panel (e.g., glass pane) and/or rabbets of the frame portion). In some embodiments, the biased members have a non-load position that extends away from the backing panel and towards the frame portion, or more particularly, towards a transparent panel of the frame portion. When a user closes the frame assembly, the biased members are placed in a load position to exert a force against the transparent panel, and accordingly, when an image is placed between the backing panel and the transparent panel, the biased members hold the image is in place against the transparent panel.

In view of the foregoing, in operation, a user may open the image frame assembly while hung on a surface (e.g., hung on a wall) by merely rotating (i.e., swinging) the frame portion (e.g., lifting the frame portion) about the hinge portion in a first direction (e.g., away from the backing panel) to release an image that was held between the biased members of the backing panel and the frame portion (e.g., a transparent panel), and remove the image from within the frame assembly. For instance, when the frame assembly is open, the backing panel remains against (e.g., flat against) the wall, thereby releasing the image and providing the user access to grasp the image and remove the image from the frame assembly.

Additionally, when the frame assembly is open, the user may place an image within the image frame assembly (e.g., against the plurality of biased members or against the glass pane and/or rabbet of the image frame). Once an image is placed within the image frame assembly, the user may close the image frame assembly by rotating the frame portion about the hinge portion in a second opposite direction (e.g., toward the backing panel). By closing the image frame assembly, the plurality of biased members of the backing panel press the image up against the transparent panel and/or rabbets of the frame portion, and thus, hold the image in place within the frame assembly.

In, additional embodiments, the image frame assembly includes a frame portion that is rotatably coupled to a plurality of connected backing panels each having a plurality of biased members for holding an image within the frame portion. In particular, a plurality of backing panels may be connected together via biased members of the backing panels as is discussed in greater detail below. As a result, multiple backing members can be connected together to accommodate differing sized frame portions and/or differing sized images. Accordingly, the image frame assembly of the present disclosure is advantageous over conventional image frames by providing a "one size fits all" backing panel.

Furthermore, in some embodiments, a user can use the unique backing panel disclosed herein to retrofit a conventional picture frame. For example, the backing panel disclosed herein is coupleable to a traditional frame portion of a conventional picture frame. Accordingly, a traditional frame can be retrofitted with the backing panel to impart at least some of the advantages of the backing panel to the traditional picture frame.

Because the image frame assembly enables a user to remove, insert, and/or exchange an image within the image frame assembly while the image frame remains hung on a wall by merely rotating the frame portion about the hinge portion to open and close the frame assembly, the image frame assembly provides a more convenient, more simple, and faster method for removing, inserting and/or exchanging images within image frames in comparison to conventional picture frames. In particular, and unlike conventional picture frames, the image frame assembly avoids a full disassembly of the image frame assembly (e.g., unhanging the image frame, bending metal tabs, removing a backing material, replacing the backing material, and re-bending the metal tabs often required by conventional picture frames). As a result, the image frame assembly reduces time required to remove, insert, and/or exchange images within the image frame assembly in comparison to conventional picture frames, and thus, provides a more versatile and efficient framing option for users.

As used herein, the term "image" may refer to one or more of a picture, piece of artwork, photo print, poster, document, or similar display object of varying thickness or rigidity. For example, an image can include a print of a digital photo, a photograph from developed film, a poster, document for display, or any other type of object that can be displayed within an image frame. Accordingly, in general, the term image refers to any object having dimensions (i.e., length, width, and thickness) to be displayed using the image frame assembly described herein.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational terms such as "first," "second," and "third," "outer," "inner," "upper," "lower," "upward," "top," "bottom," "lateral," "longitudinal," etc., and derivative terms, are for clarity and convenience in understanding the present disclosure and accompanying drawings and do not connote or depend on any specific preference, orientation, or order, except where the context clearly indicates otherwise. For example, the relational terms may refer an orientation of an image frame assembly hung on a surface (e.g., a wall) in a typical fashion.

FIG. 1 shows a perspective partially exploded view of an image frame assembly according to one or more embodiments of the present disclosure. As illustrated, the image frame assembly 100 may include a frame portion 102, a backing panel 104, and a transparent panel 106. As shown in FIG. 1, the transparent panel 106 may be disposed within the frame portion 102 (e.g., within a viewing window defined by an outer frame of the frame portion 102). In some embodiments, the transparent panel 106 may be secured (e.g., attached) to the frame portion 102 via one or more of push points, edging strips, glue (e.g., hot glue), or any other adhesive, or mechanical means. Furthermore, the frame portion 102 may be coupled (e.g., attached) to the backing panel 104 along a frame member (e.g., an upper frame member) of the frame portion 102. In other embodiments, the frame portion 102 and the backing panel 104 may include a single uniform body (e.g., injected molded "unibody").

Additionally, as will be discussed in greater detail below, the frame portion 102 may be rotatably coupled to the backing panel 104 such that the frame portion 102 and the transparent panel 106 are rotatable relative to the backing panel 104. For example, the frame portion 102 may be rotated relative to the backing panel 104 (e.g., lifted up) in order to separate a lower portion (e.g., a lower frame member) of the frame portion 102 from the backing panel 104 (e.g., open the image frame assembly 100 as shown in FIG. 1). As will be discussed in greater detail below, upon opening the image frame assembly 100, an image 108 (e.g., a photo print) can be removed from the image frame assembly, inserted into the image frame assembly 100, and/or otherwise exchanged within the image frame assembly 100.

Figure 2A:
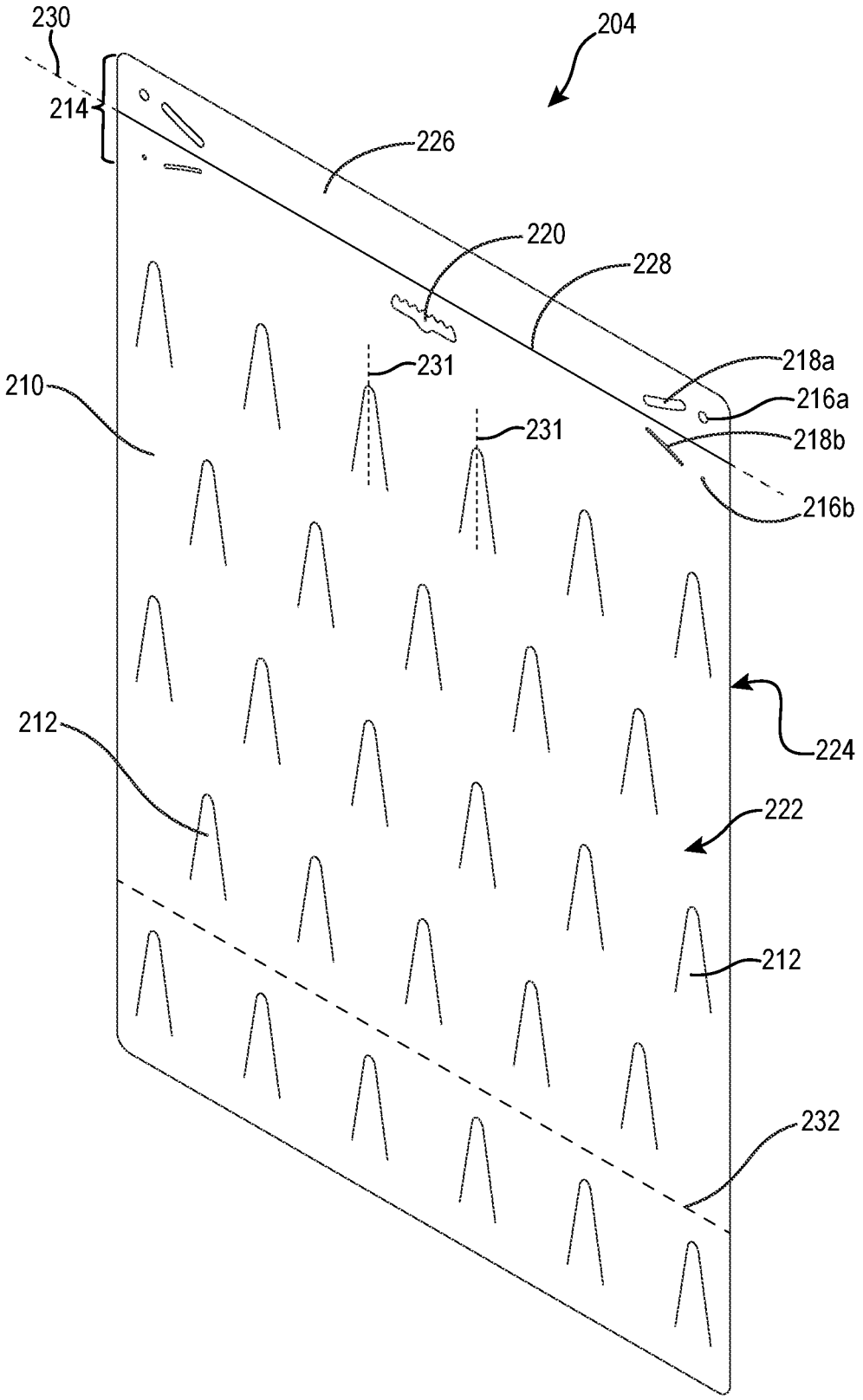
FIG. 2A shows a perspective view of a backing panel of an image frame assembly having a hinge portion in an extended position and a plurality of biased members according to one or more embodiments of the present disclosure.
Figure 2B:
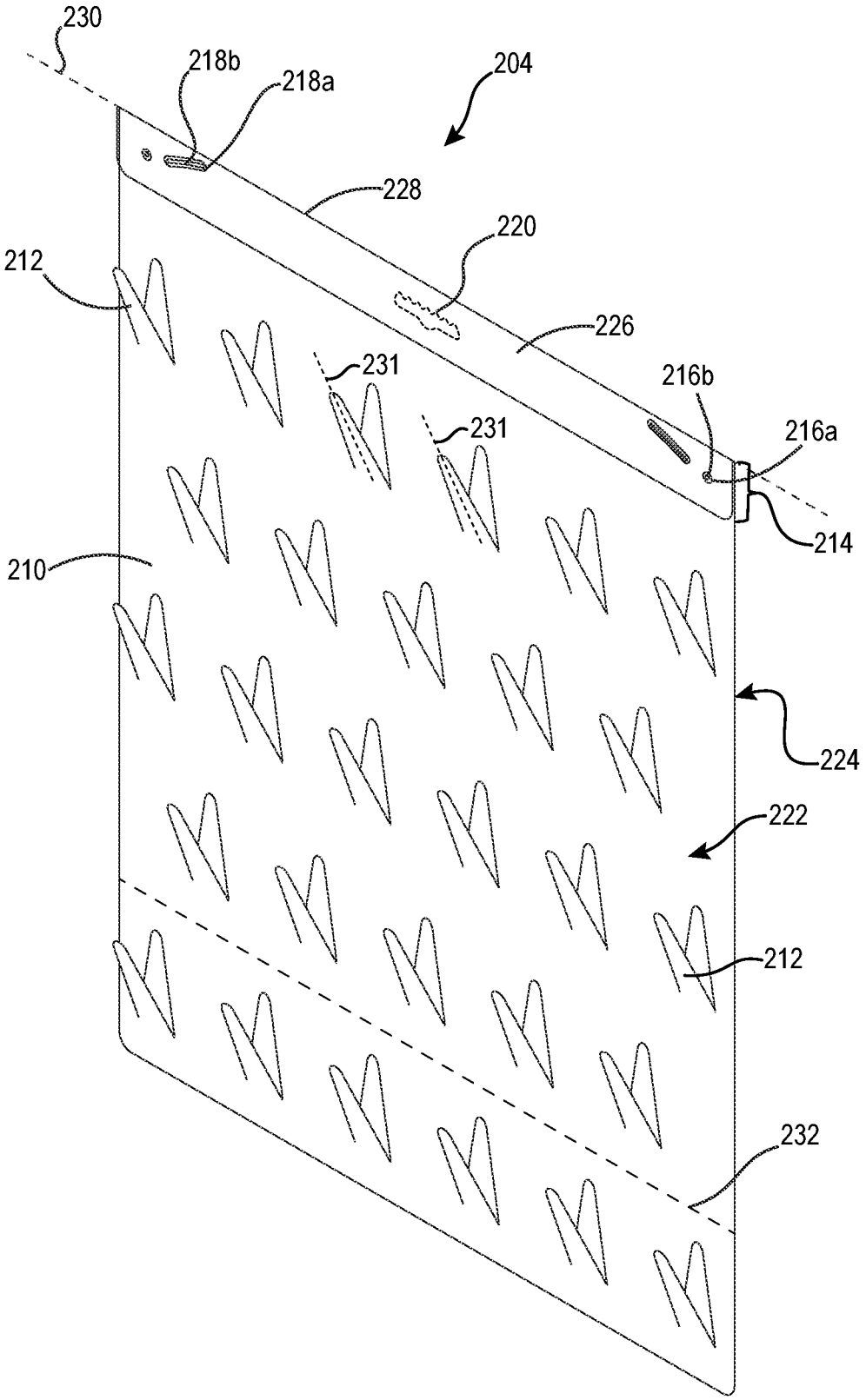
FIG. 2B shows a perspective view of the backing panel of FIG. 2A having the hinge portion in a folded position according to one or more embodiments of the present disclosure.

FIG. 2A illustrates a perspective view of a backing panel 204 of an image frame assembly according to one or more embodiments of the present disclosure. FIG. 2B illustrates another perspective view of the backing panel 204 of FIG. 2A. Referring to FIGS. 2A and 2B together, the backing panel 204 can include a body portion 210, a plurality of biased members 212, a hinge portion 214, a plurality of fastener apertures 216*a*, 216*b*, a plurality of relief apertures 218*a*, 218*b*, and a centered aperture 220.

As shown, the body portion 210 may include an inner surface 222 and an opposite parallel outer surface 224. The inner surface 222 of the body portion 210 may face a frame portion (e.g., frame portion 102) of an image frame assembly when the backing panel 204 is attached to the frame portion. Additionally, in some embodiments, the body portion 210 may be at least substantially planar (e.g., the inner surface 222 and outer surface 224 may be at least substantially parallel to each other and at least substantially planar).

Furthermore, as illustrated, the plurality of biased members 212 may be distributed throughout a plane defined by the inner surface 222 of the body portion 210. For example, the plurality of biased members 212 may be distributed throughout the plane in a pattern (e.g., array). Moreover, in some embodiments, the plurality of biased members 212 may be at least generally evenly (e.g., uniformly) spaced across the body portion 210. Although, in other embodiments, the plurality of biased members 212 may be distributed in what appears to be a random distribution across the body portion 210. Furthermore, although the backing panel 204 is described herein as having a plurality of biased members 212, the disclosure is not so limited. Rather, the backing panel 204, in some embodiments, may include a single biased member.

In some embodiments, each biased member of the plurality of biased members 212 may include a partial cutout (e.g., stencil cutout) of the body portion 210 of the backing panel 204. Furthermore, as shown in FIG. 2B, each biased member of the plurality of biased members 212 may be at least partially raised relative to the body portion 210 of the backing panel 204. For example, a portion of each biased member of the plurality of biased members 212 may be separated from the body portion 210 of the backing panel 204 by at least some distance. Specifically, each biased member of the plurality of biased members 212 may be attached to the body portion 210 of the backing panel 204 at a bottom (e.g., a base) of the biased member 212, and a top of each biased member of the plurality of biased members 212 may be separated from the body portion 210.

For instance, each biased member of the plurality of biased members 212 may be bent away from the from the body portion 210 of the backing panel 204. Additionally, when raised relative to the body portion 210 of the backing panel 204 and when the backing panel 204 is attached to a frame portion (e.g., frame portion 102), each biased member of the plurality of biased members 212 may extend toward the frame portion. Additionally, a longitudinal axis 231 of each biased member of the plurality of biased members 212 may extend in an upward direction. As a result, the plurality of biased members 212 may be less likely to catch on (e.g., snag) images as the images are inserted (e.g., slid) into image frame assembly. Although, in other example embodiments, the plurality of biased members 212 may extend in a downward direction, sideward direction, or other direction as a particular application may dictate.

In addition, the backing panel 204 can include an amount of biased members 212 having dimensions that combine to create a load force to securely hold an image in place between the plurality of biased members 212 and the transparent panel 106 (FIG. 1) when the plurality of biased members 212 are pressed into contact with the transparent panel 106 (FIG. 1) (e.g., when the frame assembly 100 is in the closed position). For example, the amount of biased members 212 can vary from one embodiment to the next depending on the size and weight of an image or the size of the viewing window within the frame portion 102 (FIG. 1). In one or more embodiments, the number of biased members 212 is determined in order to provide an even distribution of the load force across the image 108 (FIG. 1) such that when viewing the image displayed in the frame assembly 100, the image does not show indications of the location of any particular biased member (e.g., any indentations).

Similarly, each of the plurality of biased members 212 have dimensions to provide an individual load force (e.g., the load force for an individual biased member) needed to generate the combined load force to securely hold an image in place between the plurality of biased members 212 and the transparent panel 106 when the plurality of biased members 212 are pressed into contact with the transparent panel 106 (e.g., when the frame assembly 100 is in the closed position). For example, the plurality of biased members 212 can include a base dimension (e.g., portion attached to the body portion 210) to create a sufficient load force to an image that, when combined with the individual load forces of the other biased members, holds the image in place within the frame portion. Per the principles described herein, it is appreciated that the base width, for example, will vary depending on the size and weight of the image to be displayed within the image frame assembly 100.

In addition to various base dimensions, the plurality of biased members 212 may have a sufficient extension length to accommodate various styles of frame portions (e.g., frame portions have differing depths). For example, depending on a particular frame portion 102 (FIG. 1) design, a distance between the backing panel 204 and the transparent panel 106 (FIG. 1) can vary. Accordingly, the extension length of the plurality of biased members 212 can be a length that, when the frame assembly is in a closed position, causes the biased members 212 to interact with the transparent panel 106 (FIG. 1) and generate a sufficient combined load force to securely hold an image between the backing panel 204 and the transparent panel 106 (FIG. 1).

As a non-limiting example, each biased member of the plurality of biased members 212 may have an at least general rounded triangle shape (e.g., rounded peak shape) with a base of the triangle shape being attached (e.g., still attached) to the body portion 210. Furthermore, in such embodiments, a peak portion of each biased member of the plurality of biased members 212 may be separated from the body portion 210 of the backing panel 204 by at least some distance. The plurality of biased members 212 are discussed in greater detail below in regard to FIGS. 7A-7E and 14.

In addition to the plurality of biased members 212, as mentioned above, the backing panel 204 includes the hinge portion 214. Furthermore, the hinge portion 214 may be disposed proximate a top edge of the backing panel 104. As will be discussed in greater detail below, the hinge portion 214 may include a folded portion of the backing panel 204. For example, the hinge portion 214 can include an upper segment 226 of the backing panel 204 folded back on the backing panel 204 (e.g., formed by a segment of the backing panel 204 folded back on itself). In some embodiments, the upper segment 226 may include an uppermost portion of the backing panel 204. Furthermore, in one or more embodiments, the hinge portion 214 may rotatably couple a frame portion (e.g., frame portion 102) to the backing panel 204.

In particular, and as shown in FIGS. 2A-2B, the hinge portion 214 may include a linear folding line 228 disposed at a boundary of the upper segment 226 (e.g., at a boundary of the upper segment 226 and the reminder of the backing panel 204) and extending across the body portion 210 (e.g., from a first lateral end to a second opposite lateral end of the backing panel 104) of the backing panel 204 and in a direction at least substantially parallel to a longitudinal edge of the backing panel 204. Additionally, in some embodiments, the folding line 228 may extend in a direction at least substantially perpendicular to a direction in which the longitudinal axes 231 of the plurality of biased members 212 extend. Accordingly, the hinge portion 214 of the backing panel 204 may be a foldable portion of the backing panel 204 where the upper segment is foldable toward the body portion 210 along the folding line 228, as illustrated in FIG. 2B. For example, the hinge portion 214 may have an open position (e.g., an unfolded position illustrated in FIG. 2A) and a closed position (e.g., the position illustrated in FIG. 2B). Moreover, the folding line 228 may define an axis of rotation 230 about which, when a frame portion (e.g., frame portion 102) is attached to the backing panel 204, the frame portion may rotate relative to the backing panel 104. In particular, in some embodiments, the axis of rotation 230 may be collinear with the folding line 228. Furthermore, when the backing panel 204 is hung on a surface, the axis of rotation 230 may extend in an at least substantially horizontal direction.

In operation, a frame portion (e.g., frame portion 102) may be coupled to the upper segment 226 of the hinge portion 214 of the backing panel 204. In particular, an upper frame member of the frame portion may be coupled to an outer surface 224 of the upper segment 226 of the hinge portion 214. Furthermore, once coupled to the hinge portion 214, the frame portion may be rotatable back and forth (e.g., opened and closed) about the axis of rotation 230. For example, a user may open an image frame assembly by lifting the frame portion and causing the hinge portion 214 to move (e.g., rotate) from a closed position (FIG. 2B) to an open position (FIG. 2A). Upon a user lifting the frame portion, the plurality of biased members 212 of the backing panel 204 may lose contact and/or release a pressure on an image within the image frame assembly such that a user can remove the image out of the image frame assembly. Furthermore, the user may close the frame assembly by lowering the frame portion and causing the hinge portion 214 to move (e.g., swing) from an extended position (FIG. 2A) to a folded position (FIG. 2B). The hinge portion 214 are described in greater detail below in regard to FIGS. 3A-4B.

Additionally, as noted above, the backing panel 204 may include the plurality of fastener apertures 216*a*, 216*b*, the plurality of relief apertures 218*a*, 218*b*, and the centered aperture 220. Furthermore, the plurality of fastener apertures 216*a*, 216*b*, the plurality of relief apertures 218*a*, 218*b*, and the centered aperture 220 may be disposed proximate the upper edge of the backing panel 204 and may extend through the body portion 210 (e.g., extend from the inner surface 222 to the outer surface 224 of the backing panel 204). In some embodiments, the plurality of fastener apertures 216*a*, 216*b*, the plurality of relief apertures 218*a*, 218*b*, and the centered aperture may also extend through the hinge portion 214 of the backing panel 104.

In one or more embodiments, the plurality of fastener apertures 216*a*, 216*b* and the plurality of relief apertures 218*a*, 218*b* may be oriented proximate to lateral ends of the backing panel 204. Furthermore, in some embodiments, the plurality of fastener apertures 216*a*, 216*b* may include a first fastener aperture 216*a* on one side of the folding line 228 (e.g., extending through the upper segment 226 of the hinge portion 214) and a second corresponding fastener aperture 216*b* on an opposite side of the folding line 228. Moreover, the first fastener aperture 216*a* and the second corresponding fastener aperture 216*b* may be oriented such that when the hinge portion 214 is folded along the folding line 228, the first fastener aperture 216*a* and the second corresponding fastener aperture 216*b* are aligned such that a fastener (e.g., a nail) can extend through the second corresponding fastener aperture 216*b* and at least partially through the first fastener aperture 216*a* simultaneously.

For example, as shown in FIG. 2A, in some embodiments, the first fastener aperture 216*a* may be larger in circumference than the second corresponding fastener aperture 216*b*. As a result, when a fastener (e.g., a nail) is extending through the second corresponding fastener aperture 216*b* (e.g., fastening the backing panel 204 to a wall), a head of the fastener may extend through (e.g., rest within) the first fastener aperture 216*a*. For instance, when the hinge portion 214 is in a folded position, the head of the fastener may be disposed within the first fastener aperture 216*a* allowing the inner surface 222 of the hinge portion to be at least substantially flat against the inner surface 222 of the body portion 210 of the backing panel 204. Described another way, the first fastener aperture 216*a* may act as a countersink hole for the fastener to help prevent the head of the fastener from interfering with the coupling of a frame portion (e.g., frame portion 102) to the hinge portion 214.

Similarly, in one or more embodiments, the plurality of relief apertures 218*a*, 218*b*, may include a first relief aperture 218*a* on one side of the folding line 228 and a second corresponding relief aperture 218*b* on an opposite side of the folding line 228. Furthermore, the first relief aperture 218*a* and the second corresponding relief aperture 218*b* may be oriented such that when the hinge portion 214 is folded along the folding line 228, the first relief aperture 218*a* and the second corresponding relief aperture 218*b* are aligned. In some embodiments, the plurality of relief apertures 218*a*, 218*b* may provide flexibility within the hinge portion 214 of the backing panel 104 and may reduce stress to which the hinge portion 214 may be subjected to due to fasteners extending through the plurality of fastener apertures 216*a*, 216*b*.

In some embodiments, the centered aperture 220 may include a saw-tooth edged hole. Specifically, an upper edge of the centered aperture 220 may include a saw-tooth shape for gripping fasteners extending through the centered aperture 220 (e.g., fasteners already coupled to a wall). In one or more embodiments, the centered aperture may only extend through a portion of the hinge portion 214 below the folding line 228 such that, when the hinge portion 214 is in a folded position, the centered aperture 220 is at least partially obscured by the upper segment 226 of the hinge portion 214.

Referring still to FIGS. 2A and 2B together, in some instances, the backing panel 204 includes a perforation line 232 extending across a lower portion of the backing panel. For example, the perforation line 232 may extend from one lateral side of the backing panel 204 to an opposite lateral side of the backing panel 204. The perforation line 232 may allow a user to remove a portion of the backing panel 204 to fit a size of a given frame portion (e.g., a frame portion smaller than the backing panel 204). In additional embodiments, the perforation line 232 may allow a user to fold the backing panel 104 along the perforation line 216 in order to fit a size of a given frame portion. In additional examples, the backing panel can include multiple perforation lines at different intervals to allow a user to remove or fold along a particular perforation line of the multiple perforation lines to customize the size of the backing panel 204 to a particular frame portion size.

In one or more embodiments, the backing panel 204 may be formed from a semi-flexible planar material. For example, the backing panel 104 may include a plastic such as one or more of Polyethylene Terephthalate, High-Density Polyethylene, Low-Density Polyethylene, Polyvinyl Chloride, Polypropylene, Polystyrene, Polycarbonate, and Polylactide. In additional embodiments, the backing panel 104 may include one or more pliable materials such as, for example, rubber, foam rubber, and/or metal alloys. Additionally, the backing panel 204 may have one or more of a general rectangular shape, circular shape, or any other geometric shape.

Figure 3A:
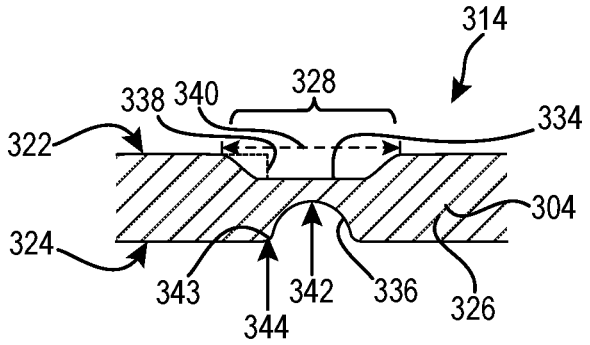
FIG. 3A shows a partial side cross-sectional view of a hinge portion of a backing panel according to one or more embodiments of the present disclosure.

FIG. 3A shows a partial side cross-sectional view of a hinge portion 314 of a backing panel of an image frame assembly according to one or more embodiments of the present disclosure. As showing in FIG. 3A, a folding line 328 may include a narrowed portion of the hinge portion 314. For example, the folding line 328 of the hinge portion 314 may include a first linear recess 334 (e.g., an at least generally uniform first linear recess) extending from the inner surface 322 of the backing panel 304 and into the backing panel 304, and a second linear recess 336 (e.g., an at least generally uniform second linear recess) extending from the outer surface 324 of the backing panel 304 and into the backing panel 304. Furthermore, the backing panel 304 may include at least some material between the first linear recess 334 (e.g., a bottom of the first linear recess) and the second linear recess 336 (e.g., a bottom of the second linear recess). For instance, neither the first linear recess 334 nor the second linear recess 336 may extend completely through the backing panel 304. In alternative embodiments, the folding line 328 may include a perforated line and may include apertures extending completely through the backing panel 304.

In some embodiments, the first linear recess 334 may be relatively shallow and may have a depth 338 within a range of about 0.0002 inches to about 0.0010 inches. For example, the first linear recess 334 may have a depth 338 of about 0.0006 inches. Furthermore, the first linear recess 334 may have a maximum width 340 within a range of about 0.035 inches to about 0.085 inches. For instance, the first linear recess 334 may have a maximum width 340 of about 0.060 inches. In other embodiments, the dimensions of the first linear recess 334 may be larger or smaller depending on a specific application or depending on the type of material used to form the backing panel 304.

Additionally, in one or more embodiments, the second linear recess 336 may have an at least general semi-circular shaped cross-section when viewed from a plane orthogonal to a direction in which the folding line 328 extends (e.g., the view illustrated in FIG. 3A). Furthermore, the second linear recess 336 may have a radius 342 within a range of about 0.020° to about 0.040°. Additionally, in some instances, intersections 343 of the second linear recess 336 with the outer surface 324 of the backing panel 304 (e.g., the edges of the second linear recess) may be rounded and may have a radius 344 within range of about 0.0025 inches to about 0.0075 inches. For example, the intersections 343 may have a radius 344 of about 0.005 inches. In other embodiments, the dimensions of the second linear recess 334 may be larger or smaller depending on a specific application or depending on the type of material used to form the backing panel 304.

In operation, the first linear recess 334 and the second linear recess 336 may allow the hinge portion 314 to more easily fold along the folding line 328. For example, the first linear recess 334 and the second linear recess 336 may allow an inner surface 322 of the upper segment 326 of the hinge portion 314, when folded along the folding line 328, to be at least substantially parallel with the inner surface 322 of the backing panel 304. For instance, the first linear recess 334 and the second linear recess 336 may allow the upper segment 326 of the hinge portion 214 to be at least substantially flat against the inner surface 322 of the backing panel 304.

Figure 3B:
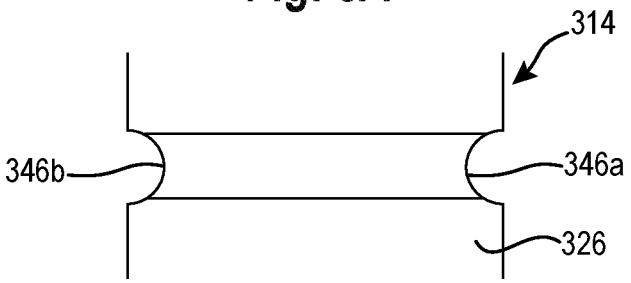
FIG. 3B shows a side view of the hinge portion of FIG. 3A according to one or more embodiments of the present disclosure.

FIG. 3B shows a partial bottom side view (e.g., a view of the outer surface 324 of the backing panel 304) of the hinge portion 314 of FIG. 3A according to one or more embodiments of the present disclosure. As shown in FIG. 3B, in some embodiments, the second linear recess 336 may include semi-circular shaped indentions 346*a*, 346*b* (e.g., cutouts) at each end of the folding line 328 and extending from an outer edge of the backing panel 304 toward a center of the backing panel 304. During use, the indentions 346*a*, 346*b* may assist in preventing the hinge portion 314 from tearing along the folding line 328.

Figure 4A:
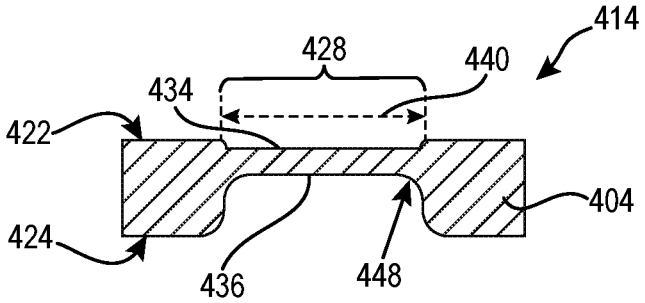
FIG. 4A shows a partial side cross-sectional view of a hinge portion of a backing panel according to another embodiment of the present disclosure.
Figure 4B:
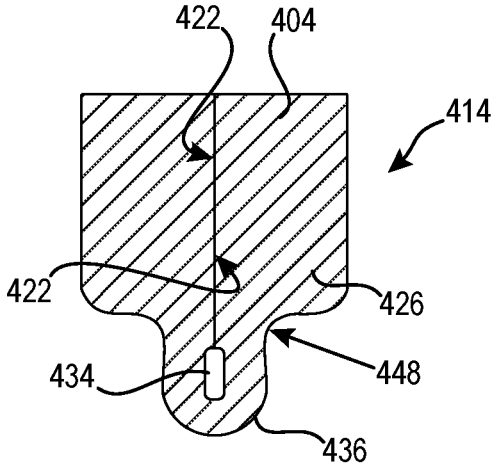
FIG. 4B shows a partial side cross-sectional view of the hinge portion of FIG. 4A in a folded position according to one or more embodiments of the present disclosure.

FIG. 4A shows a partial side cross-sectional view of a hinge portion 414 in an extended position according to other embodiments of the present disclosure. FIG. 4B shows a partial side cross-sectional view of the hinge portion 414 of FIG. 4A in a folded position. Similar to the hinge portion of FIGS. 3A and 3B, the hinge portion 414 may include a folding line 428 having a first linear recess 434 (e.g., an at least generally uniform first linear recess) extending from the inner surface 422 of the backing panel 404 and into the backing panel 404, and a second linear recess 436 (e.g., an at least generally uniform second linear recess) extending from the outer surface 424 of the backing panel 404 and into the backing panel 404.

Furthermore, the first linear recess 434 may be similar to the first linear recess 334 of FIG. 3A and may be relatively shallow and may have a depth within a range of about 0.0002 inches to about 0.0010 inches. Furthermore, the first linear recess 434 may have a maximum width 440 within a range of about 0.035 inches to about 0.085 inches. In other embodiments, the dimensions of the first linear recess 434 may be larger or smaller depending on a specific application or depending on the type of material used to form the backing panel 404.

The second linear recess 436 may have an at least general rounded rectangular cross-section when viewed from a plane orthogonal to a direction in which the folding line 428 extends (e.g., the view illustrated in FIG. 4A). Furthermore, inner rounded corners of the second linear recess 436 may have a radius 448 within a range of about 0.020° to about 0.040°. In other embodiments, the dimensions of the second linear recess 436 may be larger or smaller depending on a specific application or depending on the type of material used to form the backing panel 404.

In operation, the first linear recess 434 and the second linear recess 436 may allow the hinge portion 414 to more easily fold along the folding line 428. For example, first linear recess 434 and the second linear recess 436 may allow an inner surface 422 of the upper segment 426 of the hinge portion 414, when folded along the folding line 428, to be at least substantially parallel with the inner surface 422 of the backing panel 404 (FIG. 4B). For instance, the first linear recess 434 and the second linear recess 436 may allow the upper segment 426 of the hinge portion 414 to be at least substantially flat against the inner surface 422 of the backing panel 404. Furthermore, the first linear recess 434 and the second linear recess 436 may, when the hinge portion 414 is folded along the folding line 428, cause a stress experienced within the folding line 428 to be at least substantially uniform throughout a length the folding line 428. As a result, the first linear recess 434 and the second linear recess 436 may help to prevent failure (e.g., breaking and/or tearing) of the hinge portion 414 during use.

Figure 5A:
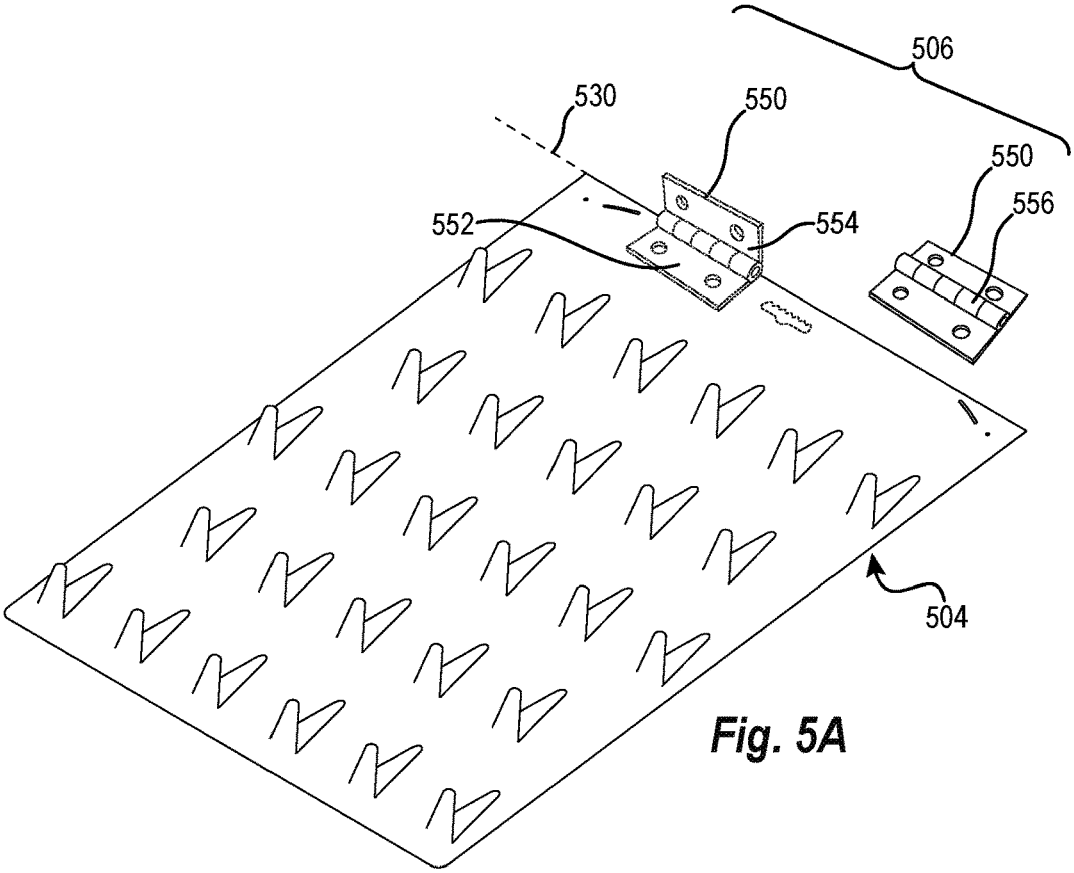
FIG. 5A shows a perspective view of a backing panel of an image frame assembly having one or more hinges attached thereto according to one or more embodiments of the present disclosure.
Figure 5B:
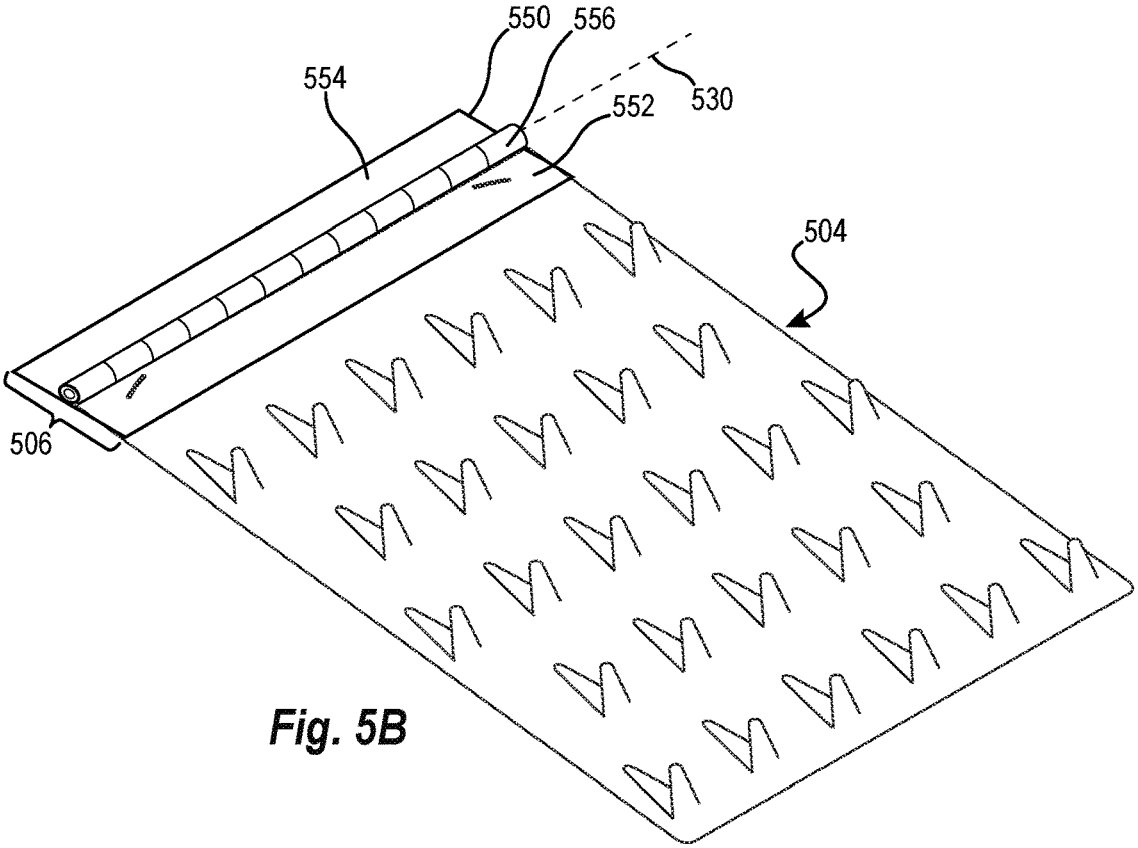
FIG. 5B shows a perspective view of a backing panel of an image frame assembly having a single hinge attached thereto according to one or more embodiments of the present disclosure.

FIG. 5A illustrates a backing panel 504 and hinge portion 506 according to another embodiment of the present disclosure. FIG. 5B illustrates a backing panel 504 and hinge portion 506 according to yet another embodiment of the present disclosure. As shown in FIGS. 5A and 5B, in some embodiments, the hinge portion 506 can include one or more butt hinges 550 having a first leave 552 of a given butt hinge 550 attached to the backing panel 504 and a second leave 554 of the given butt hinge 550 attached to the frame portion (e.g., frame portion 102) of an image frame assembly. In such embodiments, an axis of rotation 530 about which the frame portion can rotate relative to the backing panel 504 can be defined by a center of each knuckle 556 of a given butt hinge 550. In some embodiments, the one or more butt hinges 550 may include one or more of a plastic and metal material. Furthermore, the one or more butt hinges 550 may be attached to the backing panel 504 via an adhesive. Moreover, the one or more butt hinges 550 may be attached to the frame portion (e.g., frame portion 102) via one or more of an adhesive and a mechanical fastener.

Figure 6:
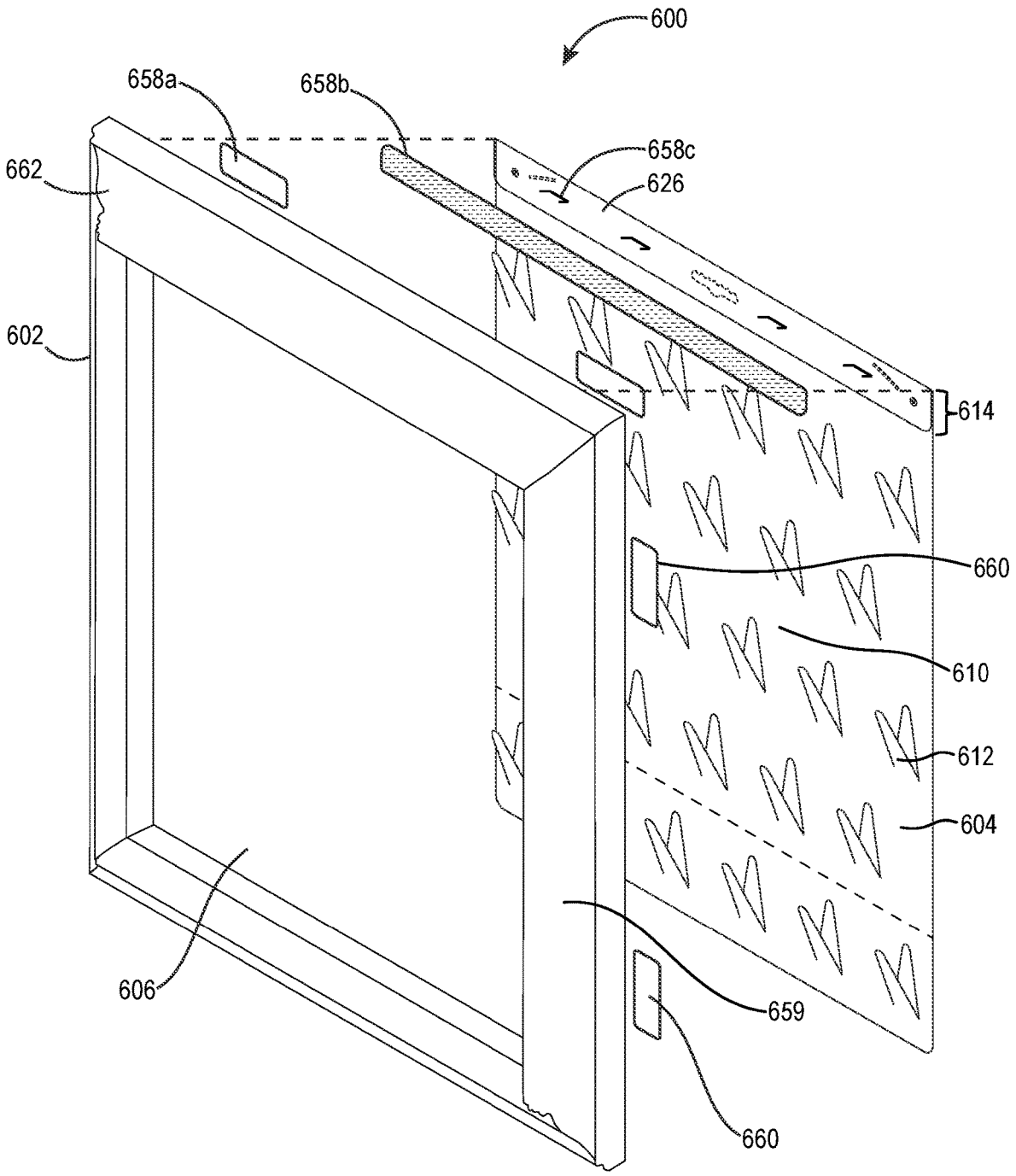
FIG. 6 shows a perspective exploded view of an image frame assembly according to one or more embodiments of the present disclosure.

FIG. 6 illustrates a perspective exploded view of an image frame assembly 600 having one or more securing elements for attaching (e.g., securing) a frame portion 602 and a transparent panel 606 to a backing panel 604 (e.g., a backing panel 604 having a plurality of biased members 612). As shown, in some embodiments, the one or more securing elements 658 can include a single strip of material 658*b* disposed between an upper frame member 662 of the frame portion 602 and an upper segment 626 of the hinge portion 614 of the backing panel 604. In additional embodiments, the one or more securing elements 658 can include a plurality of strips of material 658*a* disposed between an upper frame member 662 of the frame portion 602 and the upper segment 626 of the hinge portion 614 of the backing panel 604. In further embodiments, the one or more securing elements 658 can include mechanical fasteners 658*c* such as screws, nails, staples, tacks, etc.

In embodiments including the single strip of material 658*b* and/or a plurality of strips of material 658*a*, in some embodiments, the strip(s) of material 658*a*, 658*b* can include hook and loop fastening material (e.g., Velcro®). Alternatives to hook and loop fastening materials such as mushroom fasteners (e.g., Duotec®) or other snap-together fasteners can also be used in some embodiments. In additional embodiments, the strip(s) of material 658*a*, 658*b* can include an adhesive material (e.g., a permanent and/or semi-permanent adhesive material). Furthermore, in one more embodiments, the adhesive material may include pressure sensitive adhesives (e.g., adhesives that form a bond when pressure is applied to join the adhesive with an adhered) (referred to hereinafter as "PSAs"). In some embodiments, the adhesive material may include one or more of solvent-based PSAs and water-based PSAs. Specifically, the adhesive material may include one or more elastomers and tackifiers. The elastomers of the adhesive material may include one or more elastomers such as acrylics, bio-based acrylate, butyl rubber, ethylene-vinyl acetate, natural rubber, nitriles, silicone rubbers, synthetic rubbers, styrene block copolymers, and vinyl ethers. In one or more embodiments, the adhesive material may include one or more of styrene-butadiene-styrene (SBS), styrene-ethylene/butylene-styrene (SEBS), Styrene-ethylene/propylene (SEP), and styrene-isoprene-styrene (SIS). Furthermore, the tackifiers of the adhesive material may include one or more tackifiers such as "MQ" silicate resins, cumarone-indene, α-methyl styrene, vinyl toluene, aliphatic olefins, rosin esters, polyterpenes, and terpene phenolics. In yet further embodiments, the strips of material

658*a*, 658*b* can include biomechanical adhesives, gels, films, etc. Alternatively, it may be possible to use magnets for purposes of attaching the frame to the backing panel in any embodiment disclosed herein. Thus, any of these attachment mechanisms can be used in any of the different embodiments disclosed herein.

Referring still to FIG. 6, the image frame assembly 600 can include the one or more detachable securing elements 660 between a lateral side member of the frame portion 602 and the body portion 610 of the backing panel 604. The detaching securing elements 660 may secure (e.g., fix) the frame portion 602 relative to the backing panel 604 of the image frame assembly 600 while allowing the frame portion 602 to be relatively easily detached from the backing panel 604 along the side members 659 of the frame portion 602. For example, the detaching securing elements 660 may allow for the frame portion 602 to be easily rotated about the hinge portion 614 of the backing panel 604 in order to remove, insert, and/or exchange an image (e.g., image 108) within the image frame assembly 600. For instance, detaching securing elements 660 may include one or more of a hook and loop material and/or a tacky adhesive material such that the detaching securing elements 660 allow the frame portion 602 to be easily detached from and reattached to the body portion 610 of the backing panel 604.

Figure 7A:
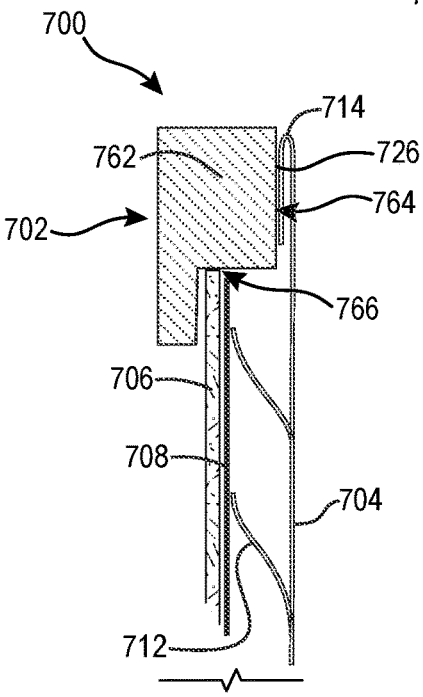
FIGS. 7A-7E show partial side cross-sectional views of various embodiments of biased members of the backing panel of an image frame assembly according to one or more embodiments of the present disclosure.

FIG. 7A illustrates a partial side cross-sectional view of an image frame assembly 700 have an image 708 disposed therein according to one or more embodiments of the present disclosure. As shown in FIG. 7A, the frame portion 702 may include an upper member 762 (e.g., an upper piece of a molding of the frame portion 702), and the upper member 762 may include a back surface 764 to which the backing panel 704 (e.g., the upper segment 726 of the hinge portion 714) can be attached and a rabbet portion 766 (e.g., notch and/or lip) for supporting the image 708 and obscuring edges of the image 708. As will be appreciated by one of ordinary skill in the art, each other member of the frame portion 702 (side members and lower member) may also include a respective back surface and rabbet portion for supporting the image 708.

Additionally, the plurality of biased members 712 (e.g., the at least general rounded triangle shaped members) may press the image 708 against the transparent panel 706 (e.g., pane of glass), and, as a result, may hold the image 708 within the rabbet portion 766 of the frame portion 702 (e.g., keep the image supported within the frame portion via mechanical interference). Furthermore, because the plurality of biased members 712 are at least generally uniformly distributed throughout the backing panel 704, the plurality of biased members 712 may uniformly press the image 708 against the transparent panel 706, thus, giving the image 708 a generally flat appearance through a viewing window of the image frame assembly 700. For example, because the plurality of biased members 712 are at least generally uniformly distributed throughout the backing panel 704, the plurality of biased members 712 may not distort and/or cause unsightly "denting" of the image 708 while the image 708 is within the image frame assembly 700.

Figure 7B:
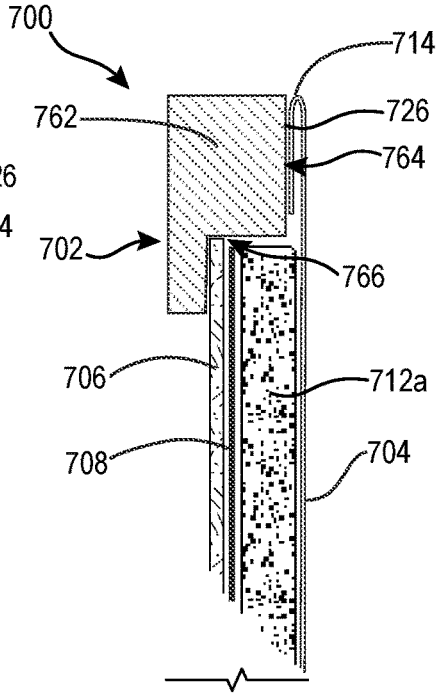

FIG. 7B illustrates a partial side cross-sectional view of an image frame assembly 700 have an image 708 disposed therein according to another embodiment of the present disclosure. As shown in FIG. 7B, in some embodiments, the image frame assembly 700 may include a single biased member 712*a*, and the single biased member 712*a* may include a compressible material. For example, the compressible material can include one or more of a foam material (e.g., a Polyurethane and/or Polyethylene foam), Styrofoam®, bubble wrap, a cushion, etc. Furthermore, similar to the plurality of biased members 712, the single biased member 712*a* may press the image 708 against the transparent panel 706, and, as a result, may hold the image 708 within the rabbet portion 766 of the frame portion 702. In some embodiments a foam sheet may be used as the backing panel such that the foam sheet includes the biased members as an integral part thereof. In particular, the biased members may be cut-outs in the foam sheet instead of in a plastic sheet. This may help to guard against cuts or other injuries to a user from the biased members being formed out of a plastic sheet.

Figure 7C:
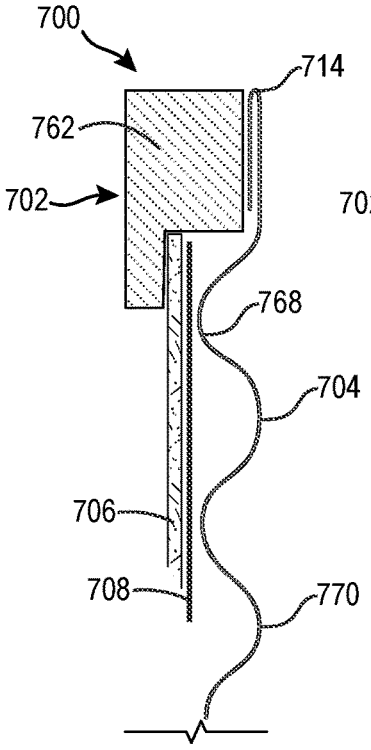

FIG. 7C illustrates a partial side cross-sectional view of an image frame assembly 700 have an image 708 disposed therein according to another embodiment of the present disclosure. As shown in FIG. 7C, the backing panel 704 may have an at least general sinusoidal shaped cross-section. For example, the cross-section of the backing panel 704 may defined a plurality of peaks 768 and plurality of valleys 770 (e.g., a corrugated shape). Furthermore, each peak and valley pair of the plurality of peaks 768 and the plurality of valleys 770 may define a biased member of the plurality of biased members 712. In particular, the plurality of peaks 768 may abut up against a back of the image 708 and may press the image 708 against the transparent panel 706, and, as a result, may hold the image 708 within the rabbet portion 766 of the frame portion 702. In such and embodiment, the backing panel 704 does not include any cutouts to form the biased members 712, but rather, the biased members 712 are the plurality of peaks 768 formed by the corrugated shape of the backing panel 704.

Figure 7D:
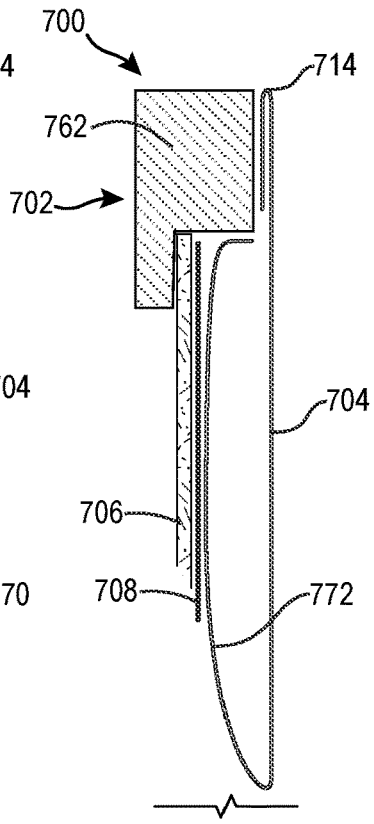

FIG. 7D illustrates a partial side cross-sectional view of an image frame assembly 700 have an image 708 disposed therein according to another embodiment of the present disclosure. As shown in FIG. 7D, the backing panel 704 may define one or more flaps 772, and the one or more flaps 772 may abut up against a back of the image 708 and may press the image 708 against the transparent panel 706. As a result, the one or more flaps 772 may hold the image 708 within the rabbet portion 766 of the frame portion 702.

Figure 7E:
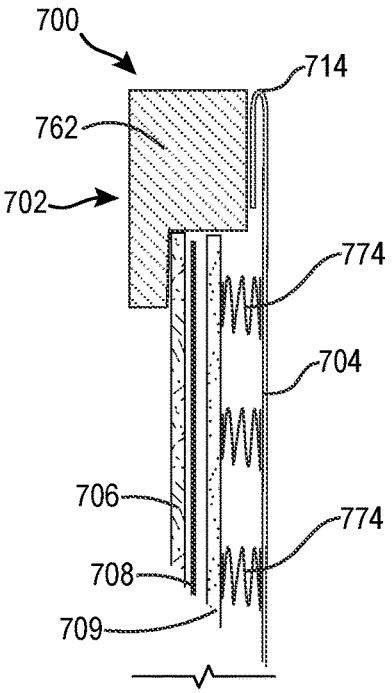

FIG. 7E illustrates a partial side cross-sectional view of an image frame assembly 700 have an image 708 disposed therein according to yet another embodiment of the present disclosure. As shown in FIG. 7E, the plurality of biased members may include one or more spring members 774 attached to backing panel 704 on one end and attached to a supporting panel 709 on an opposite end. In some embodiments, each spring member 774 may include a helical spring. Furthermore, the spring members 774 may cause the supporting panel 709 to abut up against a back of the image 708 and, as a result, may press the image 708 against the transparent panel 706. Moreover, because the spring members 774 cause the supporting panel 709 to press the image 708 against the transparent panel 706, the spring members 774 may hold the image 708 within the rabbet portion 766 of the frame portion 702.

Figures 8A, 8B, 8C, 8D:
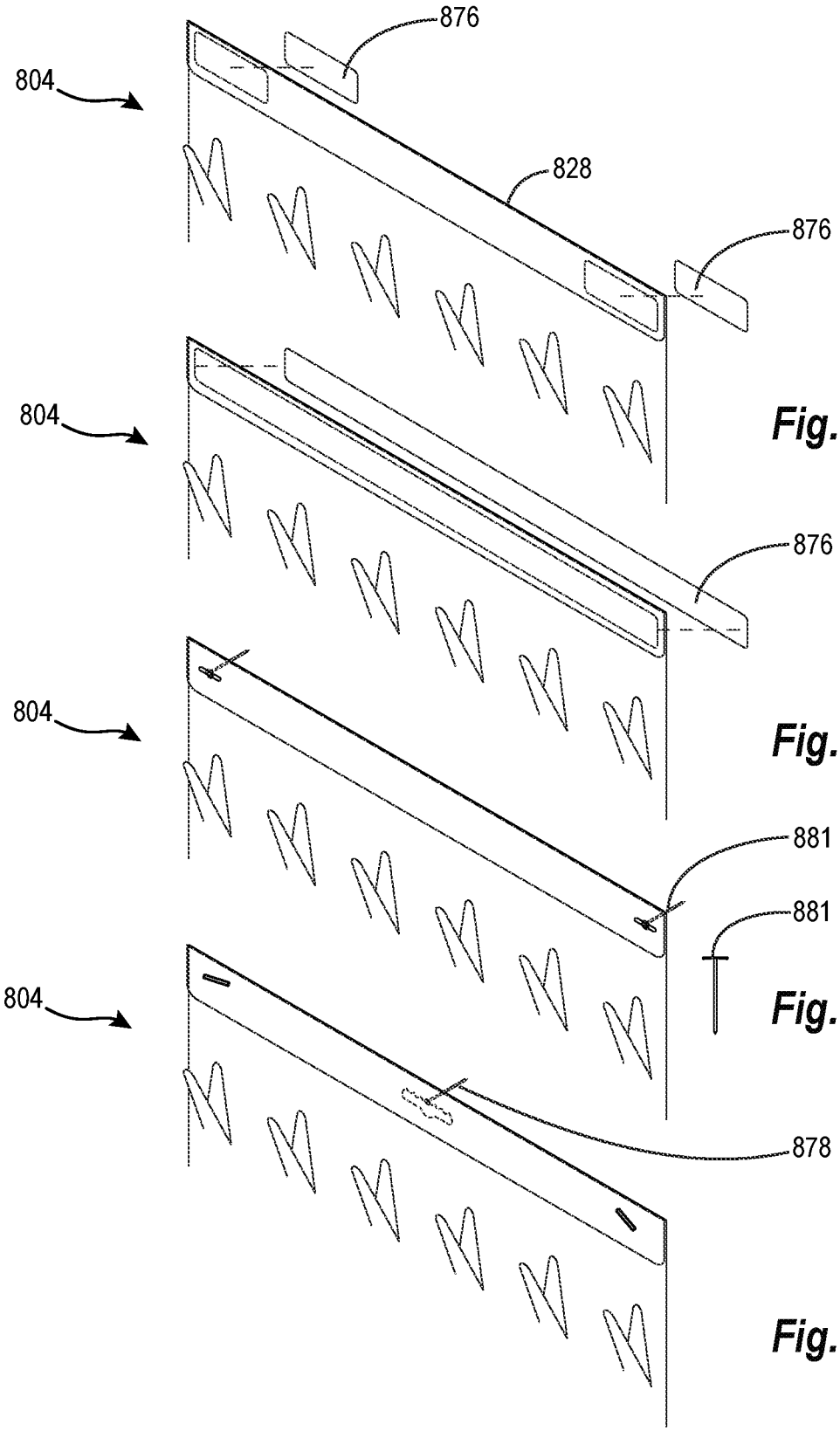
FIGS. 8A-8D show partial perspective views of various embodiments of coupling elements for coupling a backing panel of an image frame assembly to a surface according to one or more embodiments of the present disclosure.

FIGS. 8A-8D show a variety of manners in which a backing panel 804 may be coupled to (e.g. hung on) a surface (e.g., wall). For example, as shown in FIGS. 8A and 8B, the backing panel 804 may include one or more coupling elements 876 for coupling the backing panel 804 to a surface. In some embodiments, the one or more coupling elements 876 may be disposed on the backing panel 804 proximate to a folding line 828 of a hinge portion of the backing panel 804. In one or more embodiments, the coupling elements 876 may include one or more of pieces of hook and loop material or similar repositionable mechanical and/or adhesive pieces, magnets, magnet strips, removable adhesives, and Nano or biomechanical repositionable attachment elements utilizing draping adhesion and/or van der Waals' forces (e.g., Geckskin®).

Furthermore, as shown in FIGS. 8C and 8D, in some embodiments, the backing panel 804 may be coupled to (e.g., hung on) a surface via mechanical fasteners 878, 881. For example, the backing panel 804 may be coupled to a surface with one or more of nails, hooks, screws, T-pins 881 (FIG. 8C), tacks, push pins, etc. For instance, as illustrated in FIG. 8C, in some embodiments, the backing panel 804 may be coupled to a surface with T-pins 881, and the T-pins may include pins having relatively smooth T-bar heads and typical nail shafts. Furthermore, the mechanical fasteners 878 may extend through one or more of a plurality of fastener apertures (FIG. 2A), a plurality of relief apertures (FIG. 2A), and a centered aperture (FIG. 2A). Moreover, as noted above in regard to FIG. 2A, each of the plurality of fastener apertures (FIG. 2A) and the plurality of relief apertures (FIG. 2A) may have a first aperture and a second corresponding aperture, and the mechanical fasteners 878 may extend through the second corresponding apertures while heads of the mechanical fastener 878 extend through (e.g., rest within) the first apertures. Specifically, when a hinge portion of the backing panel 804 is in a folded position, a head of a given mechanical fastener 878 may be disposed within the first aperture allowing an inner surface of the hinge portion to be at least substantially flat against the inner surface of a body portion of the backing panel 804.

Figure 9A:
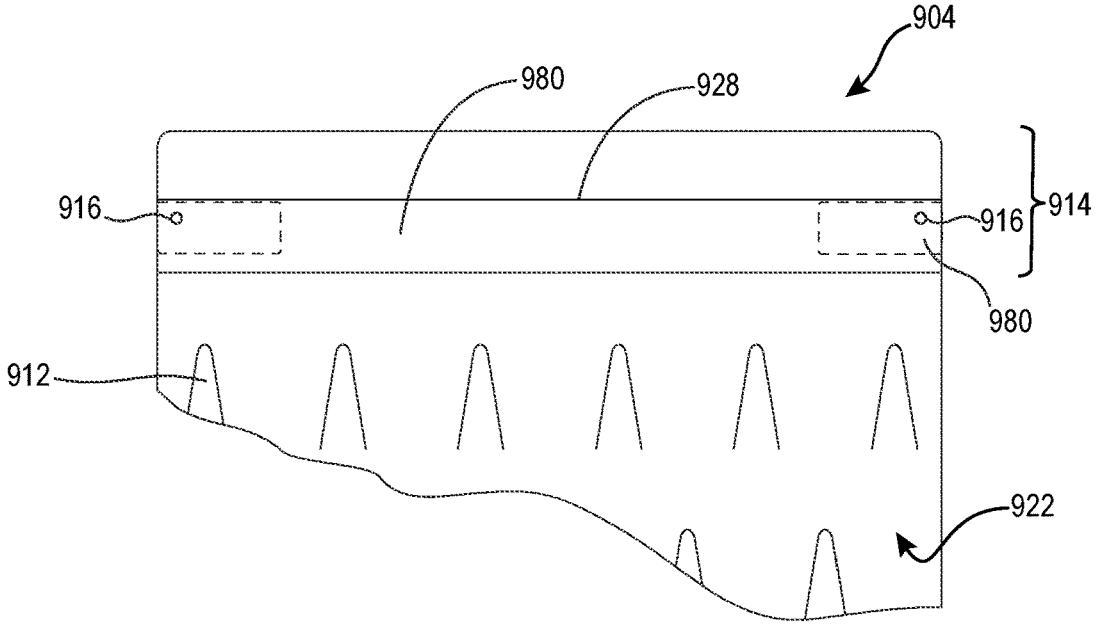
FIG. 9A shows a partial front side view of a backing panel of an image frame assembly having supporting tabs according to one or more embodiments of the present disclosure.
Figure 9B:
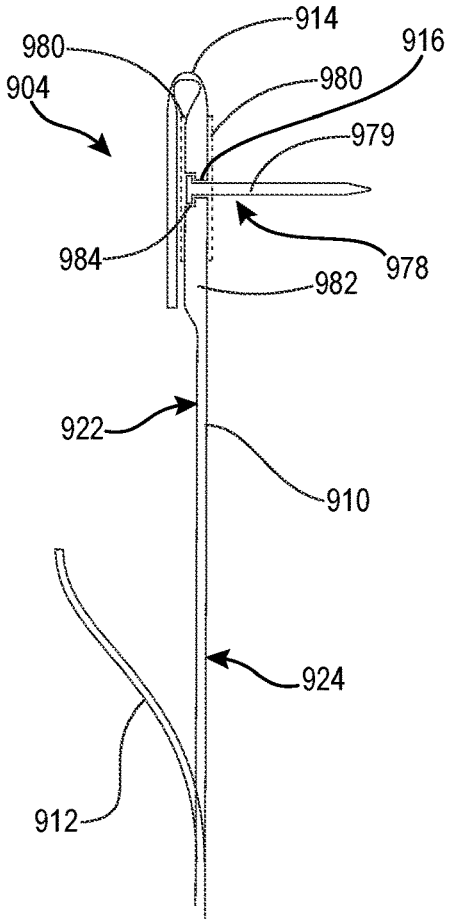
FIG. 9B shows a partial side cross-sectional view of a backing panel of an image frame assembly having a supporting tab according to one or more embodiments of the present disclosure.

Some embodiments of the present disclosure provide for supporting tabs (e.g., reinforcement tabs) for reducing a likelihood that the mechanical fasteners will tear through a backing panel of an image frame assembly. For example, FIG. 9A illustrates a partial front side view of a backing panel 904 having one or more supporting tabs 980 attached to one or more of the inner surface 922 and outer surface 924 of the backing panel 904 and proximate a plurality of fastener apertures 916. FIG. 9B shows a partial side cross-sectional view of the backing panel 904 of FIG. 9A. Referring to FIGS. 9A and 9B together, for example, the supporting tabs 980 may be aligned with the plurality of fastener apertures 916 such that, when a mechanical fastener 978 extends through a given fastener aperture 916, a respective supporting tab 980 can at least partially support the mechanical fastener 978 (e.g., support a head of nail and/or screw/or T pin).

In particular, the one or more supporting tabs 980 may allow a shaft portion 979 of a mechanical fastener 978 to extend through the given aperture while preventing a head portion of the mechanical fastener 978 from tearing through the given aperture. In some embodiments, the one or more supporting tabs 980 may include a relatively rigid material (e.g., more rigid than the backing panel 904), such as, for example, a metal material or a hard plastic (e.g., polycarbonate, polyethylene, etc.).

Furthermore, in some embodiments, the backing panel 904 may include a thicker segment 982 proximate an upper portion of a body portion 910 of the backing panel 904 through which the plurality of fastener apertures 916, the plurality of relief apertures (FIG. 2A), and/or the centered aperture (FIG. 2A) may extend. Specifically, the thicker segment 982 may have an increased thickness relative to a remainder of the backing panel 904. Furthermore, in some embodiments, for a given aperture (a fastener aperture 916, a relief aperture (FIG. 2A), and/or a centered aperture (FIG. 2A)), the thicker segment 982 may define a respective countersink hole 984. In such embodiments, the countersink hole 984 may allow the mechanical fastener 978 to be at least partially sunk within the countersink hole 984 to reduce a profile of the mechanical fastener 978 and to reduce any interference the mechanical fastener 978 may cause with the hinge portion 914 of the backing panel 904. Furthermore, in such embodiments, a supporting tab 980 may be disposed against an outer surface 924 of the backing panel 904.

Figure 10:
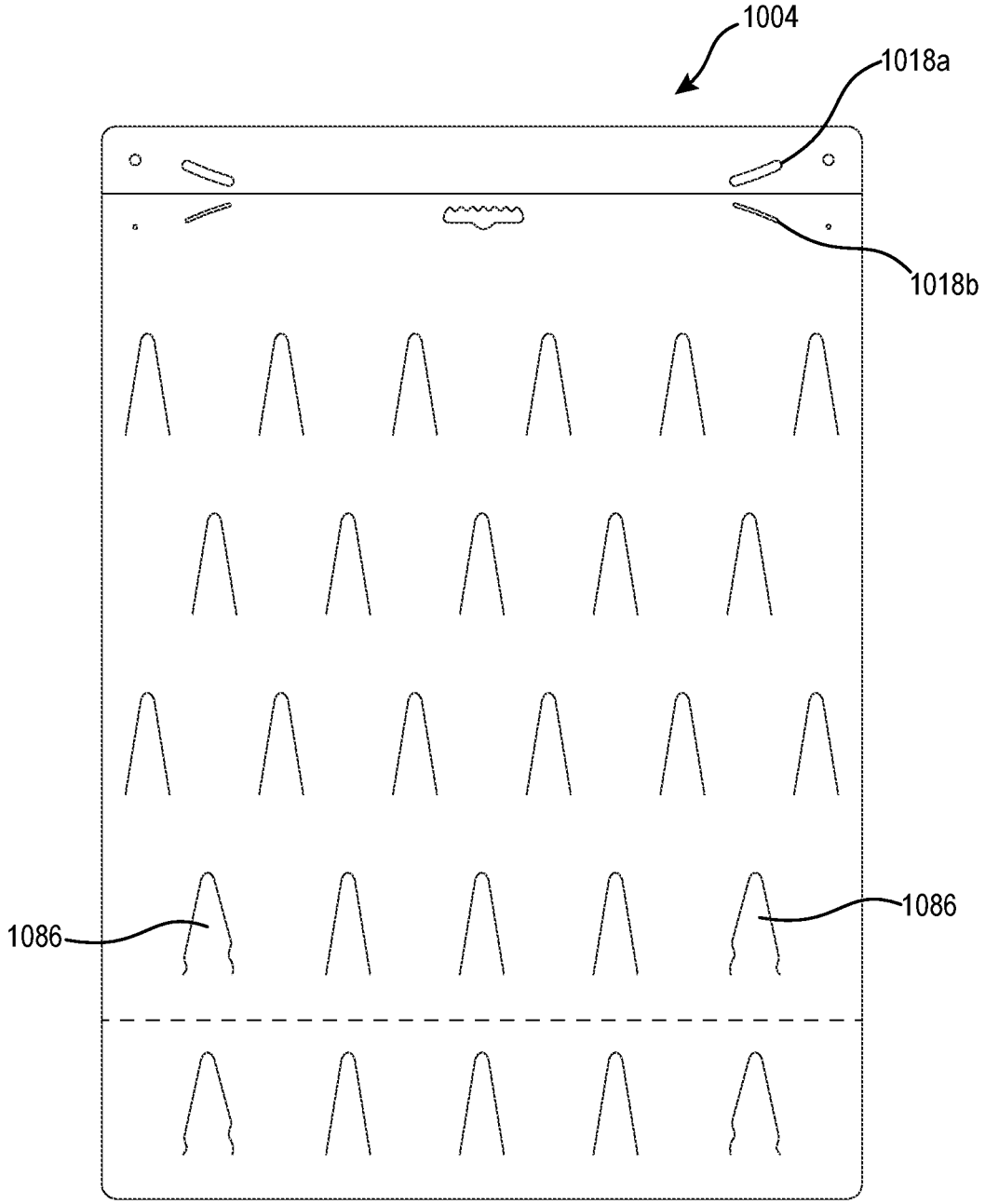
FIG. 10 shows a front side view of a backing panel of an image frame having one or more notched biased members according to one or more embodiments of the present disclosure.

Some embodiments of the present disclosure provide for connecting separate backing panels together in order to accommodate relatively large and/or uniquely shaped frame portions. For example, FIG. 10 illustrates a front side view of a backing panel 1004 according to another embodiment of the present disclosure. As show in FIG. 10, the backing panel 1004 may include one or more notched biased members 1086. Furthermore, the one or more notched biased members 1086 may be vertically aligned with the plurality of relief apertures 1018*a*, 1018*b* of the backing panel 1004. Moreover, the one or more notched biased members 1086 may be shaped (e.g., have a width and length) to fit within (e.g., extend through) the plurality of relief apertures 1018*a*, 1018*b* of a separate backing panel. In some embodiments, the one or more notched biased members 1086 may be oriented within a lower portion of the backing panel 1004. In additional embodiments, each biased member of the backing panel 1004 may include a notched biased member 1086.

Figure 11:
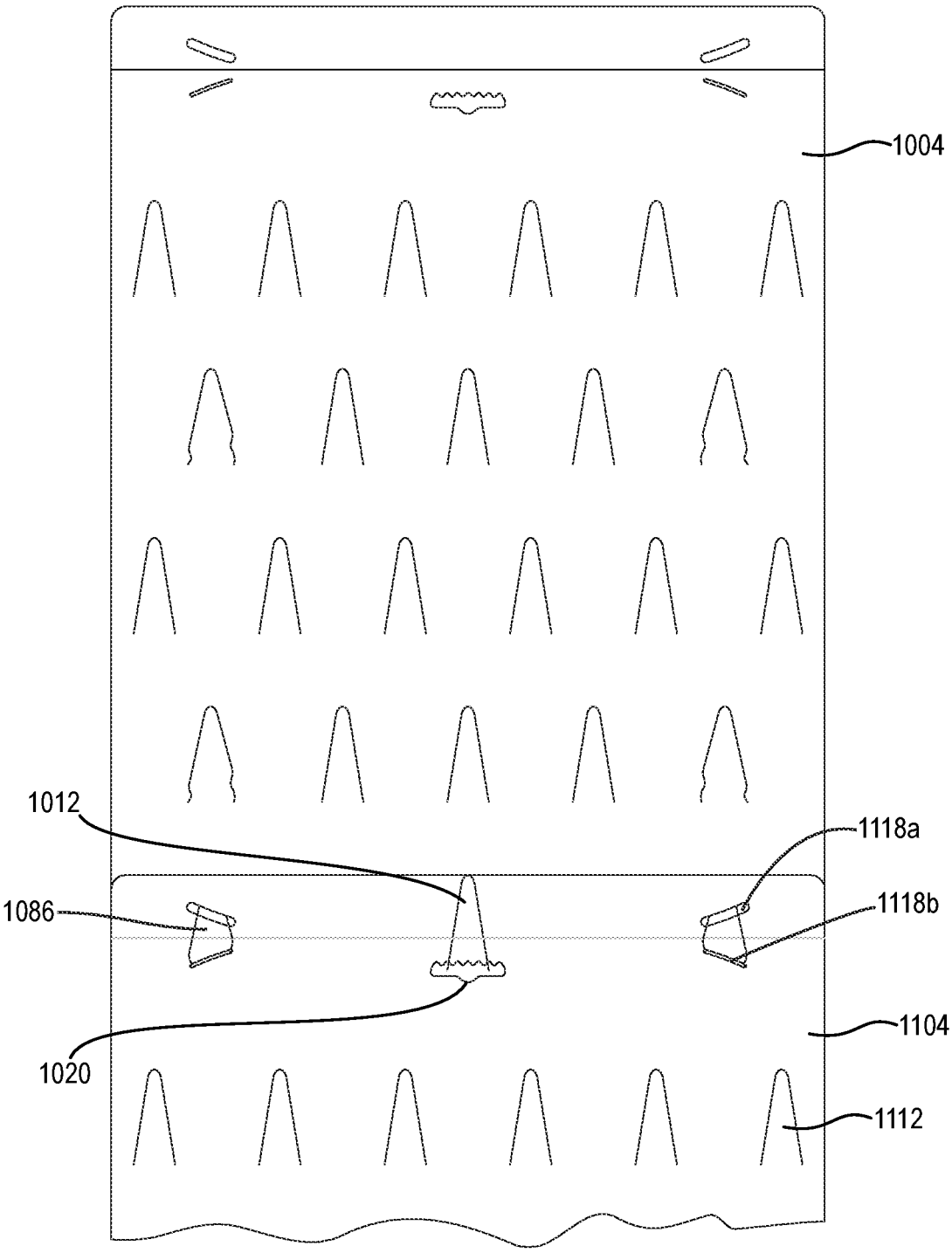
FIG. 11 shows a front side view of a backing panel coupled to a separate backing panel via notched biased members according to one or more embodiments of the present disclosure.

For instance, as illustrated in FIG. 11 a separate backing panel 1104 may be coupled to the backing panel 1004 by inserting the notched biased members 1086 of the backing panel 1004 through the plurality of relief apertures 1118*a*, 1118*b* of the separate backing panel 1104. Furthermore, a biased member 1012 of the backing panel 1004 may be inserted into a centered aperture 1020 of the separate backing panel 1104 for further support. Moreover, due to notches of the notched biased members 1086, the notches may lock (e.g., snap, click, etc.) the separate backing panel 1104 into place by holding the biased members 1086 within the plurality of relief apertures 1118*a*, 1118*b* until a threshold force is applied, at which point the plurality of relief apertures 1118*a*, 1118*b* are released from the notches. As noted above, by coupling backing panels together, the backing panels can accommodate frame portions that are larger than an individual backing panel and/or uniquely shaped frame portions.

Figure 12:
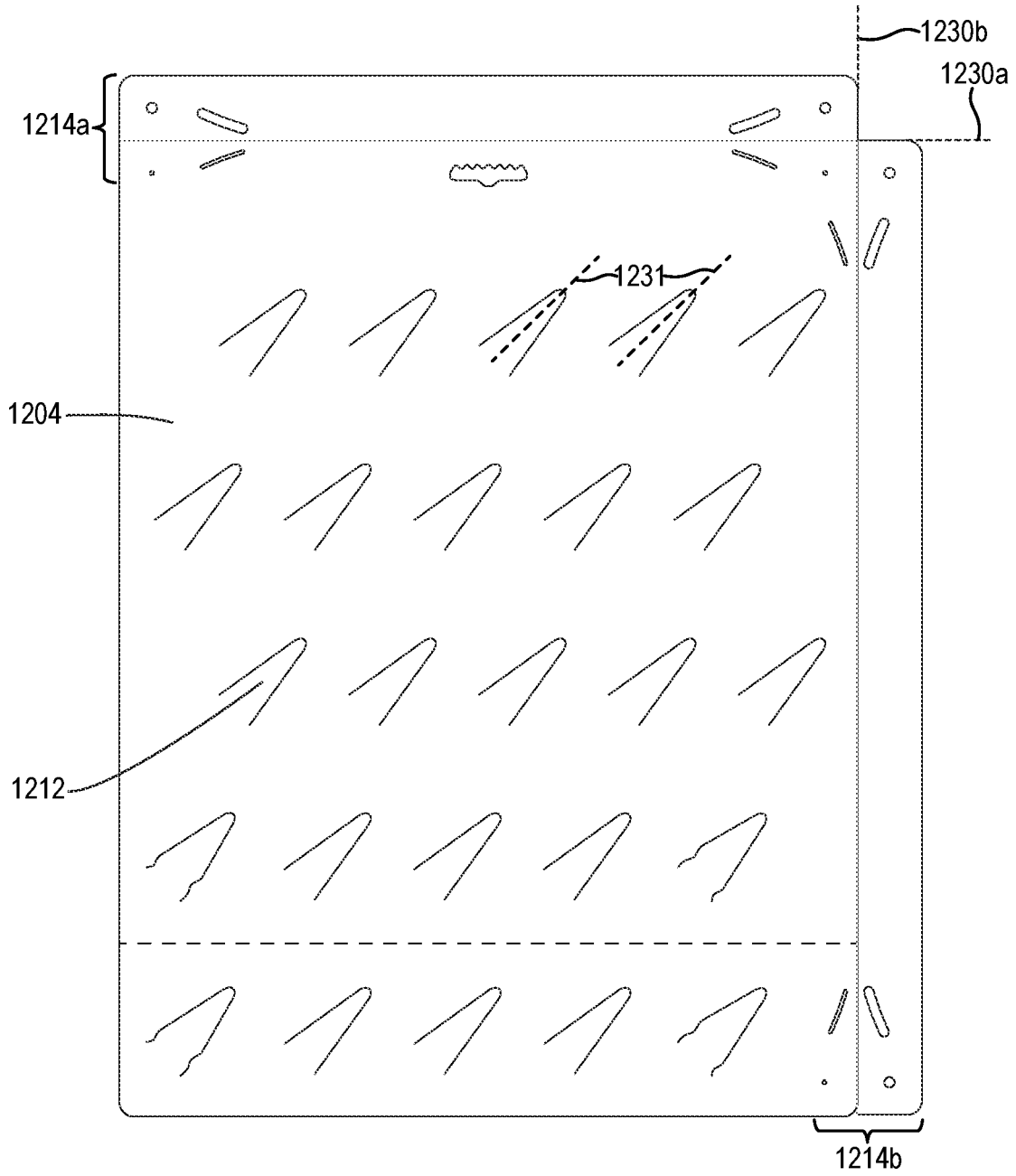
FIG. 12 shows a front side view of a backing panel having multiple hinge portions according to one or more embodiments of the present disclosure.

Furthermore, some embodiments of the present disclosure provide for bidirectional backing panel. For example, FIG. 12 shows a backing panel 1204 have a first hinge portion 1214*a* extending along a longitudinal end of the backing panel 1204 and a second hinge portion 1214*b* extending along a lateral end of the backing panel 1204. Additionally, longitudinal axes 1231 of the biased members 1212 of the backing panel 1204 may extend in a diagonal direction relative to axes of rotations 1230*a*, 1230*b* defined by the first and second hinge portions 1214*a*, 1214*b* (e.g., in a direction defining an acute angle with both the axes of rotations 1230*a*, 1230*b* defined by the first and second hinge portions 1214*a*, 1214*b*). In alternative embodiments, the longitudinal axes 1231 of the biased members 1212 may extend in different directions. For example, a first biased member of the backing panel 1204 may extend in a first direction, and a second biased member of the backing panel 1204 may extend in a second different direction. As a result, the backing panel 1204 can equally accommodate frame portions (e.g., frame portion 102) hung in either a portrait orientation or a landscape orientation.

Figure 13A:
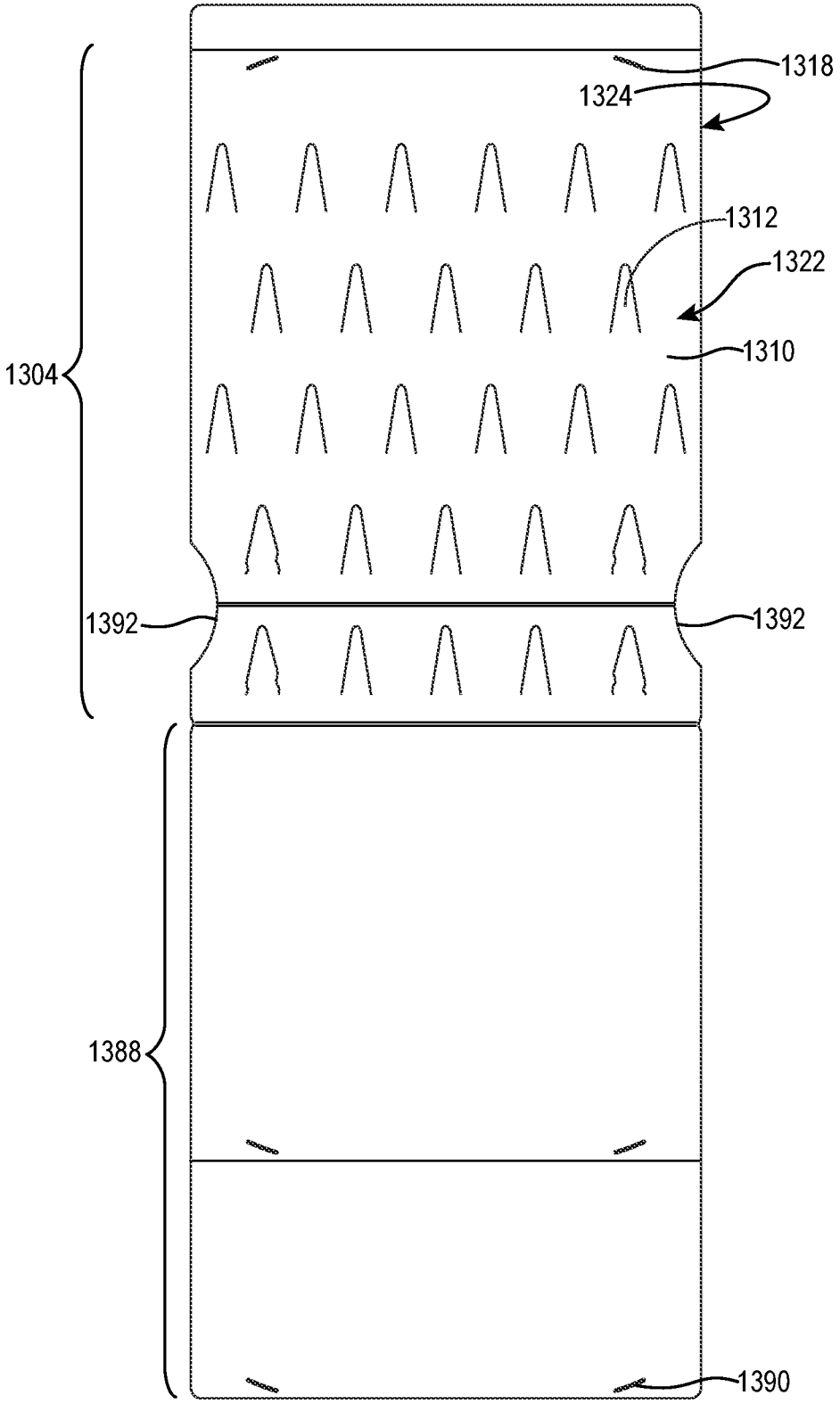
FIGS. 13A-13E shows various views of various embodiments of backing panels having additional folding panels for forming storage folders according to one or more embodiments of the present disclosure.
Figure 13B:
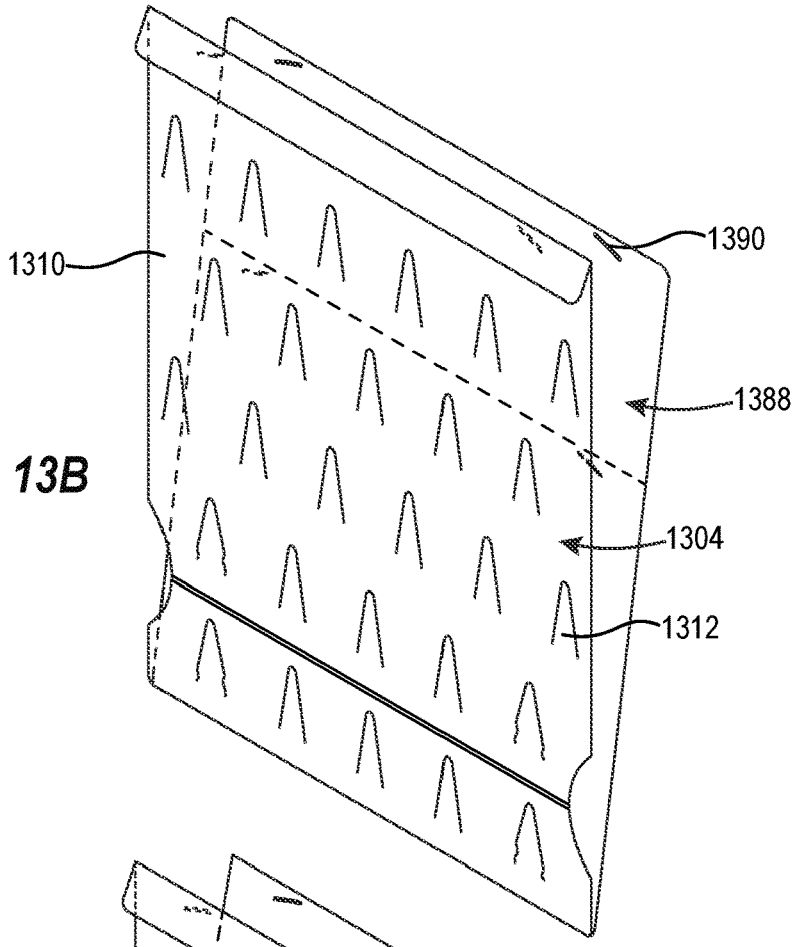
Figure 13C:
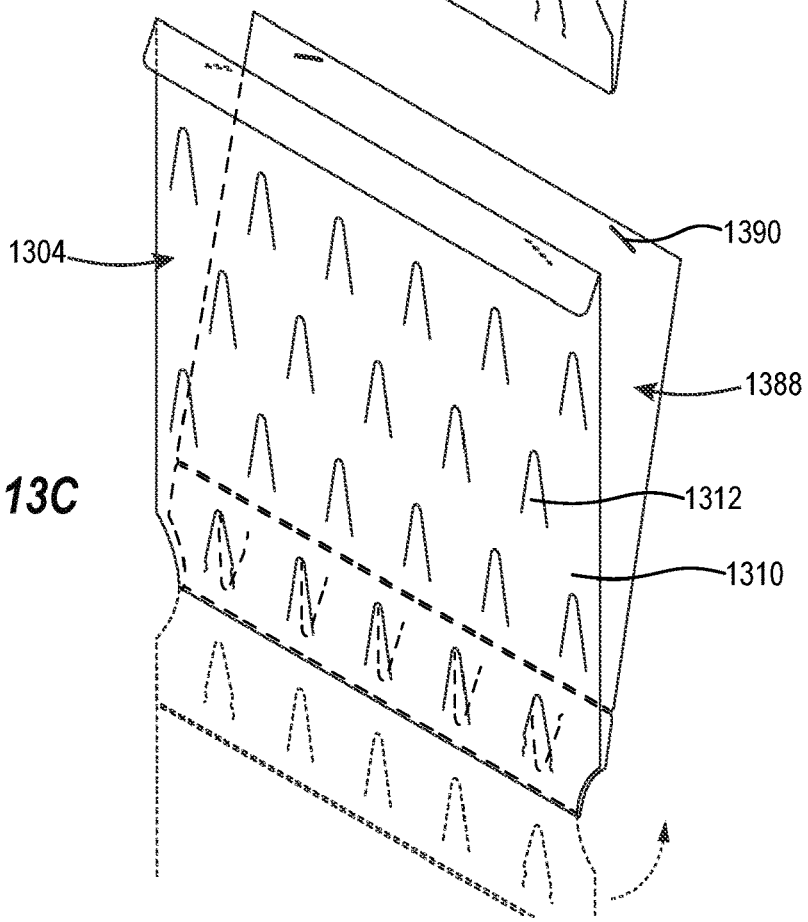

Moreover, some embodiments of the present disclosure provide for a backing panel that forms a storage folder for storing images therein. In some embodiments, as shown in FIGS. 13A-13C, a backing panel 1304 may have an additional folding panel 1388 attached to a bottom edge of a body portion 1310 of the backing panel 1304. Furthermore, the additional folding panel 1388 can be foldable along the bottom edge of the body portion 1310 and relative to the body portion 1310. Moreover, when the additional folding panel 1388 of the backing panel is folded relative to the body portion 1310 of the backing panel 1304, an outer surface 1324 of the body portion 1310 of the backing panel 1304 may face the additional folding panel 1388. Put another way, the additional folding panel 1388 may be foldable toward a back of the body portion 1310 of the backing panel 1304.

Figure 13D:
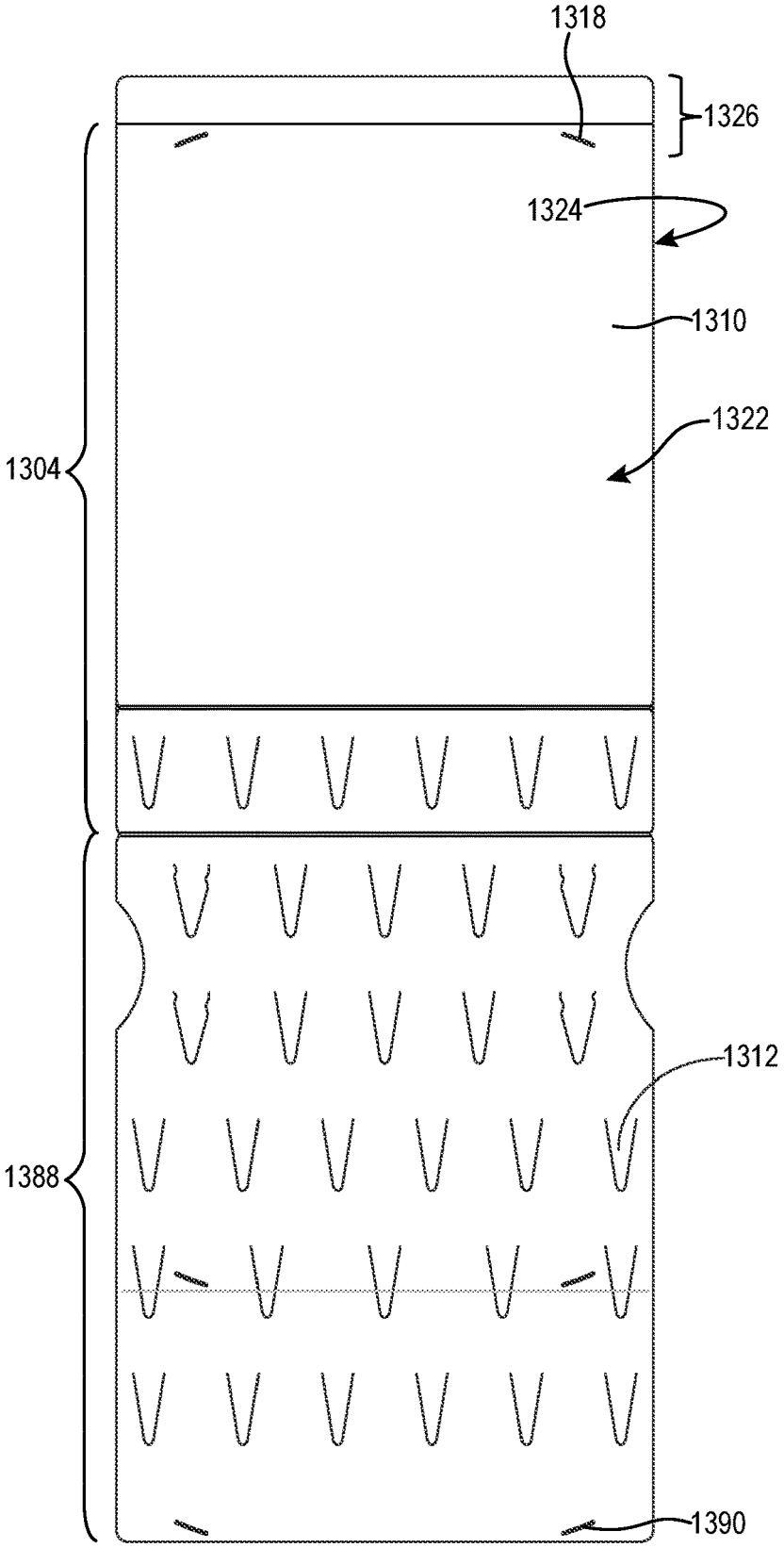
Figure 13E:
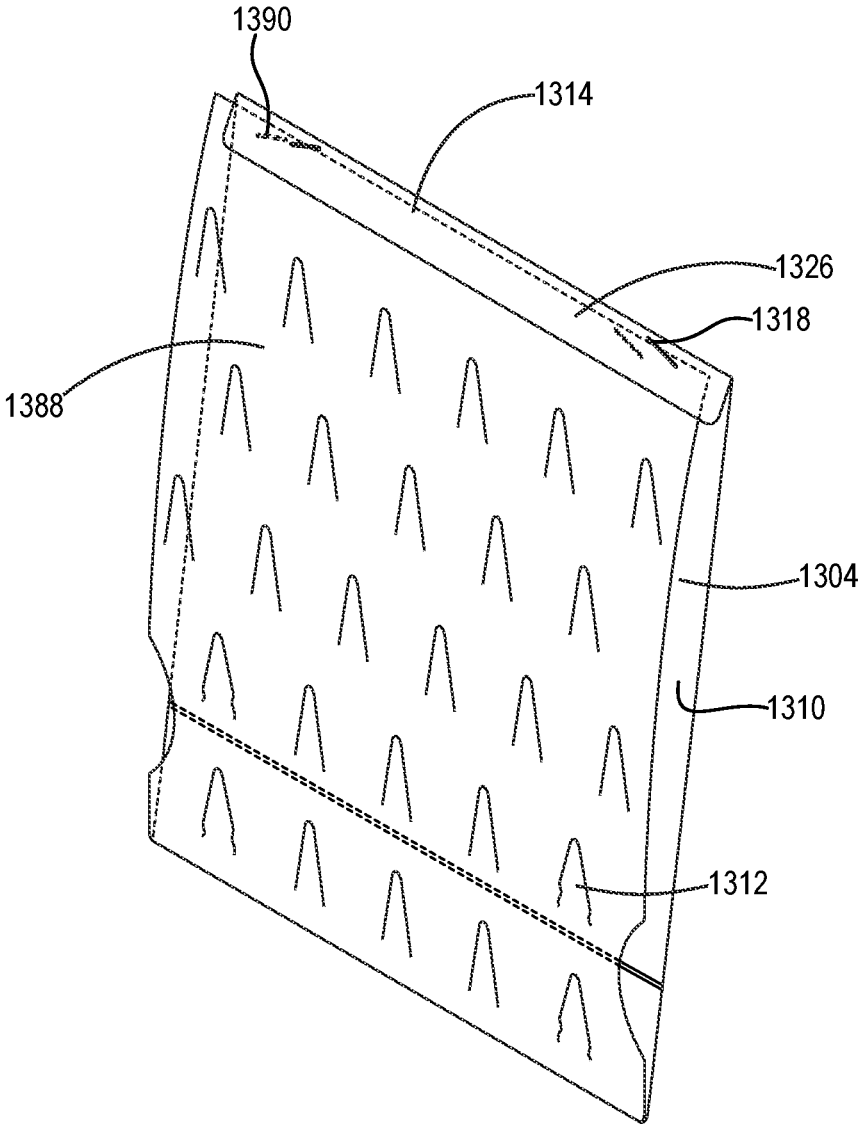

In alternative embodiments, as shown in FIGS. 13D and 13E, the backing panel 1304 may also include a plurality of biased members 1312. Furthermore, the additional folding panel 1388 may be foldable along the bottom edge of the body portion 1310 and relative to the to the body portion 1310 toward a front of the body portion 1310. For example, when the additional folding panel 1388 of the backing panel is folded relative to the body portion 1310 of the backing panel 1304, an inner surface 1322 of the body portion 1310 of the backing panel 1304 may face the additional folding panel 1388.

Moreover, in such embodiments, when folded as illustrated in FIG. 13D, the additional folding panel 1388 may be inserted at least partially between the upper segment 1326 of the hinge portion 1314 of the backing panel 1304 and the body portion 310 of the backing panel 1304. For example, the additional folding panel 1388 may be "tucked" between the upper segment 1326 of the hinge portion 1314 of the backing panel 1304 and the body portion 1310 of the backing panel 1304. Additionally, in such embodiments, the additional folding panel 1388 may include an additional plurality of relief apertures 1390 that correlate to the plurality of relief apertures 1318 of the backing panel 104 and align with the plurality of relief apertures 1318 when the additional folding panel 1388 is folded relative to the body portion 1310 of the backing panel 1304. Furthermore, the additional plurality of relief apertures 1390 may behave in the same manner as the plurality of relief apertures described above in regard to FIG. 2A.

Moreover, referring again to FIG. 13A, in one or more embodiments, the backing panel 1304 may include one or more cutouts 1392 that may allow images stored within the backing panel 1304 (e.g., storage folder) to be more accessible. For example, the one or more cutouts 1392 may extend inward from lateral edges of the body portion 1310 of the backing panel 1304. Accordingly, a user can reach through the one or more cutouts 1392 to access images within the backing panel 1304.

Figure 14:
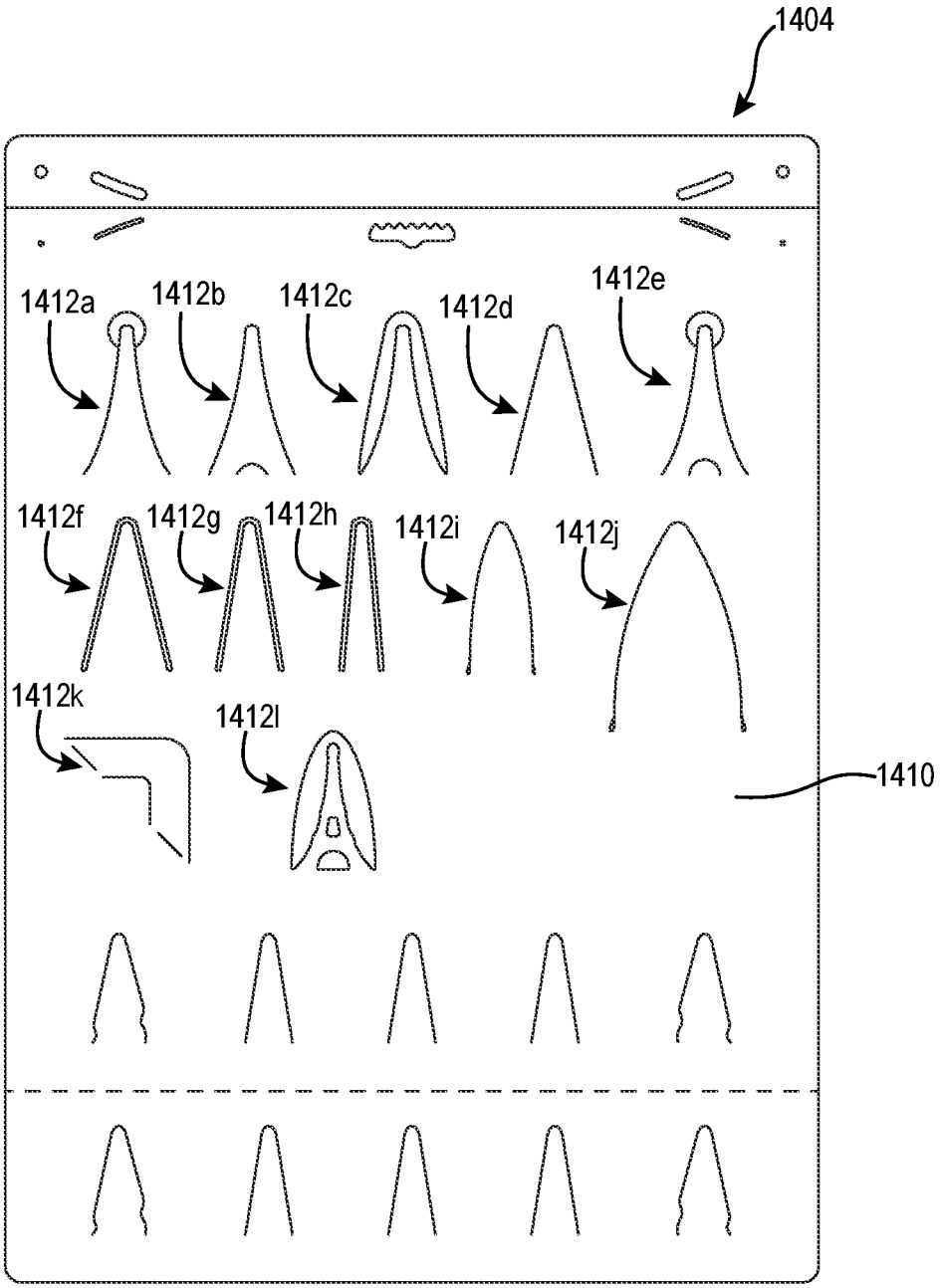
FIG. 14 shows a front side view of a backing panel having various embodiments of biased members according to one or more embodiments of the present disclosure.

FIG. 14 shows a plurality of different embodiments of biased members of the plurality of biased members. For example, in some embodiments, the plurality of biased members may include a biased member 1412*a* having a curved triangle shape. Furthermore, a tip of the biased member 1412*a* may be separated from the body portion 1410 of the backing panel 1404 by a cutout (e.g., circle cutout).

Additionally, the plurality of biased members may include a biased member 1412*b* having curved triangle shape and an additional semi-circle slit near a base of the biased member 1412*b*. Moreover, the plurality of biased members may include a biased member 1412*c* having a curved triangle shape and being separated from the body portion 1410 of the backing panel 1404 by a cutout. Likewise, the plurality of biased members may include a biased member 1412*d* having a relatively larger rounded triangle shape. Also, the plurality of biased members may include a biased member 1412*e*, which is a combination of biased members 1412*a* and 1412*b*.

Furthermore, the plurality of biased members may include biased members 1412*f*, 1412*g*, 1412*h*, which include rounded triangular shaped biased members of varying widths and being separated from the body portion 1410 of the backing panel 1404 by a slit cutout. Moreover, the plurality of biased members may include biased members 1412*i*, 1412*j*, which include swollen round triangular shapes of varying size. Additionally, the plurality of biased members may include a biased member 1412*k* including a corner tab. In yet further embodiments, the plurality of biased members 1412 (e.g., biased member 14121) may have any shape such as shapes of buildings, sunbursts, flowers, or any other geometric shape.

Figure 15:
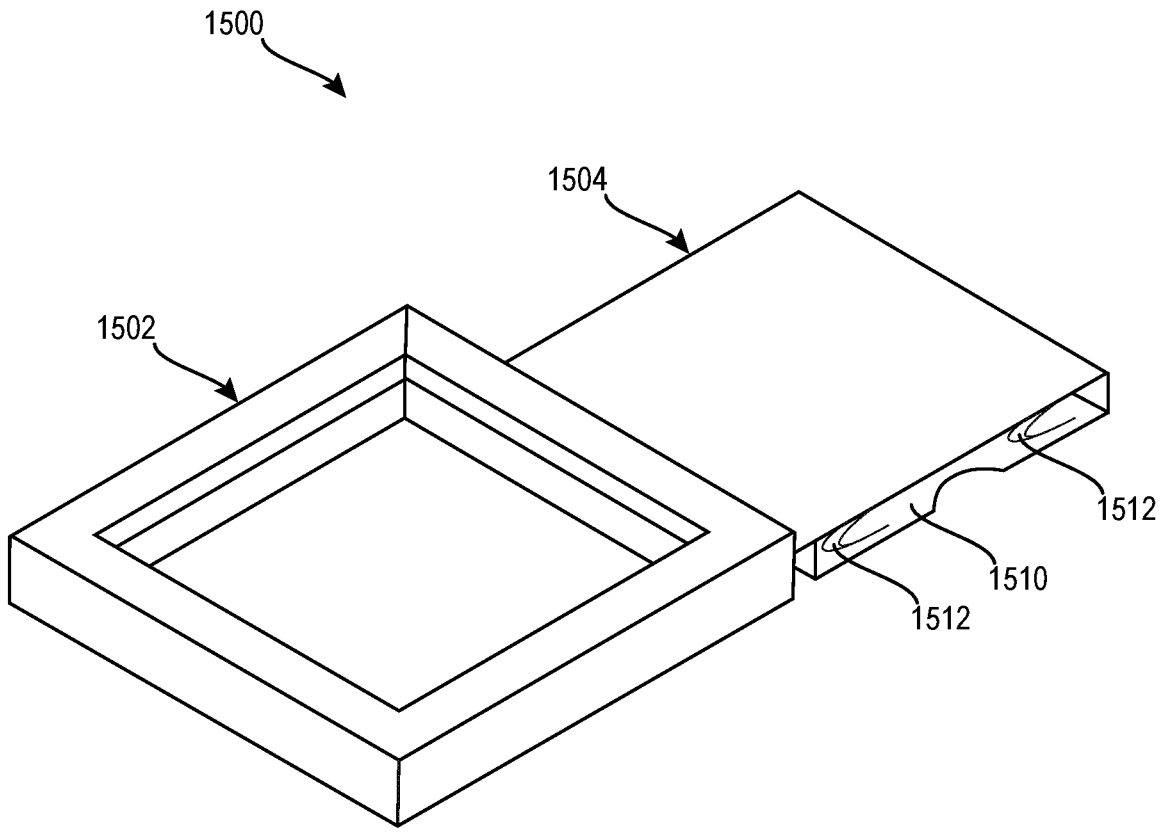
FIG. 15 shows a perspective view of a frame assembly having a frame portion and backing panel having a plurality of biased members according to another embodiment of the present disclosure.

FIG. 15 illustrates a perspective view of a frame assembly 1500 having a frame portion 1502 and backing panel 1504 having a plurality of biased members 1512 according to another embodiment of the present disclosure. As shown, the frame portion 1502 and backing portion 1504 may include a single uniform body (e.g., an injection molded uni-body) and may be attached to each other along a folding line. Furthermore, the backing portion 1504 may at least partially fit within the frame portion 1502.

Additionally, as illustrated, the frame portion 1502 may define a storage box (e.g., a rectangular cuboid storage box) for storing, e.g., images. In one or more embodiments, the frame portion 1502 may define the storage box having access openings on either vertical side of the storage box for inserting and/or removing images from the storage box. In other words, the storage box may include a rectangular sleeve. Moreover, because the backing panel 1504 at least partially fits within the frame portion, the vertical sides of the storage box may be at least partially covered by the frame portion 1502 (e.g., side members of the frame portion 1502) when the frame assembly 1500 is closed thereby forming an enclosure for images.

Moreover, because the backing panel 1504 includes a rectangular sleeve, a portion of the backing panel 1504 pressing up against an image, when the frame assembly 1500 is closed (e.g., the body portion 1510 and biased member 1512), is offset from a surface (e.g., a wall) to which the backing panel 1504 is attached. As a result, the backing panel 1504, in some embodiments, may not include the biased members 1512. Rather, the body portion 1510 of the backing panel 1504 may press an image up against a transparent panel or rabbet of the frame portion 1502 to hold the image in place.

Figure 16:
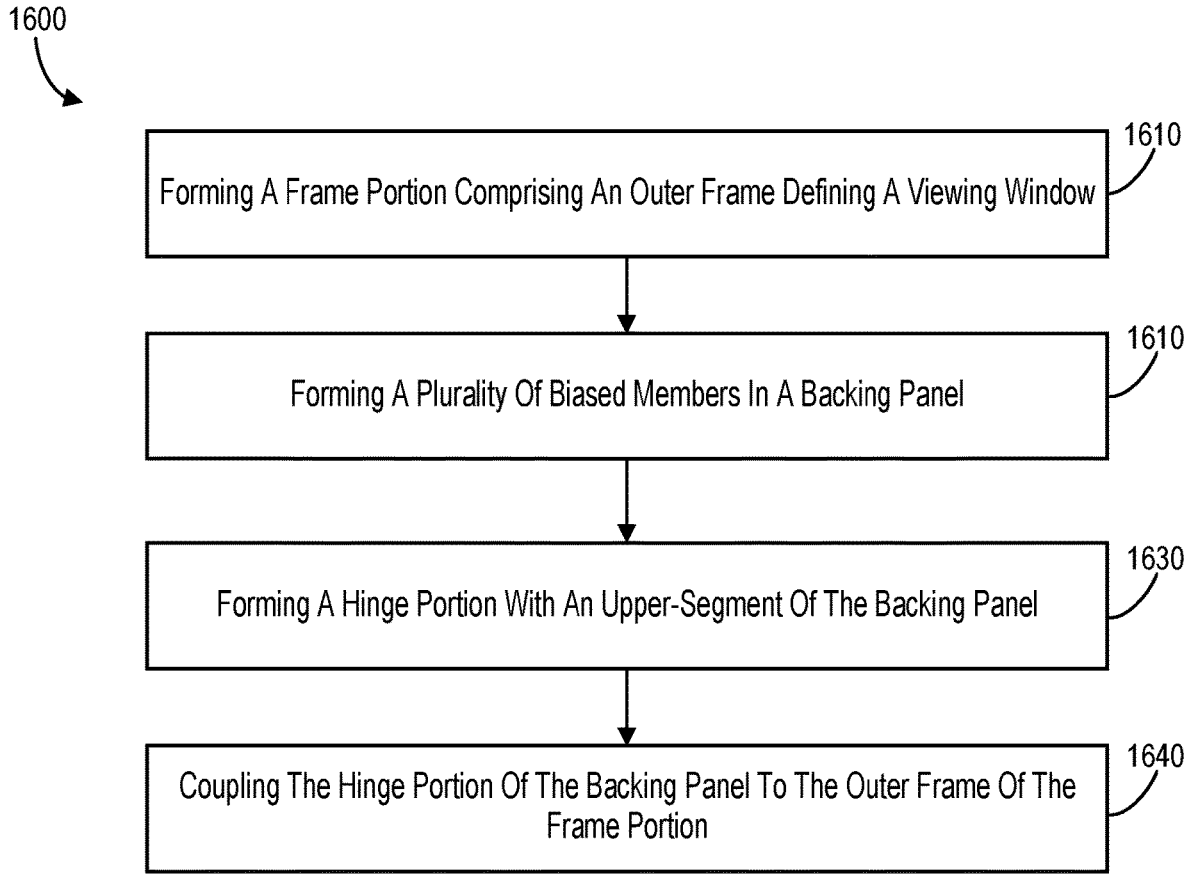
FIG. 16 shows a method flow diagram of making an image frame assembly according to one or more embodiments of the present disclosure.

Some embodiments of the present disclosure include a method of making an image frame assembly (e.g., image frame assembly 100 of FIG. 1). For example, FIG. 16 illustrates a flow diagram showing a method 1600 of making an image frame assembly. In one or more embodiments, the method 1600 can include an act 1610 of forming a frame portion. In particular, act 1610 can include forming a frame portion of the image frame assembly comprising an outer frame defining a viewing window.

Additionally, the method 1600 can include an act 1620 of forming a plurality of biased member in a backing panel. In some embodiments, forming the plurality of biased members in a backing panel can include stencil cutting the plurality of biased members in a backing panel. Furthermore, forming the plurality of biased members in a backing panel may include forming a plurality of partial cutouts in the backing panel and at least partially raising (e.g., bending)

each partial cutout of the plurality of partial cutouts relative to the backing panel and in a direction toward to the frame portion of the image frame assembly. Moreover, act 1620 may include forming the plurality of biased members in the backing panel to include any of the biased members described above in regard to FIGS. 2A-2B, FIGS. 7A-7E, FIG. 12, and FIG. 14.

Furthermore, the method 1600 can include an act 1630 of forming a hinge portion. For instance, act 1630 can include forming a hinge portion with an upper segment of the backing panel. In one or more embodiments, forming the hinge portion can include folding the upper segment of the backing portion back on the backing portion along a folding line. Moreover, act 1630 can include forming the hinge portion to include any of the hinge portions described above in regard to FIGS. 2A-5B.

Moreover, the method 1600 can include an act 1640 of coupling the hinge portion to the frame portion. For example, act 1640 can include coupling the hinge portion of the backing panel to the outer frame of the frame portion. In some embodiments, act 1640 includes coupling the hinge portion of the backing panel to the outer frame such that the outer frame of the frame portions is rotatable relative to the backing panel about an axis of rotation collinear with the folding line. In additional embodiments, act 1640 includes coupling the hinge portion of the backing panel to the outer frame with an adhesive. Furthermore, coupling the hinge portion of the backing panel to the outer frame may include coupling the hinge portion of the backing panel to the outer frame via any of the securing elements and/or detachable securing elements described above in regard to FIG. 6.

Figure 17:
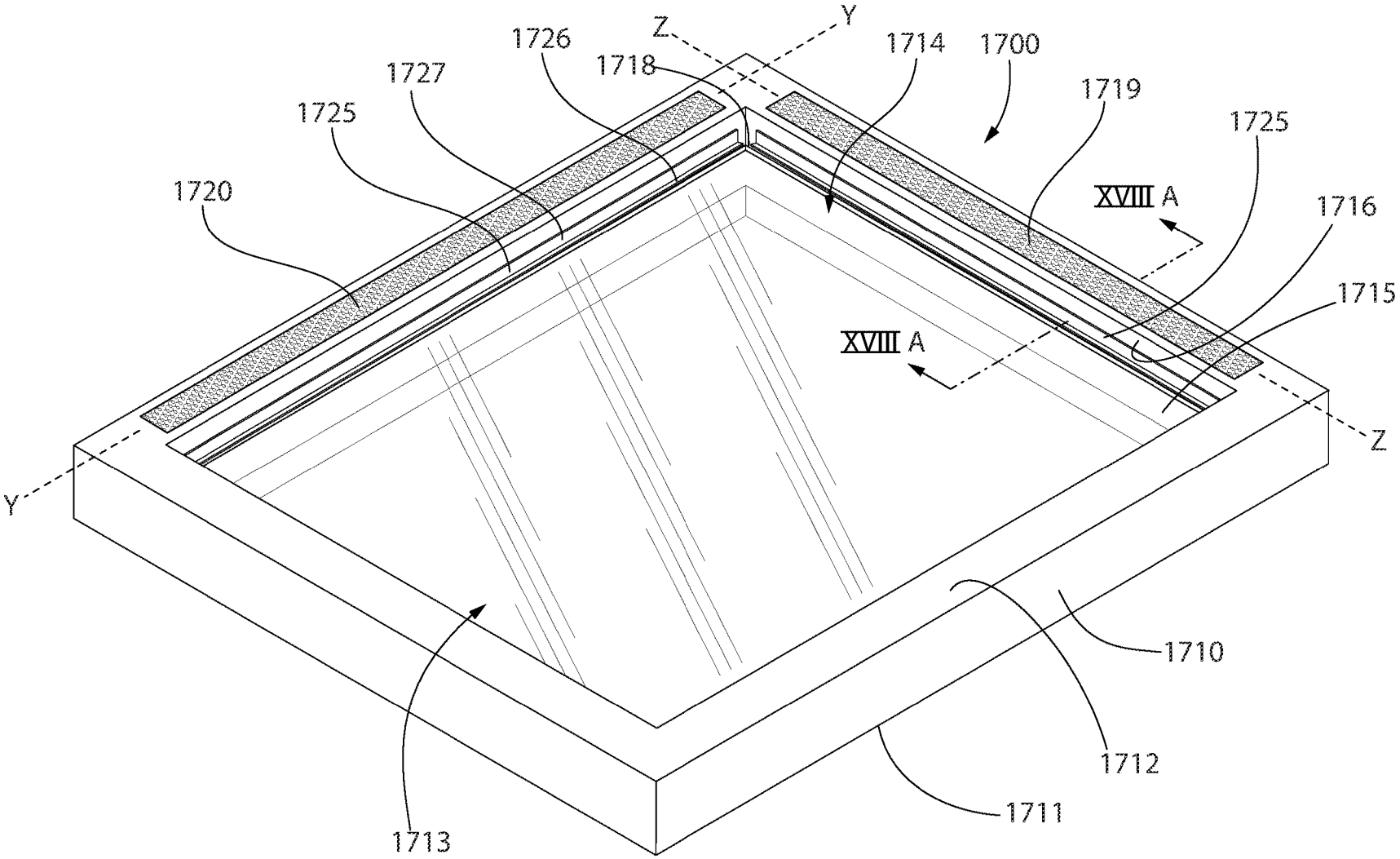
FIG. 17 shows a frame of a frame assembly in accordance with another embodiment of the present disclosure.
Figure 18A:
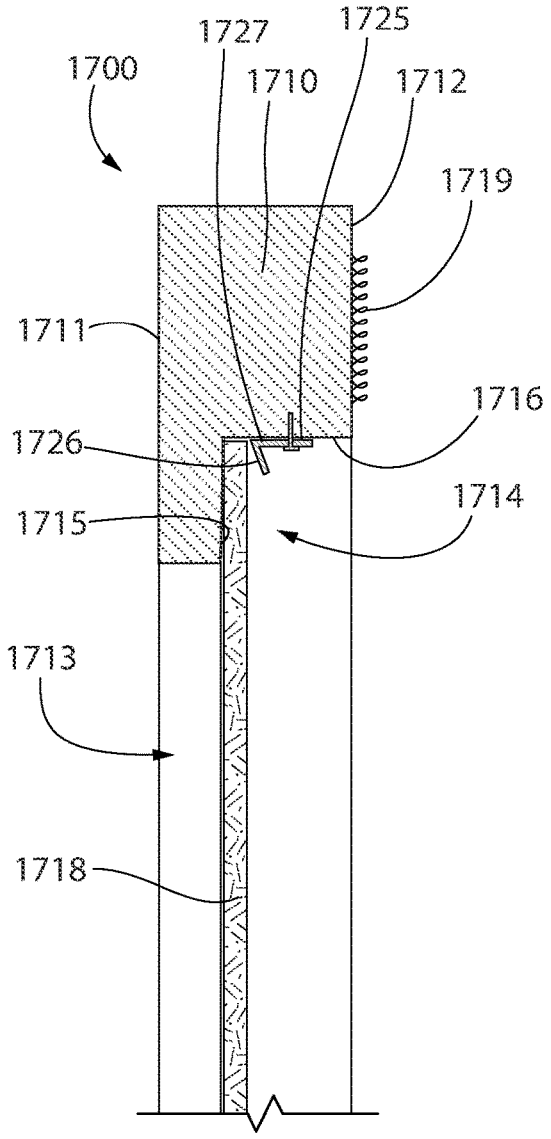
FIG. 18A is a cross-sectional view taken along line XVIIIA-XVIIIA of FIG. 17.
Figure 18B:
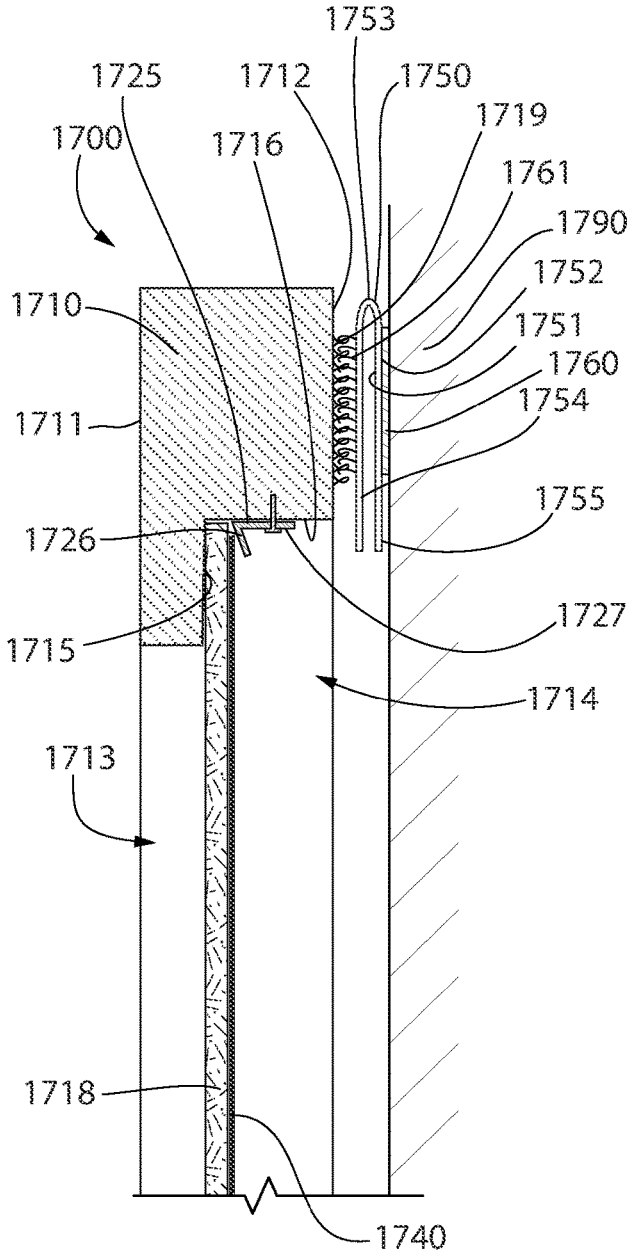
FIG. 18B is the cross-sectional view of the frame of FIG. 18A being attached to a backing panel which is mounted on a wall, and with the frame being in a closed position.

Referring to FIGS. 17-18B, a frame assembly 1700 will be described in accordance with an embodiment of the present invention. The features of the frame assembly 1700 build on the features described above, and thus to the extent that some details of the frame assembly 1700 are not described in significant detail, it is noted that the description of the frame assemblies in FIGS. 1-16 may be relevant and relied upon for a deeper understanding of the structure and function of the frame assembly 1700.

The frame assembly 1700 comprises a frame 1710 and a hinge member 1750 to which the frame 1710 is coupled to hang the frame 1710 from a support surface such as a wall. Due to the attachment of the frame 1710 to the hinge member 1750 which is mounted on the wall, the frame 1710 can be pivoted away from the wall for purposes of removing or inserting display items therein without removing the frame 1710 from the wall. This significantly simplifies the process of changing out framed images. The frame 1710 comprises a front surface 1711 and a rear surface 1712 opposite the front surface 1711. Furthermore, the frame 1710 comprises a viewing window 1713 which is an opening that extends through the frame 1710 from the front surface 1711 to the rear surface 1712. The frame 1710 also comprises a rabbet 1714, which is defined by a floor 1715 and an inner surface 1716. In particular, a portion of the inner surface 1716 of the frame 1710 which surrounds the viewing window 1713 forms a side wall of the rabbet 1714.

In the exemplified embodiment, a transparent panel 1718 is located within the rabbet 1714 adjacent to the floor 1715 of the rabbet 1714. The transparent panel 1718 forms a glazing for the frame 1710 which protects an item displayed therein while still permitting its viewing. In particular, the transparent panel 1718 is transparent so that the display item held by the frame 1700 can be readily seen through the transparent panel 1718. The transparent panel 1718 may be formed from any of a variety of materials including glass and plastic such as acrylic.

In the exemplified embodiment, the frame 1710 includes at least two strips of material located on its rear surface 1712 for purposes of coupling the frame 1710 to the hinge member 1750. In particular, a first securing member 1719 is coupled to the rear surface 1712 of the frame 1710 and extends along a first axis Z-Z and a second securing member 1719 is coupled to the rear surface 1712 of the frame 1710 and extends along a second axis Y-Y. The first and second axes Z-Z, Y-Y are perpendicular to each other. As discussed further below, the frame 1710 can be hung from the hinge member 1750 by engagement between the first securing member 1719 and the hinge member 1750 or by engagement between the second securing member 1720 and the hinge member 1750. This allows the frame 1710 to be readily hung in either a portrait orientation or a landscape orientation, with all of the benefits and functionality being realized regardless of the orientation at which the frame 1710 is hung.

In the exemplified embodiment, the first and second securing members 1719, 1720 are strips of either hook material or loop material that are configured for a hook-and-loop style coupling. Thus, the first and second securing members 1719, 1720 may be secured to the rear surface 1712 of the frame 1710 via adhesive, fasteners, or the like. Thus, the first and second securing members 1719, 1720 may be strips of material having adhesive on one side and hooks or loops on the other side. The exposed surfaces of the first and second securing members 1719, 1720 may have hooks or loops thereon. The adhesive allows the first and second securing members 1719, 1720 to be coupled to the frame 1710 and the hooks or loops allow for coupling to the opposite of hooks or loops on the hinge member 1750 as described below. In other embodiments, the exposed surfaces of the first and second securing members 1719, 1720 may comprise other style snap-together fasteners such as mushroom type snap-together fasteners (also referred known in the art as reclosable fasteners). In still other embodiments, the exposed surfaces of the first and second securing members 1719, 1720 may comprise adhesive or other grip and peel style technologies, such as that known as Geckskin®. The hooks or loops or snap-together fasteners or adhesive may be configured to engage with a securing member on the hinge member 1750 for purposes of coupling the frame 1710 to the hinge member 1750 as described herein.

Furthermore, in the exemplified embodiment, there are one or more retaining members 1725 coupled to the frame 1710 along the inner surface 1716 of the rabbet 1714 for purposes of retaining or otherwise holding a display item within the frame 1710. In the exemplified embodiment, there is a distinct retaining member 1725 positioned along each linear section of the rabbet 1714, as best shown in FIG. 17. Specifically, the frame 1710 comprises several linear sections, each of which comprises a linear section of the rabbet 1714. Thus, a different or distinct retaining member 1725 may be attached to the frame 1710 along each of the linear sections of the rabbet 1714. In some embodiments, more than one of the retaining members 1725 may be positioned along each linear section of the rabbet 1714. In still other embodiments, a single, continuous, integral retaining member 1725 may extend along parts of each of the linear sections of the rabbet 1714. The purpose of the retaining member(s) 1725 is to hold or otherwise retain a display item within the rabbet 1714. Thus, the retaining members 1725 may be elongated in the linear direction of the rabbet 1714 or there may be a plurality of smaller retaining members 1725 positioned within each linear section of the rabbet 1714 to achieve this retention function.

In the exemplified embodiment, the retaining members 1725 are L-shaped brackets. That is, the retaining members 1725 comprise a second portion 1727 that is aligned along and coupled to the inner surface 1716 of the rabbet 1714 and a first portion 1726 that protrudes from the inner surface 1716 of the rabbet 1714. The second portions 1727 of the retaining members 1725 have inner surfaces that abut the inner surface 1716 of the rabbet 1714. In the exemplified embodiment, the second portions 1727 of the retaining members 1725 are coupled to the inner surface 1716 of the rabbet 1714 using fasteners (screws, nails, staples, or the like, as best shown in FIGS. 18A and 18B). However, this is not required in all embodiments and it may be possible to attach the retaining members 1725 to the inner surface 1716 of the rabbet 1714 using other means, such as adhesive or the like.

The first portion 1726 of the retaining members 1725 extends from one of the ends of the second portion 1727 of the retaining members 1725. The first and second portions 1726, 1727 of the retaining members 1725 are both elongated in the linear direction of the rabbet 1714, with the first portion 1726 extending along an entirety of the length of the second portion 1727. Moreover, in the exemplified embodiment, the first portion 1726 extends obliquely from the second portion 1727. That is, the first portion 1726 extends from the second portion 1727 so that an acute angle is formed between the first and second portions 1726, 1727. The first portion 1726 extends from the second portion 1727 so that as the first portion 1726 extends further from the second portion 1727, the first portion 1726 extends downwardly in a direction away from the inner surface 1716 and away from the floor 1715 of the rabbet 1714 and towards the rear surface 1712 of the frame 1710. Stated another way, the floor 1715 and the inner surface 1716 of the rabbet 1714 are perpendicular to one another, and the first portion 1726 of the retaining member 1725 is oriented obliquely relative to each of the floor 1715 and the inner surface 1716 of the rabbet 1714. By angling the first portion 1726 of the retaining members 1725 downwardly away from the floor 1715 of the rabbet 1714, a user can more easily insert and remove display items from the rabbet 1714 without removing the frame 1714 from the wall. The first portion 1726 of the retaining member 1725 is spaced apart from the floor 1715 of the rabbet 1714 by a gap. The transparent panel 1718 is disposed within the rabbet 1714 and positioned in the gap, and there is also sufficient space for a display item 1740 to be positioned in the rabbet 1714 between the transparent panel 1718 and the first portion 1726 of the retaining member 1725.

While the retaining members 1725 are depicted and described as L-shaped brackets, the invention is not to be so limited in all embodiments. In other embodiments, the retaining members 1725 may be flex tabs or glazier points that can be flexed or bent to allow for the display item 1740 to be inserted into and removed from the space between the retaining members 1725 and the floor 1715 of the rabbet 1714. Thus, the retaining members 1725 may include only features similar to the first portions 1726 but not also the second portions, with the first portions 1726 being partially embedded within the frame 1710. However, the retaining members 1725 being L-shaped brackets may be advantageous because it does not require a user to bend the component when inserting and removing items from the rabbet 1714. This may enable a user to change out the display item without ever having to remove the frame 1710 from the wall on which it is hanging as described above and again below.

As mentioned above, the frame assembly 1700 also comprises a hinge member 1750. The hinge member 1750 is a component that is mounted to a support surface or wall 1790 (see FIG. 18B), and then the frame 1710 is detachably coupled to the hinge member 1750 to hang the frame 1710 from the wall 1790. The hinge member 1750 is formed from a sheet of material that is folded along a fold line much like the hinge portion 214 of the backing panel 204 described above. In essence, the hinge member 1750 is the same as the backing panel 204 described above, except with the body portion 210 omitted. That is, the hinge member 1750 is similar if not identical to the hinge portion 214 of the backing panel 204. Of course, in other embodiments the hinge member 1750 may more closely resemble the backing panel 204 described above such that it may include a body portion with biased members. However, due to the incorporation of the retaining members 1725, the biased members may no longer be necessary because the retaining members 1725 will perform the function of retaining the display item in the frame 1710 (which function was being achieved with the biased members in the previously described embodiments).

In the exemplified embodiment, the hinge member 1750 is a single sheet of material comprising a front surface 1751 and a rear surface 1752. The hinge member 1750 is folded along a fold line 1753 so that a first portion 1754 of the hinge member 1750 that is above the fold line 1753 overlaps a second portion 1755 of the hinge member 1750 that is below the fold line 1753. Although in the exemplified embodiment the fold line 1753 is at a central location along the length of the hinge member 1750, this is not required in all embodiments and the first portion 1754 may overlap some or all of the second portion 1755 in various embodiments. When the hinge member 1750 is folded as shown in FIG. 18B, the front surface 1751 of the hinge member 1750 along the first portion 1754 thereof faces the front surface 1751 of the hinge member 1750 along the second portion 1755 thereof. Moreover, the rear surface 1752 of the hinge member 1750 along the first portion 1754 thereof faces outwardly away from the wall 1790 and is exposed for attachment to the frame 1710 as described below.

The hinge member 1750 is configured to be mounted to the wall 1790 with the rear surface 1752 of the hinge member 1750 along the second portion 1755 of the hinge member 1750 facing the wall 1790. The hinge member 1750 may be mounted to the wall 1790 using fasteners such as nails, staples, screws, hook-and-loop strips, or the like. However, in the exemplified embodiment the hinge member 1750 is mounted to the wall using a double-sided adhesive tape 1760 which is attached to the rear surface 1752 of the second portion 1755 of the hinge member 1750. It is important to note that the first portion 1754 of the hinge member 1750 is not directly connected to the wall 1790. Thus, the first portion 1754 of the hinge member 1750 is free to rotate relative to the second portion 1755 of the hinge member 1750 about the fold line 1753. Moreover, when the hinge member 1750 is mounted to the wall 1790, the first portion 1754 of the hinge ember 1750 can freely rotate relative to the wall 1790 about the fold line 1753. This is what enables the hinge member 1750 to operate as a hinge or movable joint upon which the frame 1710 can swing between open and closed states.

As shown in FIG. 18B, there is a third securing member 1761 located on the rear surface 1752 of the hinge member 1750 along the first portion 1754 of the hinge member 1750. Because the first portion 1754 of the hinge member 1750 is folded relative to the second portion 1755 of the hinge member 1750 along the fold line 1753, the rear surface 1752 of the first portion 1754 of the hinge member 1750 faces outwardly away from the wall 1790. The third securing member 1761 is configured to engage or mate with one of the first and second securing members 1719, 1720 on the frame 1710 to couple the frame 1710 to the hinge member 1750. As mentioned above, in the exemplified embodiment, the first and second securing members 1719, 1720 comprise one of hooks or loops on their exposed surfaces. Thus, in the exemplified embodiment the third securing member 1761 comprises the other one of hooks or loops on its exposed surface (with its non-exposed surface comprising adhesive so that it can be coupled to the hinge member 1750). Therefore, when one of the first and second securing members 1719, 1720 is put into contact or engagement with the third securing member 1761, the first or second securing member 1719, 1720 will become attached to the third securing member 1761, thereby effectively coupling the frame 1710 to the hinge member 1750.

Furthermore, although hook and loop style fastener members are described in accordance with the exemplified embodiment, the invention is not to be so limited in all embodiments. The securing members 1719, 1720, 1761 may be other styles of snap-together fasteners, such as mushroom style fasteners having mushroom shaped heads that slid past each other with a snap. In other embodiments, the third securing member 1761 may have an adhesive on its exposed surface for purposes of coupling to the frame 1710 and the first and second securing members 1719, 1720 may be omitted. In other embodiments, the first and second securing members 1719, 1720 may have an adhesive on their exposed surfaces for purposes of attaching the frame 1710 to the hinge member 1750 and the third securing member 1761 may be omitted. Thus, there are variations to the exemplified embodiment which still fall within the scope of the invention described and claimed herein.

When the frame 1710 is to be hung in a portrait orientation, the first securing member 1719 engages the third securing member 1761 to couple the frame 1710 to the hinge member 1750. When the frame 1710 is to be hung in a landscape orientation, the second securing member 1720 engages the third securing member 1761 to couple the frame 1710 to the hinge member 1750. Thus, the structure of the frame assembly 1700 described herein allows for easy interchange of display items 1740 in the frame 1710 and also easy modification of the hanging orientation of the frame 1710 on the wall 17980. The function of the frame assembly 1700 and particularly the ability to pivot or rotate the frame 1710 away from the wall 1790 for changing out the display item contained therein operates the same regardless of whether the frame 1710 is hung in the portrait or landscape orientation.

Referring to FIG. 18B, the frame 1710 is illustrated hanging from the wall 1790. In particular, the hinge member 1750 is mounted directly on the wall 1790 and the frame 1710 is coupled to the first portion 1754 of the hinge member 1750 as described herein above. FIG. 18B illustrates the frame 1710 in a closed position. In the closed position, the frame 1710 hangs downwardly from the hinge member 1750 and is oriented substantially parallel to the wall 1790. This is the normal way that a frame is hung from a wall in its display position. Moreover, as described previously, the display item 1740 is disposed within the rabbet 1714 of the frame 1710 and is trapped between the first portion 1726 of the retaining members 1725 and the transparent panel 1718 (although it could be trapped between the first portion 1726 of the retaining members 1725 and the floor 1715 of the rabbet 1714 if the transparent panel 1718 were to be omitted).

Figure 18C:
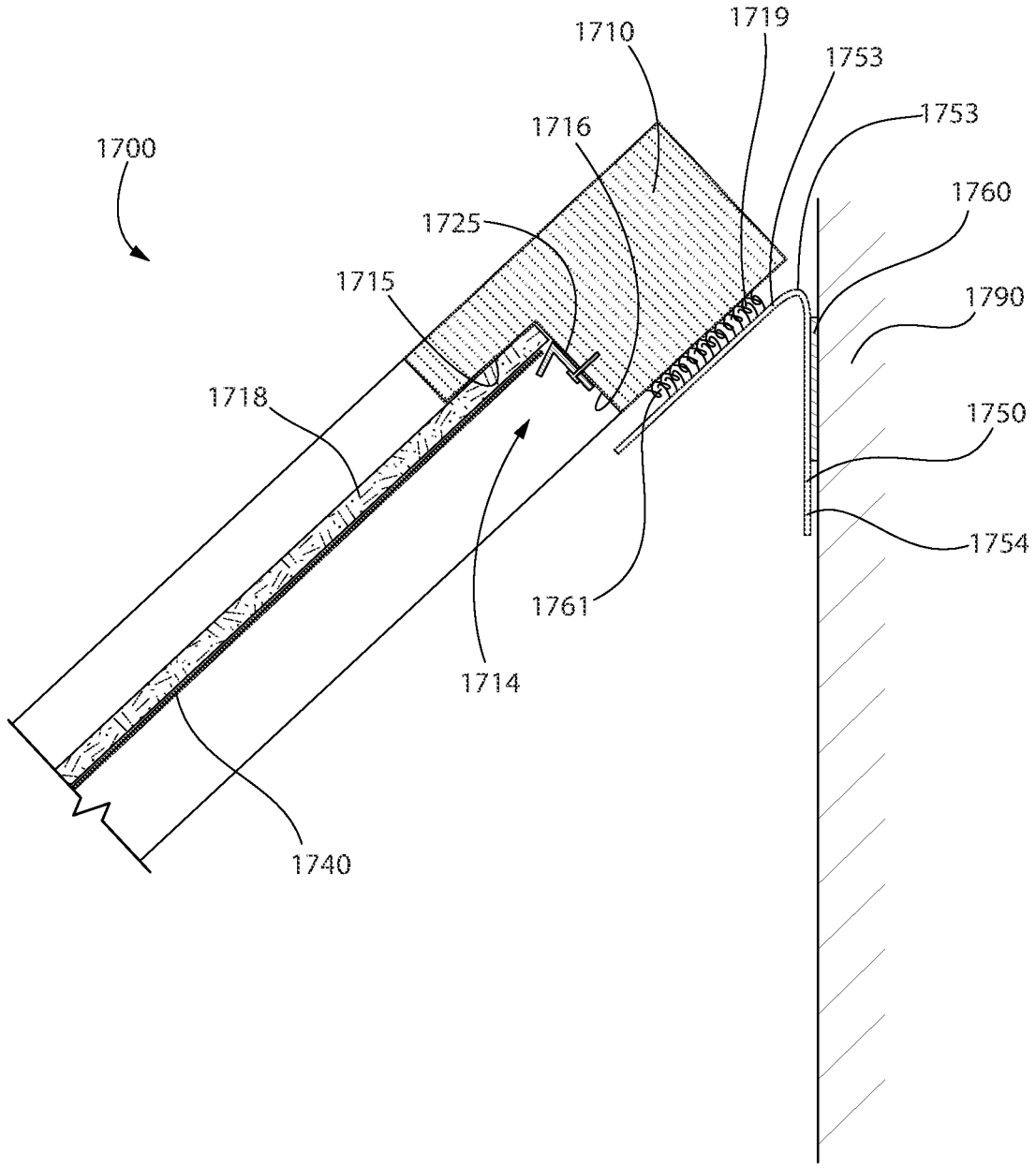
FIG. 18C is the cross-sectional view of FIG. 18B with the frame having been rotated to an open position.

Referring to FIGS. 18B and 18C collectively, the frame 1710 can be pivoted from the closed position (shown in FIG. 18B) to an open position (shown in FIG. 18C) by rotating the frame 1710 and the first portion 1754 of the hinge member 1750 relative to the wall 1790 (or relative to the second portion 1755 of the hinge member 1750) about the fold line 1753. This pivoting will rotate the first portion 1754 of the hinge member 1750 away from the second portion 1755 of the hinge member 1750 (and also away from the wall 1790). Because the frame 1710 is coupled to the first portion 1754 of the hinge member 1750, the lower portion of the frame 1710 will similarly pivot or rotate away from the wall 1790. When the frame 1710 is pivoted into the open position, the display item 1740 can be easily removed from the rabbet 1714 and replaced with another display item if so desired. Thus, this allows for a user to exchange the display item 1740 that is held by the frame 1710 without having to remove the frame 1710 from the wall 1790. Rather, the frame 1710 can simply be pivoted to the open position shown in FIG. 18C while remaining hanging from the wall 1790. The hinge member 1750 alters from a folded position (FIG. 18B) to an extended position (FIG. 18C) during this pivoting or rotational movement of the frame 1710.

It should be appreciated that in the exemplified embodiment, an upper portion of the frame 1710 is attached directly to the hinge member 1750 and the remainder of the frame 1710 is not attached to the hinge member 1750 or to the wall 1790. Thus, the remainder of the frame 1710 hangs freely from the hinge member 1750 without being coupled to the hinge member 1750 or to the wall 1790. This allows a user to readily and easily transition the frame 1710 from the closed position to the open position by gripping the lower portion of the frame 1710 and rotating it outwardly and upwardly. Of course, in other embodiments the lower portion of the frame 1710 may be attached to the wall 1790 such as by adhesive strips or hook and loop or snap-together fasteners such that a user must first detach the lower portion of the frame 1710 from the wall before rotating the frame 1710 from the closed position to the open position.

Turning to FIGS. 19A-19D, a frame assembly 1900 is illustrated in accordance with yet another embodiment of the present invention. As with the embodiments described previously, the concepts described above may be applicable to the frame assembly 1900 and therefore some concepts which are not specifically described with reference to FIGS. 19A-19D may nonetheless be applicable.

The frame assembly 1900 comprises a frame 1910 and a stand 1950, with the frame 1910 being detachably coupled to the stand 1950 in the exemplified embodiment. Moreover, in some embodiments the frame 1910 may be coupled to the stand 1950 but not in a detachable manner. Nonetheless, the frame 1910 comprises a front surface 1911, a rear surface 1912 opposite the front surface 1911, and a display window 1913 extending therethrough from the front surface 1911 to the rear surface 1912. Furthermore, the frame 1910 comprises a rabbet 1914 within which a transparent panel 1915 and a display item 1916 may be disposed. The transparent panel 1915 may be adhered to the floor of the rabbet 1914 using adhesive materials in some embodiments, or the transparent panel 1915 may be held in place within the rabbet 1714 using clips or other mechanical structures. The display item 1916 may be held in place within the rabbet 1914 using features of the stand 1950 to be described below (in particular, biased members as described above with reference to previously described embodiments).

The stand 1950 comprises a horizontal support portion 1951 that extends from a front edge 1952 to a rear edge 1953 and a vertical display portion 1954 extending upwardly from the horizontal support portion 1951. In the exemplified embodiment, the vertical display portion 1954 extends upwardly from the front edge 1952 of the horizontal support portion 1951 at an angle in a direction towards the rear edge 1953 of the horizontal support portion 1951. That is, the vertical display portion 1954 is not oriented perpendicular to the horizontal support portion 1951 in the exemplified embodiment. Rather, the vertical display portion 1954 is angled rearwardly relative to the horizontal support portion 1951 to provide a better viewing angle for a user and to also provide a better support system for the frame 1910. The stand 1950 is configured to stand upright when positioned on a horizontal surface 1990 such as a table, a desk, a floor, or the like. Moreover, the stand 1950 is configured to support the frame 1910 thereon and to hold the frame 1910 at an oblique angle relative to the horizontal surface 1990 to allow for easy viewing of the display item 1916 held thereby.

In the exemplified embodiment, the vertical display portion 1954 of the stand 1950 comprises a rigid support portion 1955 and a flexible panel portion 1956 coupled to the rigid support portion 1955. The rigid support portion 1955 provides rigidity to the vertical display portion 1954 to enable it to support the frame 1910 as described herein. The flexible panel portion 1956 forms a hinge portion 1957 of the vertical display portion 1954 and also comprises a plurality of biased members 1958 that facilitate pressing the display item 1940 into contact with the transparent panel 1915 (or with the floor of the rabbet 1914 in embodiments that omit the transparent panel 1915) as described in more detail below. It may be possible in other embodiments for the vertical display portion 1954 to be formed as an integral structure rather than having two portions (one flexible and one rigid). In particular, the vertical display portion 1954 may simply be made out of a material that is sufficiently rigid to enable it to support the frame 1910 while also having flexibility at the hinge portion 1957. Such flexibility at the hinge portion 1957 may be achieved by forming a living hinge into the vertical display portion 1954 at the fold line.

In the exemplified embodiment, a lower segment 1965 of the flexible panel portion 1956 of the vertical display portion 1954 is folded to form the hinge portion 1957 in a manner that is similar to that which has been described above for the previous embodiments. By folding the lower segment 1965 of the flexible panel portion 1957 about a fold line, the lower segment 1965 of the flexible panel portion 1957 forms a hinge that can rotate relative to the fold line. The hinge portion 1957 can be altered from a folded configuration, shown in FIG. 19C, whereby the lower segment 1965 is folded about the fold line, and an extended configuration, shown in FIG. 19D, whereby the lower segment 1965 is rotated about the fold line in a direction away from the remainder of the vertical display portion 1954 of the stand 1950.

The biased members 1958 are cutouts that are formed integrally with the flexible panel portion 1956 of the vertical display portion 1954. In particular, the biased members 1958 are partially cut-out from the flexible panel portion 1956 and then bent to extend outwardly from the vertical display portion 1954 in a direction that is towards the frame 1910 when the frame 1910 is coupled to the stand 1910 as described in more detail below. The biased members 1958 are formed in the same manner as the biased members 212 described above and therefore the description of those features above is applicable to this embodiment and the process and structure will not be described again here in the interest of brevity. However, it should be noted that in the exemplified embodiment the biased members 1958 extend outwardly and downwardly from the vertical display portion 1954 of the stand 1950, whereas the biased members 212 were shown in FIG. 2 as extending outwardly and upwardly from the backing panel 204. As noted above, the particular direction at which the biased members 212 extend is not to be limiting in all embodiments unless specifically claimed as such.

In this embodiment, the frame 1910 and the stand 1950 are coupled together at two locations. In particular, a lower portion 1917 of the frame 1910 is coupled to the hinge portion 1957 of the vertical display portion 1954 of the stand 1950. Specifically, securing members 1919, 1959 on the lower portion 1917 of the frame 1910 and on the hinge portion 1957 of the vertical display portion 1954 of the stand 1950 engage one another to couple the frame 1910 to the stand 1950. The securing members 1919, 1959 may be hook and loop fasteners, snap-together fasteners, adhesive strips, or the like as has been described above. Moreover, the securing members 1919, 1959 may be omitted and replaced with more permanent connection features, such as an adhesive or fasteners such as screws, nails, staples, or the like to more permanently couple the lower portion 1917 of the frame 1910 to the hinge portion 1957 of the stand 1950 in other embodiments. The frame 1910 remains coupled to the hinge portion 1957 of the stand 1950 when the frame 1910 is in a first closed position as shown in FIG. 19C and when the frame 1910 is in a second open position as shown in FIG. 19D.

Moreover, in the exemplified embodiment, in order to ensure that the frame 1910 remains coupled to the stand 1950 and that the frame 1910 is maintained in the first (closed) position until a user purposely moves the frame 1910 to the second (open) position, an additional set of securing members 1920, 1960 are positioned on an upper portion 1918 of the frame 1910 and along a top region of the vertical display portion 1954 of the stand 1950. The securing members 1920, 1960 engage each other to couple the upper portion 1918 of the frame 1910 to the top region of the vertical display portion 1954 of the stand 1950 to assist in maintaining the frame 1910 in its angled position as it leans against the stand 1910. The securing members 1920, 1960 may be hook and loop fasteners, snap-together fasteners, adhesive strips, or the like. The securing members 1920, 1960 may be omitted in some embodiments and the frame 1910 may remain in its display position as shown in FIG. 19C due to gravity as the frame 1910 leans against the stand 1950.

Figure 19A:
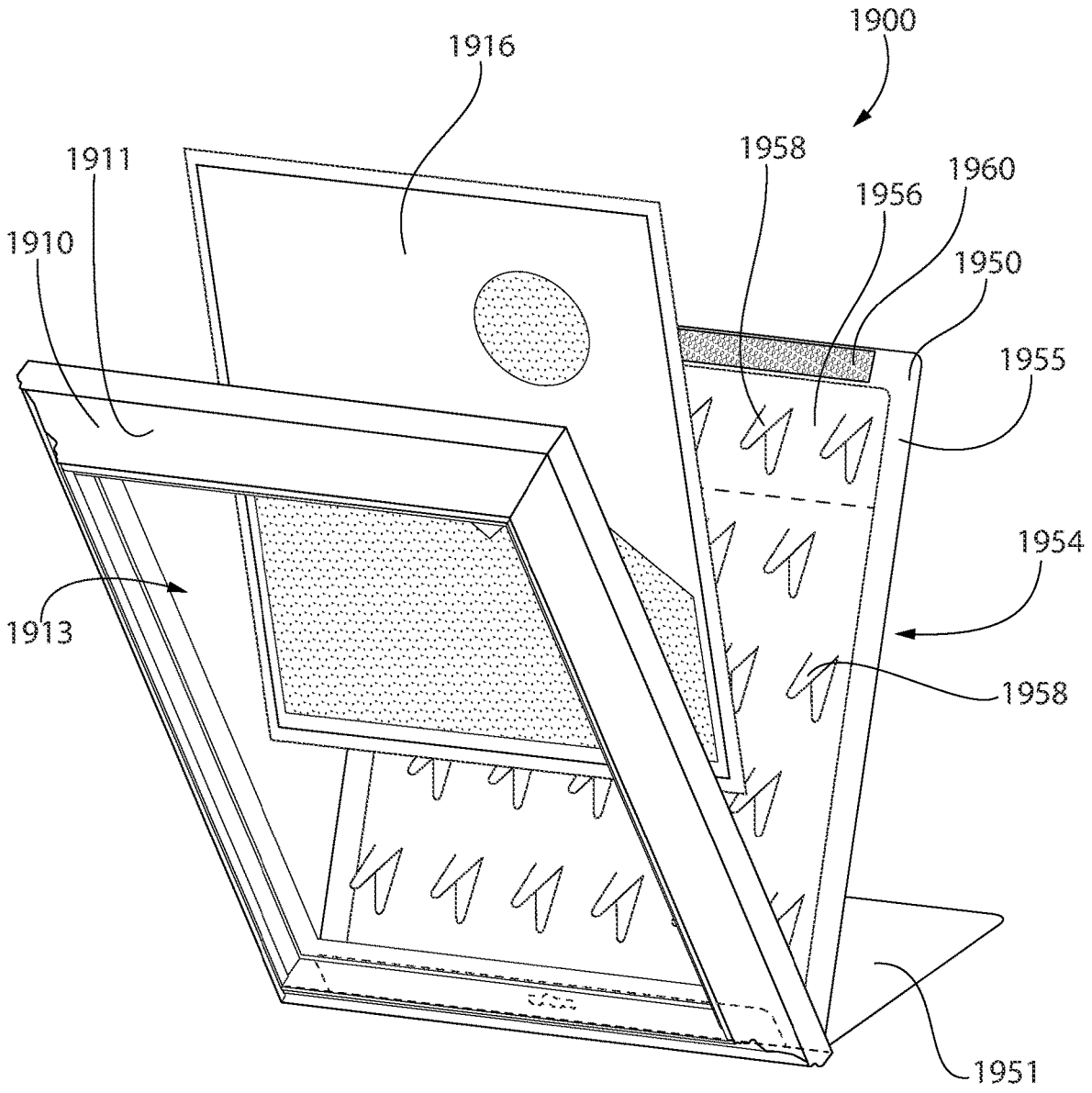
FIG. 19A is a perspective view of a frame assembly in accordance with still another embodiment of the present disclosure, with a frame thereof in an open position.
Figure 19B:
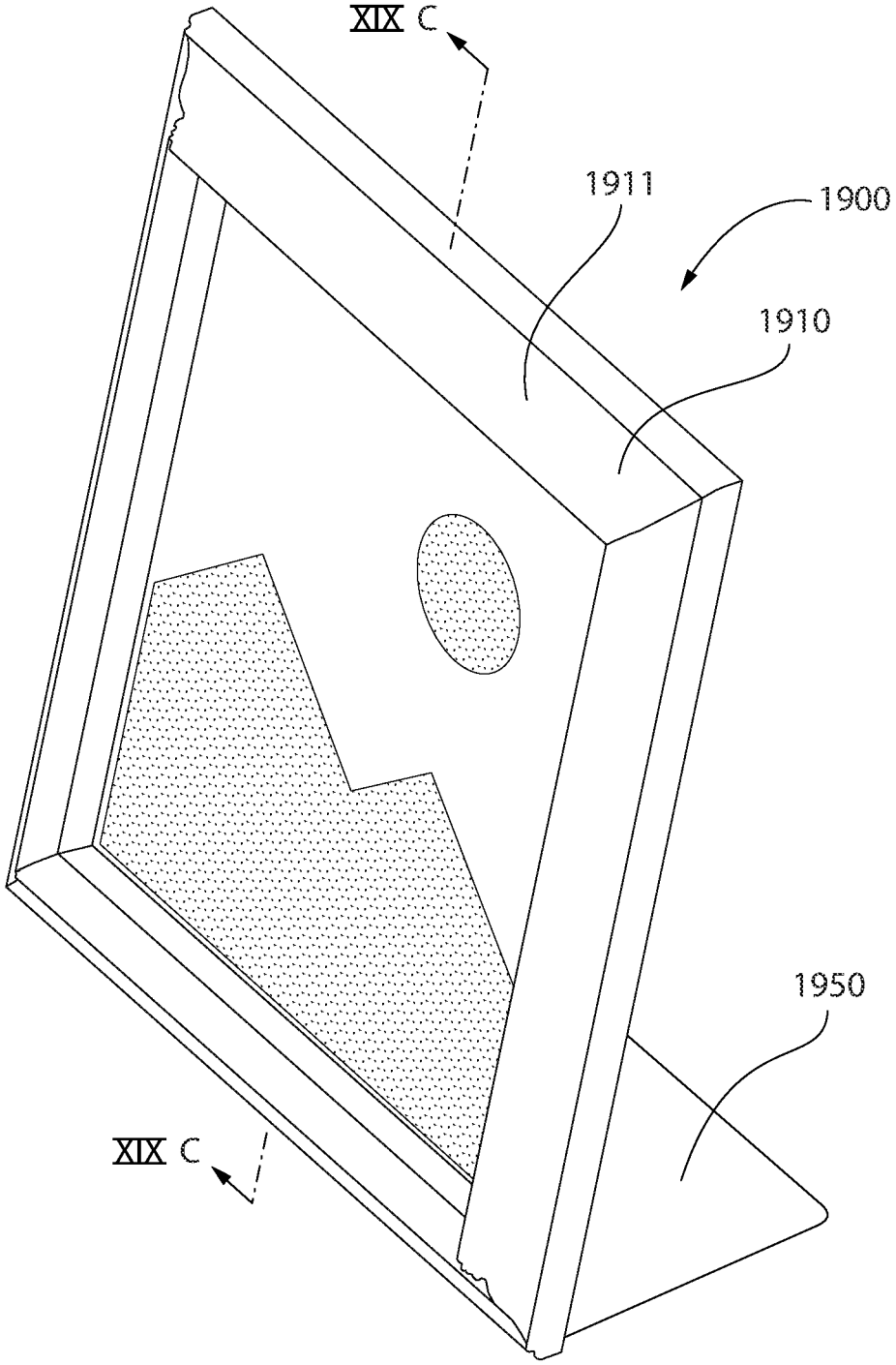
FIG. 19B is a perspective view of the frame assembly of FIG. 19A with the frame thereof in a closed position.
Figure 19C:
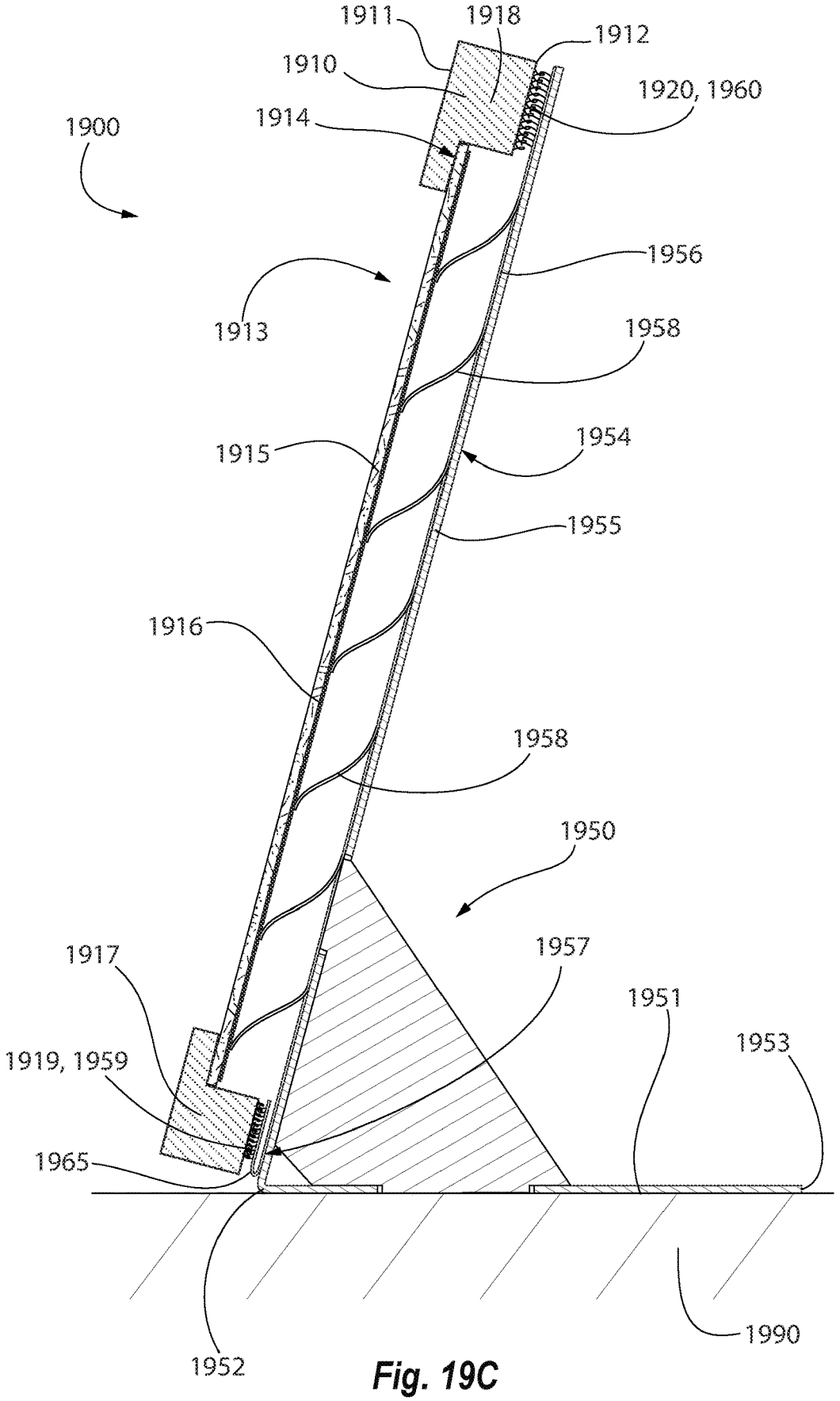
FIG. 19C is a cross-sectional view taken along line XIXC-XIXC of FIG. 19B.
Figure 19D:
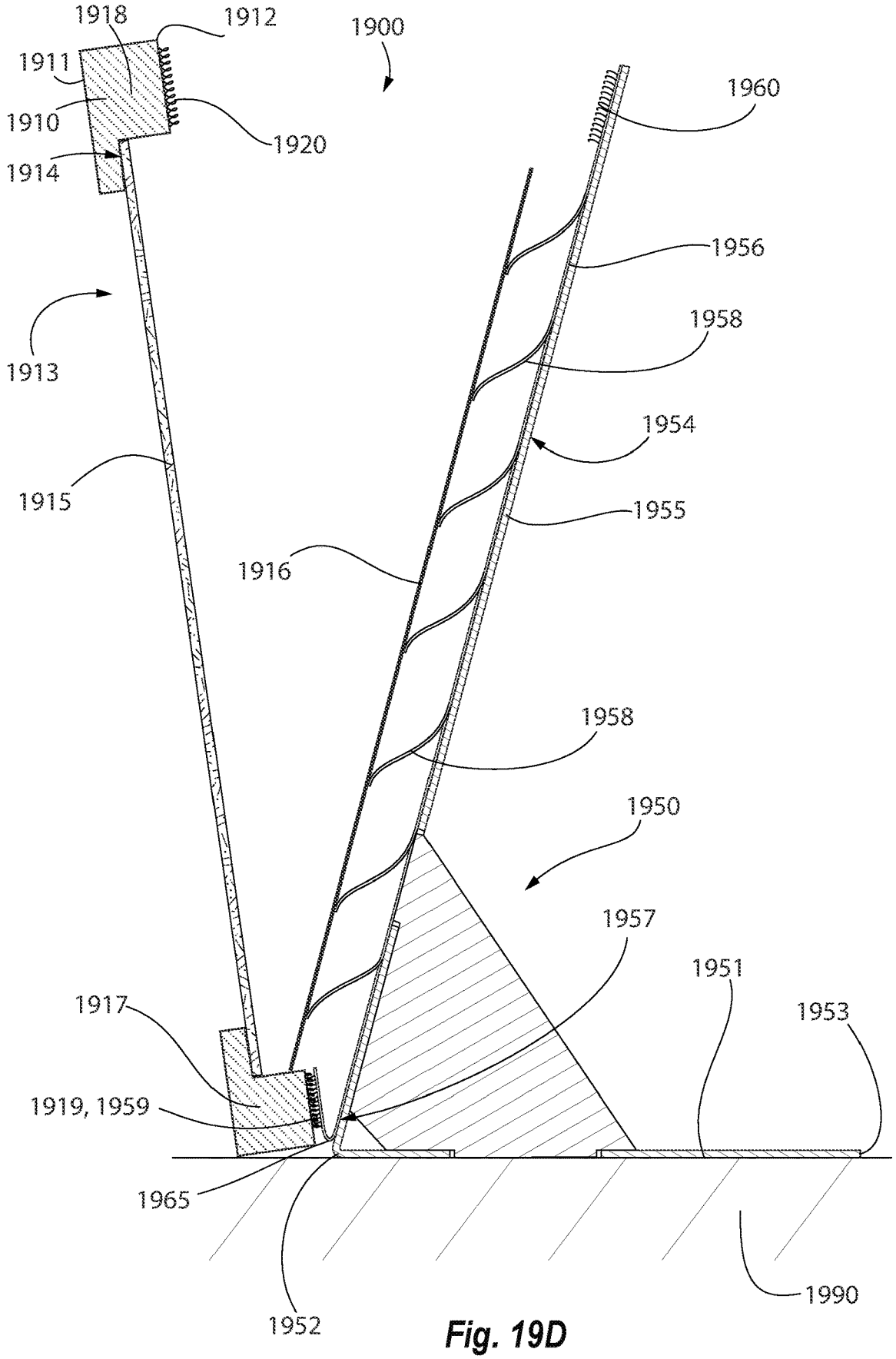
FIG. 19D is the cross-section of FIG. 19C with the frame being pivoted to an open position.

Referring to FIGS. 19C and 19D, the frame 1910 is pivotable relative to the stand 1950 while remaining coupled to the stand 1950. Specifically, the frame 1910 is pivotable between a first position (FIG. 19C) whereby the hinge portion 1957 of the vertical display portion 1954 of the stand 1950 is in a folded configuration and the frame 1910 is leaning against the vertical display portion 1954 of the stand 1950 and a second position (FIG. 19D) whereby the hinge portion 1957 of the vertical display portion 1954 of the stand 1950 rotates from the folded position to an extended position, thereby rotating a portion of the frame 1910 away from the vertical display portion 1954 of the stand 1950.

In the first position, the frame 1910 leans against the vertical display portion 1954 of the stand 1950 so that the securing members 1920, 1960 can be engaged. It may be possible for the securing members 1920, 1960 to be omitted, because the frame 1910 will still lean on and against the vertical display portion 1954. However, the securing members 1920, 1960 provide a more secure coupling between the frame 1910 and the vertical display portion 1954 of the stand 1950 to hold the frame 1910 in the first position until the frame 1910 is intentionally pivoted to the second position by a user. When the frame 1910 is in the first position, the biased members 1958 extend from the stand 1950 and press the display item 1916 against the transparent panel 1915 or against the floor of the rabbet 1914. Thus, in this embodiment there is nothing holding the display item 1916 in position other than the force applied by the biased members 1958 onto the display item 1916 in the direction of the transparent panel 1915. As a result, when the frame 1910 is pivoted to the second position, the display item 1916 can be easily and readily removed from the rabbet 1914 and replaced with another display item.

In the exemplified embodiment, the hinge portion 1957 of the stand 1950 is located at the bottom of the stand 1950. Thus, the frame 1910 pivots from the first (closed) position shown in FIG. 19C to the second (open) position shown in FIG. 19D by pivoting/rotating the upper portion 1918 of the frame 1910 away from the stand 1950. However, the invention is not to be so limited in all embodiments. In particular, in an alternative embodiment, the hinge portion 1957 of the stand 1950 may be located at the top of the stand 1950 so that the frame 1910 is pivoted from its lower end 1917 rather than from its upper end 1918 as with the exemplified embodiment. In still other embodiments, the stand 1950 may include two hinges, one at the top end thereof and one at the bottom end thereof, and the user can pivot the frame 1910 either from the top end or from the bottom end, accordingly. Moreover, the stand 1950 may include hinges along its sides rather than (or in addition to) its top/bottom ends so that the frame 1910 can pivot from left to right or right to left rather than from its top or bottom. In any case, the stand 1950 comprises one or more built-in hinge portions that enable the frame 1910 to pivot relative to the stand 1950 so that the display items 1916 can be placed into and removed from the frame 1910 without detaching the frame 1910 from the stand 1950. Moreover, the stand 1950, by way of its biased members 1958, function to hold the display item 1916 in place when the frame 1910 is in the first (i.e., closed) position as shown in FIG. 19C.

Figure 20:
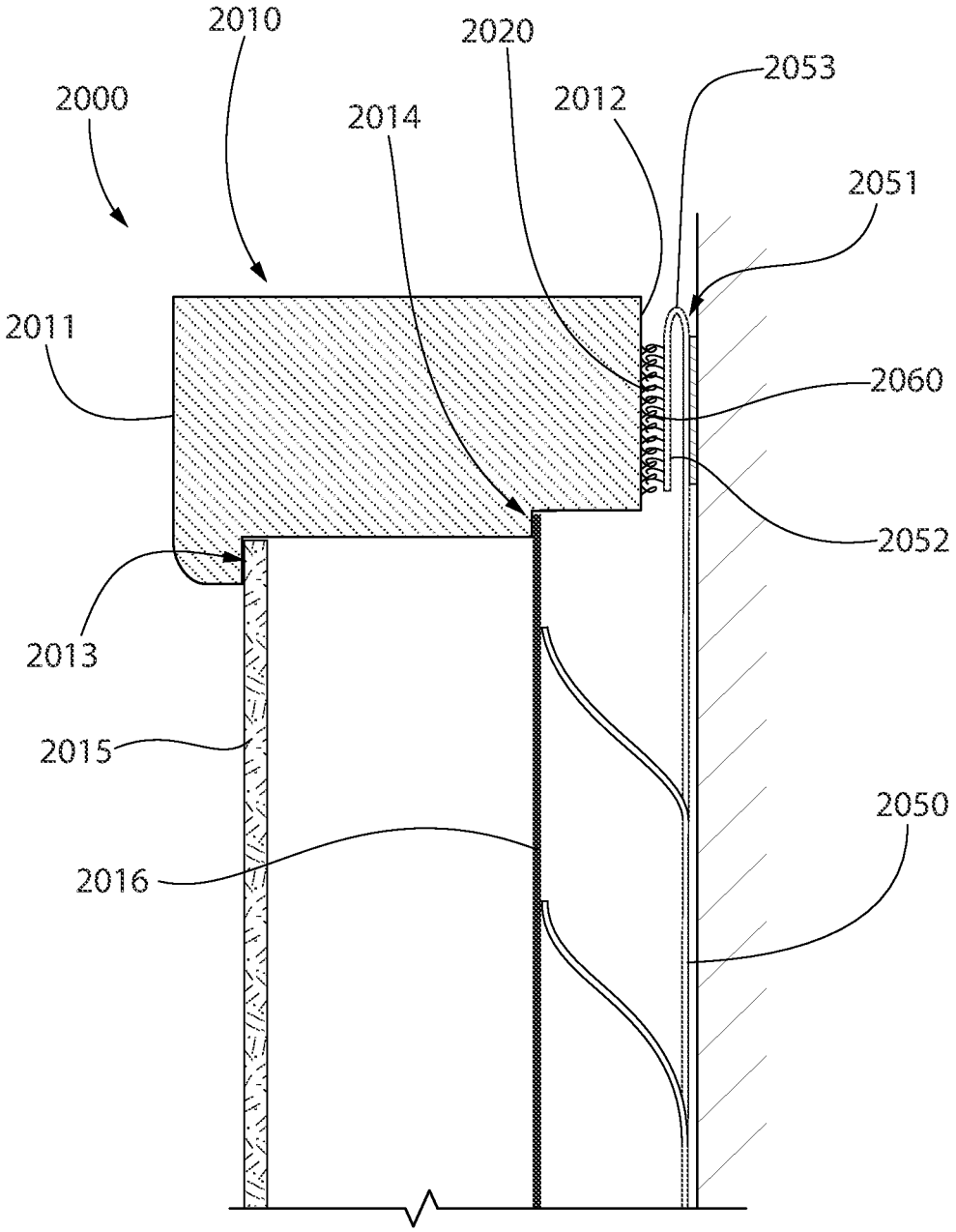
FIG. 20 is a partial side cross-sectional view of a frame assembly in accordance with a further embodiment of the present disclosure.
Figure 21:
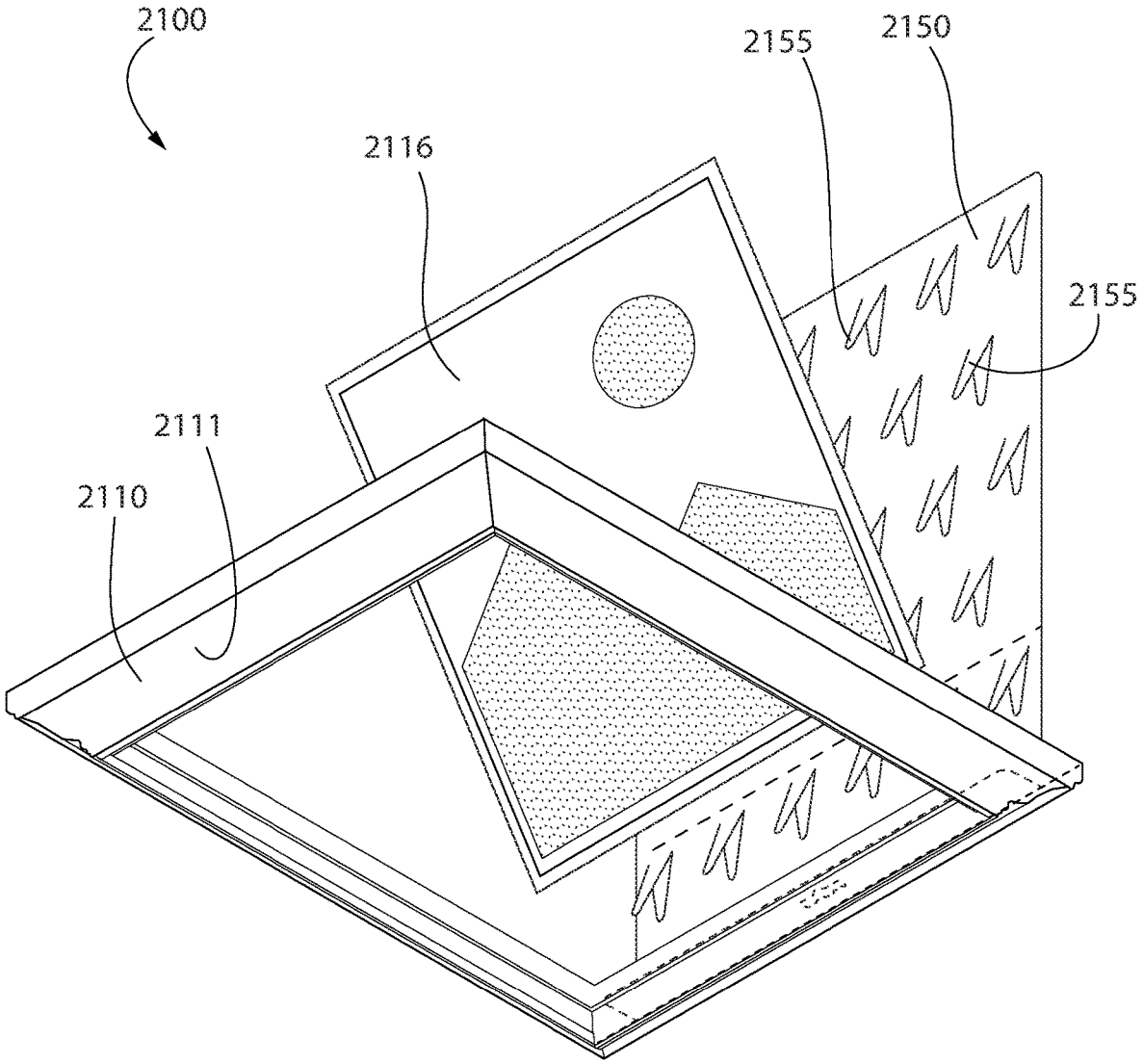
FIG. 21 is a perspective view of a frame assembly in accordance with a still further embodiment of the present disclosure, wherein a frame thereof is in an open position.
Figure 22:
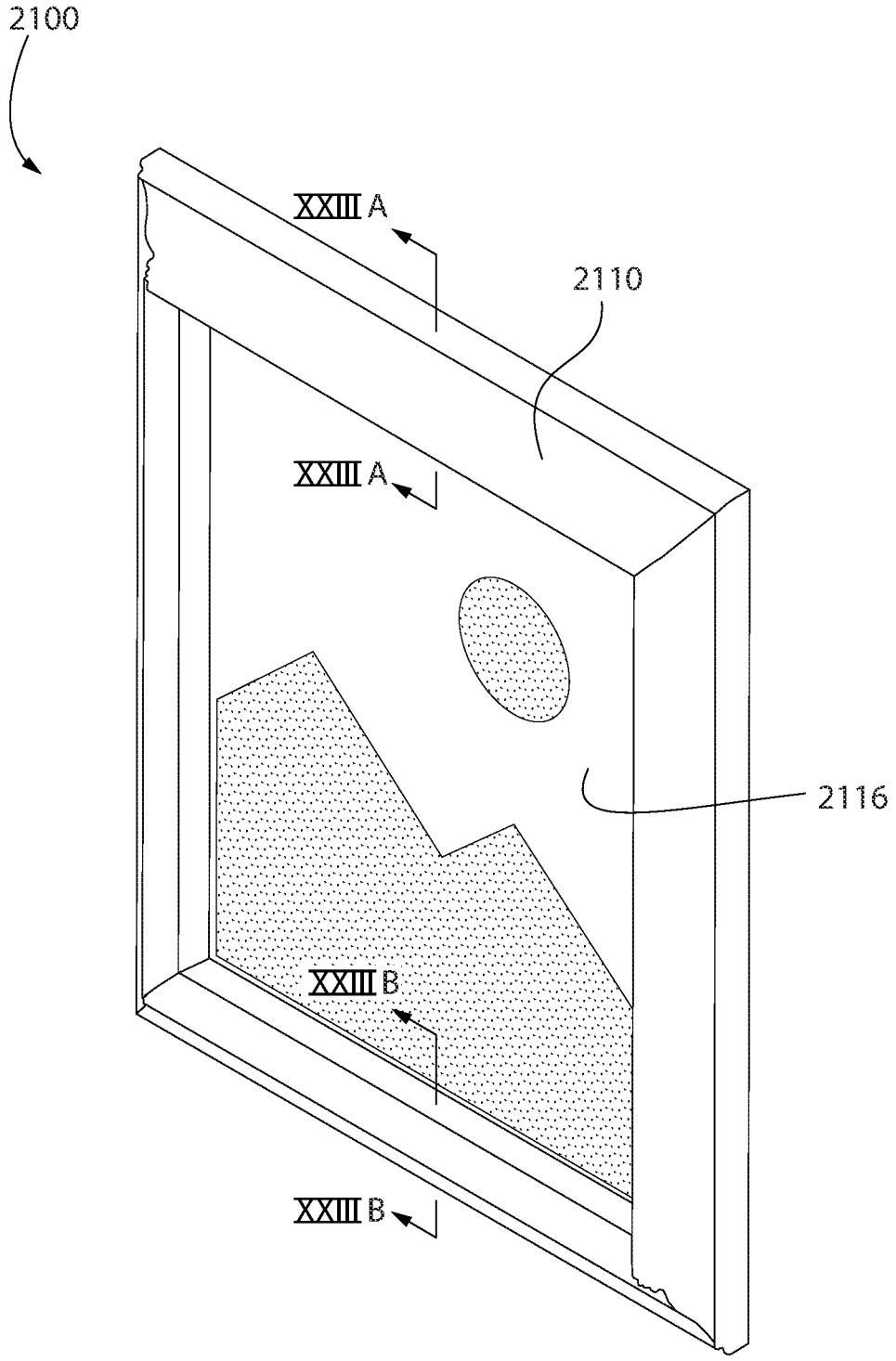
FIG. 22 a perspective view of the frame assembly of FIG. 21 with the frame in a closed position.

Referring to FIG. 20, yet another embodiment of a frame assembly 2000 is illustrated and will be described. The frame assembly 2000 comprises a frame 2010 and a backing panel 2050. In this embodiment, the frame 2010 is in the style of a shadow box, which means that the item being displayed by the frame 2010 is set back from the glazing. In that regard, the frame 2010 comprises a front surface 2011, a rear surface 2012, a first rabbet 2013, and a second rabbet 2014. The first rabbet 2013 is located closer to the front surface 2011 than the second rabbet 2014. The second rabbet 2014 is located closer to the rear surface 2012 than the first rabbet 2013. Thus, the second rabbet 2014 is located between the first rabbet 2013 and the rear surface 2012 of the frame 2010.

The frame 2010 comprises a transparent panel or glazing 2015 which is disposed within the first rabbet 2013. The transparent panel 2015 may be secured to the frame 2010 within the first rabbet 2013 via adhesive, glue, clips, fasteners, brackets, or the like. The second rabbet 2014 is configured to receive a display item 2016. Moreover, as discussed below, features of the backing panel 2050 are configured to press the display item 2016 into the second rabbet 2014 to retain the display item 2015 therein.

The backing panel 2050 has the same structure and function as the backing panel 204 described above. In particular, the backing panel 2050 is formed as a sheet of material, such as plastic material. The backing panel 2050 comprises a hinge portion 2051 that is formed by folding an upper segment 2052 of the backing panel 2050 so as to overlap a portion of the backing panel 2050 below the upper segment 2052 (i.e., a body portion of the backing panel 2050). Thus, the upper segment 2052 of the backing panel 2050 is configured to pivot or rotate about a fold line 2053 relative to a remainder of the backing panel 2050. The backing panel 2050 also comprises a plurality of biased members 2055. The biased members 2055 are identical to the biased members 212. In particular, the biased members 2055 are formed by partially cutting out portions of the backing panel 2050 and then bending or folding those cut-out portions of the backing panel 2050 to make them protrude from the backing panel 2050. Of course, the biased members 2055 could be replaced with other types of biased members such as that which has been described above with reference to FIGS. 7A-7E. In fact, in all embodiments described herein, the biased members may take the form and structure of any of the different embodiments and types of biased members described herein.

The frame 2010 is illustrated coupled to the backing panel 2050 in FIG. 20. In particular, a securing member 2020 coupled to the frame 2010 is configured to engage a securing member 2060 on the upper segment 2052 of the backing panel 2050. The securing members 2020, 2060 may be hook and loop fastener strips, adhesive strips, snap-together fasteners, or the like as has been described herein above. That is, the securing members 2020, 2060 have adhesive on one side thereof for coupling to the respective one of the frame 2010 and the backing panel 2050 and attachment members such as hooks, loops, snap-together fasteners, mushroom style fasteners, or the like on the opposite sides thereof. Thus, the frame 2010 can be pivoted from a first position (closed position) as shown in FIG. 20 to an open position (not shown) by rotating the bottom portion of the frame 2010 away from the wall upon which it is hanging. This is possible due to the coupling of the frame 2010 to the hinge portion 2051 of the backing panel 2050 as has been described in great detail throughout this application. Specifically, the upper portion of the frame 2010 will remain coupled to the hinge portion 2051 of the backing panel 2050 and the frame 2010 and hinge portion 2051 will pivot or rotate about the fold line 2053. As the lower portion of the frame 2010 is pivoted away from the wall, the display item 2016 becomes accessible and can be removed and replaced with another display item as desired.

Referring to FIGS. 21-23B, a frame assembly 2100 is illustrated in accordance with still another embodiment of the present invention. The frame assembly 2100 is similar to the frame assembly 100 described above with reference to FIG. 1, with the difference being the manner in which the frame pivots relative to the backing panel. In particular, whereas in the frame assembly 100 of FIG. 1 the hinge is located at the top of the backing panel, in the frame assembly 2100 of FIGS. 21-23B the hinge is located at the bottom of the backing panel. Otherwise, the structure and function is identical.

The frame assembly 2100 generally comprises a frame 2110 and a backing panel 2150. A display item 2116 is configured to be supported by the frame assembly 2100 between the frame 2110 and the backing panel 2150 in much the same way as has been described throughout this document. In particular, the frame 2110 comprises a front surface 2111, a rear surface 2112, a viewing window 2113, and a rabbet 2114. A transparent panel 2115 is disposed within the rabbet 2114 and functions to protect an exposed surface of the display item 2116 as it is displayed. The display item 2116 may be pressed against the transparent panel 2115 by biased members 2155 of the backing panel 2150.

The backing panel 2150 is a sheet of material, such as flexible plastic material, as has been described in detail above with regard to the previously described embodiments of the present invention. The backing panel 2150 comprises a hinge portion 2151 located along a bottom end thereof. In particular, a lower segment 2152 of the backing panel 2150 is folded along a fold line 2153 so that the lower segment 2152 of the backing panel 2150 overlaps a portion of the backing panel 2150. The lower segment 2152 can be pivoted/rotated about the fold line 2153 to alter the hinge portion 2151 from a folded configuration to an extended configuration. The backing panel 2150 also comprises a plurality of biased members 2155 protruding therefrom. The biased members 2155 are formed as cut-outs by cutting slits through the backing panel 2150 and then bending or folding the biased members 2155 so that they protrude from the front surface of the backing panel 2150.

Figure 23A:
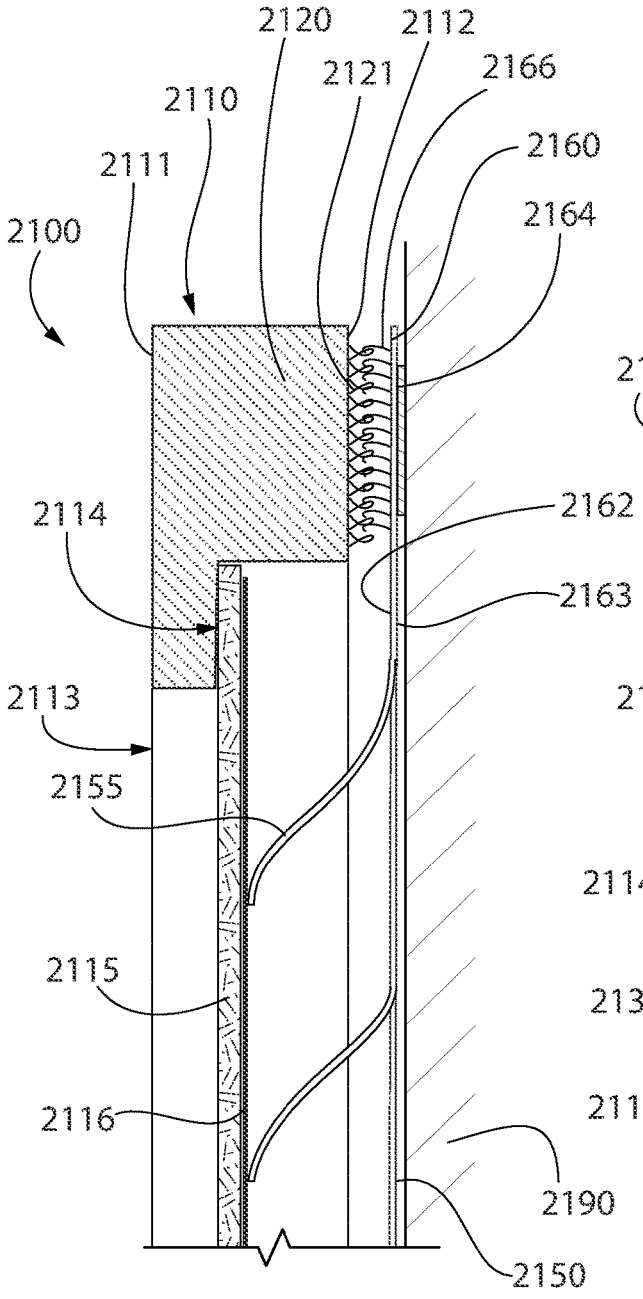
FIG. 23A is a cross-sectional view taken along line XXIIIA-XXIIIA of FIG. 22.
Figure 23B:
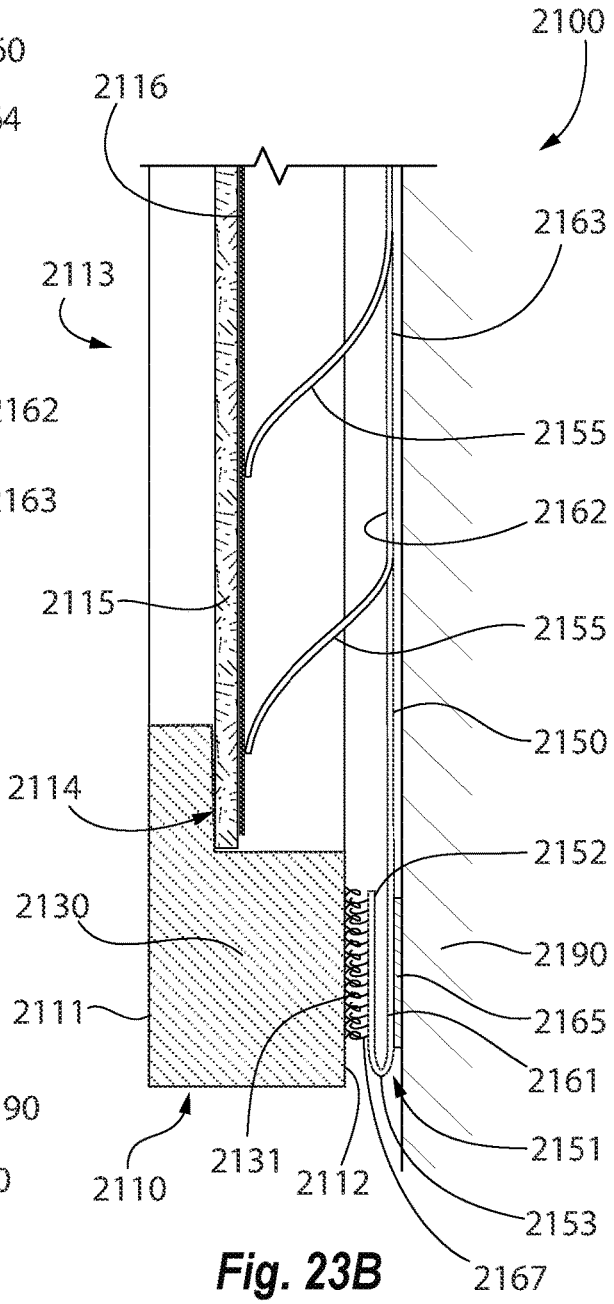
FIG. 23B is a cross-sectional view taken along line XXIIIB-XXIIIB of FIG. 22.

Referring in particular to FIGS. 23A and 23B, the coupling between the frame 2110 and the backing panel 2150 as well as the backing panel 2150 and the wall 2190 will be described. In this embodiment, the backing panel 2150 comprises a top portion 2160 and a bottom portion 2161. Furthermore, the backing panel 2150 comprises a front surface 2162 and a rear surface 2163. The backing panel 2150 is positioned against the wall 2190 with the rear surface 2163 of the backing panel 2150 facing the wall 2190. In the exemplified embodiment, a first adhesive strip 2164 is positioned on the rear surface 2163 of the backing panel 2150 along the top portion 2160 thereof and a second adhesive strip 2165 is positioned on the rear surface 2163 of the backing panel 2150 along the bottom portion 2161 thereof. In this embodiment, the first and second adhesive strips 2164, 2165 are double-sided adhesive strips. Thus, as the backing panel 2150 is pressed against the wall 2190, both the top and bottom portions 2160, 2161 of the backing panel 2150 will become coupled to the wall 2190. It may be possible to attach the backing panel 2150 to the wall 2190 using only the adhesive strip 2164 at the top portion 2160 of the backing panel 2150, but using both adhesive strips 2164, 2165 provides a more secure attachment particularly during pivoting of the frame 2110 as described herein.

Although the first and second adhesive strips 2164, 2165 are used for coupling the backing panel 2150 to the wall 2190 in the exemplified embodiment, the invention is not to be so limited in all embodiments. Thus, in one alternative embodiment, a fastener such as a screw, a nail, or a staple may be used to couple the top portion 2160 of the backing panel 2150 to the wall 2190 and another screw, nail, or staple may be used to couple the bottom portion 2161 of the backing panel 2150 to the wall 2190. Thus, the first and second adhesive strips 2164, 2165 are merely one possible non-limiting way for coupling the backing panel 2150 to the wall 2190.

In the exemplified embodiment, there is also a first securing member 2166 coupled to the front surface 2162 of the backing panel 2150 along the top portion 2160 thereof and a second securing member 2167 coupled to the rear surface 2163 of the backing panel 2150 along the lower segment 2152 of the backing panel 2150. Because the lower segment 2152 of the backing panel 2150 has been folded along the fold line 2153, the rear surface 2163 of the lower segment 2152 actually faces outward away from the wall 2190. In the exemplified embodiment, the first and second securing members 2166, 2167 are either one or more strips of hook fasteners or one or more strips of loop fasteners. However, the invention is not to be so limited and the first and second securing members 2166, 2167 could alternatively comprise snap-together fasteners (e.g., mushroom type), adhesive strips, or the like.

Still referring to FIGS. 23A and 23B, the frame 2110 comprises a top portion 2120 and a bottom portion 2130. A first securing member 2121 is attached to the rear surface 2112 of the frame 2110 along the top portion 2120 and a second securing member 2131 is attached to the rear surface 2112 of the frame 2110 along the bottom portion 2130. The first and second securing members 2121, 2131 may comprise adhesive on one surface thereof for purposes of coupling them to the frame 2110. The opposite surface of the first and second securing members 2121, 2131 may comprise connection features such as hooks, loops, snap-type fasteners such as mushroom style fasteners, or other such connection features described in this document or otherwise known in the art. In some embodiments, the first and second securing members 2166, 2167 on the backing panel 2150 comprise one of hooks or loops and the first and second securing members 2121, 2131 on the frame 2110 comprise the other one of hooks or loops. As a result, when the first and second securing members 2121, 2131 on the frame 2110 are brought into engagement or contact with the first and second securing members 2166, 2167 on the backing panel 2150, the first and second securing members 2121, 2131 on the frame 2110 become attached or otherwise coupled to the first and second securing members 2166, 2167 on the backing panel 2150.

FIG. 23A illustrates the attachment between the first securing member 2121 on the top portion 2120 of the frame 2110 and the first securing member 2166 on the top portion 2160 of the backing panel 2150. The first securing members 2121, 2166 have engaging hook and loop style fasteners that facilitate the detachable coupling therebetween. FIG. 23B illustrates the attachment between the second securing member 2131 on the bottom portion 2130 of the frame 2110 and the second securing member 2167 on the bottom portion 2161 of the backing panel 2150. The second securing members 2131, 2167 have engaging hook and loop style fasteners that facilitate a detachable coupling therebetween. However, in this embodiment, while the coupling between the first securing members 2121, 2166 must be detachable to permit the desired function, the coupling between the second securing members 2131, 2167 need not be detachable and could instead be permanent (such as by using adhesives or the like).

FIGS. 23A and 23B illustrate the frame 2110 in a closed position and the hinge portion 2151 of the backing panel 2150 in a folded configuration. A user can alter the frame 2110 into an open position by rotating the frame 2110 and the hinge portion 2151 of the backing panel 2150 about the fold line 2153. In particular, a user can detach the first securing members 2121, 2166 from each other by pulling the top portion 2120 of the frame 2110 away from the backing panel 2150 and the wall 2190. Once the first securing members 2121, 2166 are detached from one another, the frame 2110 can be pivoted or rotated away from the backing panel 2150 and the wall 2190. Such pivoting/rotating of the frame 2110 causes the lower segment 2152 of the backing panel 2150 to rotate relative to a remainder of the backing panel 2150 about the fold line 2153. Thus, this action serves to pull the top portion 2120 of the frame 2110 away from the wall 2190 so that an access opening or passageway is created into the space between the frame 2110 and the wall 2190 (or between the frame 2110 and the backing panel 2150). Once the frame 2110 has been pivoted or rotated a sufficient distance, a user can reach into the space between the frame 2110 and the backing panel 2150 or wall 2190 to remove and/or insert different display items 2116 into the rabbet 2114 of the frame 2110. Once a desired display item 2116 is so positioned, the top portion 2120 of the frame 2210 can be rotated back towards the wall 2190 to re-engage the first securing member 2121 on the frame 2110 with the first securing member 2166 on the backing panel 2150. Doing this will cause the biased members 2155 to press the display item 2116 into contact with the transparent panel 2115 and/or the floor of the rabbet 2114 to hold it in place. This process can be repeated as many times as desired to put different display items 2116 into the frame 2110.

The present disclosure may be embodied in other specific forms without departing from its spirit or essential characteristics. Thus, the described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A frame assembly comprising:

a frame comprising a front surface, a rear surface opposite the front surface, a rabbet defined by an inner surface and a floor, and a viewing window;

one or more retaining members coupled to the frame along the inner surface of the rabbet, a first portion of the one or more retaining members protruding from the inner surface of the rabbet and being spaced apart from the floor of the rabbet by a gap;

a transparent panel located in the rabbet and positioned in the gap between the first portion of the one or more retaining members and the floor of the rabbet, the transparent panel covering the viewing window;

a hinge member comprising a front surface and a rear surface, the hinge member being alterable between: (1) a folded position whereby a first portion of the hinge member overlaps a second portion of the hinge member so that the front surface of the hinge member along the first portion faces the front surface of the hinge member along the second portion; and (2) an extended position whereby the first portion of the hinge member is rotated away from the second portion of the hinge member;

a first securing member coupled to the rear surface of the hinge member along the first portion of the hinge member;

a second securing member coupled to the rear surface of the frame and extending along a first axis;

a third securing member coupled to the rear surface of the frame and extending along a second axis that is perpendicular to the first axis;

wherein the rear surface of the frame is coupled to the rear surface of the hinge member along the first portion of the hinge member such that altering the hinge member from the folded position to the extended position pivots the frame from a closed position to an open position; and wherein the frame is configured to be coupled to the hinge member in a portrait orientation by coupling the second securing member to the first securing member and in a landscape orientation by coupling the third securing member to the first securing member.

2. The frame assembly according to claim 1 wherein the frame assembly is configured to receive a display item in the gap at a location between the transparent panel and the first portion of the one or more retaining members to retain the display item in the rabbet of the frame.

3. The frame assembly according to claim 1 wherein the one or more retaining members comprise a second portion coupled directly to the inner surface of the rabbet, the second portion comprising a first end positioned closest to the floor of the rabbet and a second end positioned furthest from the floor of the rabbet, the first portion protruding from the first end of the second portion in a direction away from the floor of the rabbet.

4. The frame assembly according to claim 3 wherein for each of the one or more retaining members, the first portion extends obliquely from the end of the second portion in the direction away from the floor of the rabbet.

5. The frame assembly according to claim 1 wherein the second portion of the hinge member is configured to be coupled to a wall, and wherein the frame is detachably coupled to the first portion of the hinge member.

6. The frame assembly according to claim 1 wherein the hinge member is rotatable between the folded and extended positions by rotating the first portion of the hinge member relative to the second portion of the hinge member along a folding line that separates the first portion of the hinge member from the second portion of the hinge member.

7. The frame assembly according to claim 1 wherein the one or more retaining members are L-shaped brackets.

8. The frame assembly according to claim 1 wherein the frame comprises a plurality of linear frame segments each defining a linear portion of the rabbet, and further comprising a plurality of the one or more retaining members, wherein each of the plurality of one or more retaining members is coupled to one of the linear frame segments along one of the linear portions of the rabbet.

9. The frame assembly according to claim 1 wherein the first securing member comprises one of a hook strip or a loop strip and each of the second and third securing members comprise the other one of a hook strip or a loop strip.

10. The frame assembly according to claim 1 wherein the one or more retaining members are flexible tabs that are configured to be bent to enable a display item to be inserted into and removed from the gap.

11. The frame assembly according to claim 1 wherein pivoting the frame from the closed position to the open position comprises moving a lower portion of the frame in a direction away from a wall on which the frame assembly is hung so that a user can remove and replace a display item positioned between the first portion of the one or more retaining members and the transparent panel without detaching the frame assembly from the wall.

12. The frame assembly according to claim 1 wherein an upper portion of the frame is attached directly to the hinge member and a remainder of the frame hangs freely from the hinge member without being coupled to the hinge member or to a wall on which the frame assembly is hung.

13. A frame assembly comprising:

a stand comprising a horizontal support portion and a vertical display portion extending upwardly from the horizontal support portion, the vertical display portion comprising a hinge portion and at least one biased member;

a frame comprising a rabbet and a display window, the frame leaning against the vertical display portion of the stand and coupled to the hinge portion of the vertical display portion of the stand; and wherein the frame is pivotable between: (1) a first position whereby the hinge portion of the vertical display portion of the stand is in a folded position and a display item is pressed against the rabbet of the frame by the at least one biased member; and (2) a second position whereby the hinge portion of the vertical display portion rotates from the folded position to an extended position, thereby rotating a portion of the frame away from the vertical display portion so that the display item can be removed from the rabbet.

14. The frame assembly according to claim 13 wherein the vertical display portion is oriented at an oblique angle relative to the horizontal support portion so that the vertical display portion extends upwardly from a front edge of the horizontal support portion and is angled rearwardly towards a rear edge of the horizontal support portion as it extends further from the horizontal support portion.

15. The frame assembly according to claim 13 wherein a lower portion of the frame is coupled to the hinge portion of the vertical display portion of the stand, and wherein pivoting the frame from the first position to the second position causes an upper portion of the frame to pivot away from the vertical display portion of the stand to provide a user with access into a space between the frame and the vertical display portion of the stand.

16. The frame assembly according to claim 15 wherein the upper portion of the frame is detachably coupled to the vertical display portion by one or more securing members, and wherein the upper portion of the frame is detached from the vertical display portion during pivoting of the frame from the first position to the second position.

17. The frame assembly according to claim 13 wherein the hinge portion is formed by folding a lower segment of the vertical display portion upwardly along a fold line, and wherein the hinge portion rotates about the fold line as the frame is pivoted between the first and second positions.

18. The frame assembly according to claim 13 wherein the vertical display portion of the stand comprises a rigid support member and a flexible panel member coupled to the rigid support member, wherein the flexible panel member comprises the hinge portion and the at least one biased member, wherein the at least one biased member comprises a plurality of biased members that are partially cut out from the flexible panel member, each of the plurality of biased members extending outwardly and downwardly relative to the rigid support member.

19. A frame assembly comprising:

a backing panel configured to be mounted on a support surface, the backing panel comprising a body portion and a hinge portion, the hinge portion formed by a segment of the backing panel being folded about a fold line of the backing panel;

a frame comprising a lower frame member that is coupled to the hinge portion of the backing panel and an upper frame member that is coupled to the body portion of the backing panel, wherein the frame is configured to be pivoted relative to the body portion of the backing panel about the fold line while the backing panel remains mounted on the support surface; and one or more biased members configured to press an item positioned between the frame and the backing panel in a direction towards the frame.

20. A frame assembly comprising:

a frame comprising a front surface, a rear surface, a first rabbet, and a second rabbet, the second rabbet being positioned between the first rabbet and the rear surface;

a transparent panel coupled to the frame within the first rabbet;

a backing panel configured to be mounted to a wall, the backing panel comprising a body portion comprising a plurality of biased members and a hinge portion;

wherein the frame is coupled to the hinge portion so that the frame can be pivoted relative to the body portion of the backing panel between a closed position whereby the biased members of the backing panel are configured to press a display item against a floor of the second rabbet of the frame and an open position whereby a portion of the frame is configured to be pivoted away from the wall so that the display item can be removed; and wherein the hinge portion is formed by folding an upper segment of the backing panel about a folding line, and wherein the frame is coupled to the hinge portion via adhesive strips or hook and loop fastener strips.

* * * * *